US008967621B2

(12) United States Patent
Sines et al.

(10) Patent No.: US 8,967,621 B2
(45) **Date of Patent: *Mar. 3, 2015**

(54) CARD SHUFFLING APPARATUSES AND RELATED METHODS

(71) Applicant: Bally Gaming, Inc., Las Vegas, NV (US)

(72) Inventors: Randy D. Sines, Spokane, WA (US); Gary W. Griffin, Minneapolis, MN (US); Joseph J. Lahti, Long Lake, MN (US)

(73) Assignee: Bally Gaming, Inc., Las Vegas, NV (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/631,543

(22) Filed: Sep. 28, 2012

(65) Prior Publication Data

US 2013/0020761 A1 Jan. 24, 2013

Related U.S. Application Data

(63) Continuation-in-part of application No. 13/101,717, filed on May 5, 2011, now Pat. No. 8,469,360, which is a continuation of application No. 12/384,732, filed on Apr. 7, 2009, now Pat. No. 7,988,152.

(51) Int. Cl.
*A63F 1/12* (2006.01)

(52) U.S. Cl.
CPC ..... *A63F 1/12* (2013.01)
USPC ..... 273/149 R; 273/149 P

(58) Field of Classification Search
USPC ..... 273/149 R, 149 P
See application file for complete search history.

(56) References Cited

U.S. PATENT DOCUMENTS 609,730 A 8/1898 Booth
892,389 A 7/1908 Bellows (Continued)

FOREIGN PATENT DOCUMENTS

CA 2266555 9/1996
DE 672616 11/1949

(Continued)

OTHER PUBLICATIONS

PCT International Search Report and Written Opinion of the International Searching Authority for PCT/US2010/001032, dated Jun. 16, 2010, 11 pages.

*Primary Examiner* — Benjamin Layno
(74) *Attorney, Agent, or Firm* — TraskBritt

(57) ABSTRACT

Card shuffler apparatuses include a card repositioner used to randomly reposition a plurality of cards on-edge over an aperture extending through a card support surface to allow cards to sequentially pass through the aperture in a random order. The apparatuses may be capable of continuously and sequentially forming playing card hands for use in a game. Shuffler apparatuses may be used to obtain a measurement relating to a thickness of the deck of cards. Methods involve the use of card shuffler apparatuses to form one or more playing card hands in a playing card game. Additional methods involve counting playing cards present within a stack of playing cards using a shuffler apparatus. In further methods, a number of shuffler apparatuses and a lesser number of shuffler activation devices are provided in a gaming establishment so as to preclude simultaneous use of all the shuffler apparatuses in the establishment.

44 Claims, 30 Drawing Sheets

(56) References Cited

U.S. PATENT DOCUMENTS 1,998,690 A 4/1935 Shepherd et al.
2,060,096 A 11/1936 McCoy
2,692,777 A 10/1954 Miller
2,747,877 A 5/1956 Howard
3,588,116 A 6/1971 Miura
3,618,933 A 11/1971 Roggenstein
4,023,705 A 5/1977 Reiner et al.
4,513,969 A 4/1985 Samsel
4,515,367 A 5/1985 Howard
4,586,712 A 5/1986 Lorber et al.
4,659,082 A 4/1987 Greenberg
4,667,959 A 5/1987 Pfeiffer et al.
4,770,421 A 9/1988 Hoffman
4,807,884 A 2/1989 Breeding
4,969,648 A 11/1990 Hollinger et al.
5,096,197 A 3/1992 Embury
5,118,114 A 6/1992 Tucci et al.
5,121,921 A 6/1992 Friedman
5,261,667 A 11/1993 Breeding
5,275,411 A 1/1994 Breeding
5,303,921 A 4/1994 Breeding
5,356,145 A 10/1994 Verschoor
5,382,024 A 1/1995 Blaha
5,397,128 A 3/1995 Hesse et al.
5,431,399 A * 7/1995 Kelley ..... 273/149 P
5,431,407 A 7/1995 Hofberg et al.
5,445,377 A 8/1995 Steinbach
D365,853 S 1/1996 Zadro
5,489,101 A 2/1996 Moody et al.
5,531,448 A 7/1996 Moody et al.
5,544,892 A 8/1996 Breeding et al.
5,575,475 A 11/1996 Steinbach
5,584,483 A 12/1996 Sines et al.
5,586,766 A 12/1996 Forte et al.
5,605,334 A 2/1997 McCrea et al.
5,676,372 A 10/1997 Sines et al.
5,683,085 A 11/1997 Johnson et al.
5,685,543 A 11/1997 Garner et al.
5,692,748 A 12/1997 Frisco et al.
5,695,189 A 12/1997 Breeding et al.
5,707,287 A 1/1998 McCrea, Jr.
5,711,525 A 1/1998 Breeding et al.
5,718,427 A 2/1998 Cranford et al.
5,735,525 A 4/1998 McCrea et al.
5,791,988 A 8/1998 Nomi et al.
5,839,730 A 11/1998 Pike
5,845,906 A 12/1998 Wirth et al.
5,879,233 A 3/1999 Stupero
5,883,804 A 3/1999 Christensen
5,911,626 A 6/1999 McCrea et al.
5,944,310 A 8/1999 Johnson et al.
D414,527 S 9/1999 Tedham
5,991,308 A 11/1999 Fuhrmann et al.
6,019,368 A 2/2000 Sines et al.
6,019,374 A 2/2000 Breeding et al.
6,050,569 A 4/2000 Taylor
6,068,258 A 5/2000 Breeding et al.
6,093,103 A 7/2000 McCrea et al.
6,113,101 A 9/2000 Wirth et al.
D432,588 S 10/2000 Tedham
6,139,014 A 10/2000 Breeding et al.
6,149,154 A 11/2000 Grauzer et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,293,546 B1 9/2001 Hessing et al.
6,299,167 B1 10/2001 Sines et al.
6,299,534 B1 10/2001 Breeding et al.
6,325,373 B1 12/2001 Breeding et al.
6,334,614 B1 1/2002 Breeding
6,341,778 B1 1/2002 Lee
6,346,044 B1 2/2002 McCrea, Jr.
6,361,044 B1 3/2002 Block et al.
6,386,973 B1 5/2002 Yoseloff
6,454,266 B1 9/2002 Breeding et al.
6,561,897 B1 5/2003 Bourbour et al.
6,568,678 B2 5/2003 Breeding et al.
6,582,301 B2 6/2003 Hill
6,585,588 B2 7/2003 Hartl
6,588,750 B1 * 7/2003 Grauzer et al. ..... 273/149 R
6,588,751 B1 7/2003 Grauzer et al.
6,638,161 B2 10/2003 Soltys et al.
6,651,981 B2 11/2003 Grauzer et al.
6,651,982 B2 11/2003 Grauzer et al.
6,651,985 B2 11/2003 Sines et al.
6,655,684 B2 12/2003 Grauzer et al.
6,655,690 B1 12/2003 Oskwarek
6,659,460 B2 12/2003 Blaha et al.
6,659,461 B2 12/2003 Yoseloff et al.
6,676,127 B2 1/2004 Johnson et al.
6,688,597 B2 2/2004 Jones
6,698,756 B1 3/2004 Baker et al.
6,698,759 B2 3/2004 Webb et al.
6,702,290 B2 3/2004 Buono-Correa et al.
6,719,288 B2 4/2004 Hessing et al.
6,726,205 B1 4/2004 Purton
6,733,012 B2 5/2004 Bui et al.
6,769,693 B2 8/2004 Huard et al.
6,789,801 B2 9/2004 Snow
6,802,510 B1 10/2004 Haber
6,808,173 B2 10/2004 Snow
6,840,517 B2 1/2005 Snow
6,874,784 B1 4/2005 Promutico
6,874,786 B2 4/2005 Bruno
6,877,748 B1 4/2005 Patroni
6,886,829 B2 5/2005 Hessing et al.
6,889,979 B2 5/2005 Blaha
6,902,167 B2 6/2005 Webb
6,905,121 B1 6/2005 Timpano
6,923,446 B2 8/2005 Snow
6,938,900 B2 9/2005 Snow
6,950,948 B2 9/2005 Neff
6,955,599 B2 10/2005 Bourbour et al.
6,959,925 B1 11/2005 Baker et al.
6,960,134 B2 11/2005 Hartl et al.
6,986,514 B2 1/2006 Snow
7,029,009 B2 4/2006 Grauzer et al.
7,036,818 B2 5/2006 Grauzer et al.
7,048,629 B2 5/2006 Sines et al.
7,059,602 B2 6/2006 Grauzer et al.
7,066,464 B2 6/2006 Blad et al.
7,073,791 B2 7/2006 Grauzer et al.
7,114,718 B2 10/2006 Grauzer et al.
7,137,627 B2 11/2006 Grauzer et al.
7,140,614 B2 11/2006 Snow
7,165,769 B2 1/2007 Crenshaw et al.
7,165,770 B2 1/2007 Snow
7,175,522 B2 2/2007 Hartl
7,201,656 B2 4/2007 Darder
7,213,812 B2 5/2007 Schubert et al.
7,222,855 B2 5/2007 Sorge
7,243,148 B2 7/2007 Keir et al.
7,243,698 B2 7/2007 Siegel
7,246,799 B2 7/2007 Snow
7,255,344 B2 8/2007 Grauzer et al.
7,255,351 B2 8/2007 Yoseloff et al.
7,255,642 B2 8/2007 Sines et al.
7,257,630 B2 8/2007 Cole et al.
7,261,294 B2 8/2007 Grauzer et al.
7,264,241 B2 9/2007 Schubert et al.
7,264,243 B2 9/2007 Yoseloff et al.
7,278,923 B2 10/2007 Grauzer et al.
7,294,056 B2 11/2007 Lowell et al.
7,300,056 B2 11/2007 Gioia et al.
7,309,065 B2 12/2007 Yoseloff et al.
7,316,609 B2 1/2008 Dunn et al.
7,322,576 B2 1/2008 Grauzer et al.
7,331,579 B2 2/2008 Snow
7,334,794 B2 2/2008 Snow
7,338,044 B2 3/2008 Grauzer et al.
7,338,362 B1 3/2008 Gallagher
7,341,510 B2 3/2008 Bourbour et al.
7,360,094 B2 4/2008 Neff

(56) References Cited

U.S. PATENT DOCUMENTS

| | | | |
|---|---|---|---|
| 7,367,561 | B2 | 5/2008 | Blaha et al. |
| 7,367,563 | B2 | 5/2008 | Yoseloff et al. |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,513,437 | B2 | 4/2009 | Douglas |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs, III et al. |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,669,852 | B2 | 3/2010 | Baker et al. |
| 7,669,853 | B2 | 3/2010 | Jones |
| 7,988,152 | B2 | 8/2011 | Sines |
| 2002/0017481 | A1 | 2/2002 | Johnson et al. |
| 2002/0063389 | A1 | 5/2002 | Breeding et al. |
| 2002/0070499 | A1 | 6/2002 | Breeding et al. |
| 2002/0113368 | A1 | 8/2002 | Hessing et al. |
| 2002/0155869 | A1 | 10/2002 | Soltys et al. |
| 2002/0163125 | A1 | 11/2002 | Grauzer et al. |
| 2002/0187821 | A1 | 12/2002 | Soltys et al. |
| 2003/0052449 | A1 | 3/2003 | Grauzer et al. |
| 2003/0052450 | A1 | 3/2003 | Grauzer et al. |
| 2003/0064798 | A1 | 4/2003 | Grauzer et al. |
| 2003/0067112 | A1 | 4/2003 | Grauzer et al. |
| 2003/0073498 | A1 | 4/2003 | Grauzer et al. |
| 2003/0075865 | A1 | 4/2003 | Grauzer et al. |
| 2003/0090059 | A1 | 5/2003 | Grauzer et al. |
| 2003/0094756 | A1 | 5/2003 | Grauzer et al. |
| 2003/0151194 | A1 | 8/2003 | Hessing et al. |
| 2004/0036214 | A1 | 2/2004 | Baker et al. |
| 2004/0067789 | A1 | 4/2004 | Grauzer et al. |
| 2004/0108654 | A1 | 6/2004 | Grauzer et al. |
| 2004/0169332 | A1 | 9/2004 | Grauzer et al. |
| 2004/0224777 | A1 | 11/2004 | Smith et al. |
| 2004/0245720 | A1 | 12/2004 | Grauzer et al. |
| 2004/0259618 | A1 | 12/2004 | Soltys et al. |
| 2005/0012671 | A1 | 1/2005 | Bisig |
| 2005/0023752 | A1 | 2/2005 | Grauzer et al. |
| 2005/0051956 | A1 | 3/2005 | Grauzer et al. |
| 2005/0062228 | A1 | 3/2005 | Grauzer et al. |
| 2005/0062229 | A1 | 3/2005 | Grauzer et al. |
| 2005/0082750 | A1 | 4/2005 | Grauzer et al. |
| 2005/0093230 | A1 | 5/2005 | Grauzer et al. |
| 2005/0093231 | A1 | 5/2005 | Grauzer et al. |
| 2005/0104289 | A1 | 5/2005 | Grauzer et al. |
| 2005/0104290 | A1 | 5/2005 | Grauzer et al. |
| 2005/0110211 | A1 | 5/2005 | Blad et al. |
| 2005/0140090 | A1 | 6/2005 | Breeding et al. |
| 2005/0146093 | A1 | 7/2005 | Grauzer et al. |
| 2005/0206077 | A1 | 9/2005 | Grauzer et al. |
| 2006/0066048 | A1 | 3/2006 | Krenn et al. |
| 2006/0181022 | A1 | 8/2006 | Grauzer et al. |
| 2006/0220312 | A1 | 10/2006 | Baker et al. |
| 2006/0220313 | A1 | 10/2006 | Baker et al. |
| 2006/0281534 | A1 | 12/2006 | Grauzer et al. |
| 2007/0001395 | A1 | 1/2007 | Gioia et al. |
| 2007/0069462 | A1 | 3/2007 | Downs et al. |
| 2007/0102879 | A1 | 5/2007 | Stasson |
| 2007/0222147 | A1 | 9/2007 | Blaha |
| 2007/0272600 | A1 | 11/2007 | Johnson |
| 2007/0278739 | A1 | 12/2007 | Swanson |
| 2007/0290438 | A1 | 12/2007 | Grauzer et al. |
| 2008/0006997 | A1 | 1/2008 | Scheper et al. |
| 2008/0006998 | A1 | 1/2008 | Grauzer et al. |
| 2008/0113700 | A1 | 5/2008 | Czyzewski et al. |
| 2008/0284096 | A1 | 11/2008 | Toyama |
| 2008/0315517 | A1 | 12/2008 | Toyama |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0121429 | A1 | 5/2009 | Walsh |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho |
| 2009/0267297 | A1 | 10/2009 | Blaha et al. |
| 2009/0283969 | A1 | 11/2009 | Tseng |
| 2009/0302535 | A1 | 12/2009 | Ho |
| 2009/0302537 | A1 | 12/2009 | Ho |
| 2009/0314188 | A1 | 12/2009 | Toyama et al. |
| 2010/0013152 | A1 | 1/2010 | Grauzer et al. |

FOREIGN PATENT DOCUMENTS

| | | |
|---|---|---|
| GB | 414014 | 7/1934 |
| JP | 2001-327647 A | 11/2001 |
| JP | 2005-198668 A | 7/2005 |
| WO | 9840136 | 9/1998 |
| WO | 0051076 | 2/1999 |
| WO | 2010/117446 | 10/2010 |

* cited by examiner

CARD SHUFFLING APPARATUSES AND RELATED METHODS

CROSS-REFERENCE TO RELATED APPLICATIONS

This application is a continuation-in-part of U.S. patent application Ser. No. 13/101,717, filed on May 5, 2011, now U.S. Pat. No. 8,469,360, issued Jun. 25, 2013, and entitled "PLAYING CARD SHUFFLER," which is a continuation of U.S. patent application Ser. No. 12/384,732, filed on Apr. 7, 2009, now U.S. Pat. No. 7,988,152, issued Aug. 2, 2011, and entitled "PLAYING CARD SHUFFLER," the disclosures of which are incorporated herein in their entireties by this reference.

TECHNICAL FIELD

The technical field of this disclosure is shuffling machines for shuffling playing cards used in gaming.

BACKGROUND

Shuffling machines, or shufflers, are widely used in casinos, card rooms and many other venues at which card games are played. Conventional shufflers are typically adapted to receive one or more decks of standard playing cards to be shuffled. The intended purpose of most shufflers is to shuffle the playing cards into what is believed to be a random order. Such a random order of the playing cards is desirable when playing various types of card games such as blackjack, poker and the like. However, in reality most shufflers have tendencies to shuffle or reorder the deck or decks in a manner that skilled card counters can perceive and use to their advantage versus the casino, house or other player. Thus, there is still a need for automated shufflers that function in a manner which more truly randomizes the ordering of a deck or decks of playing cards.

Other problems associated with at least some conventional shufflers include excessive size, excessive weight, excessive mechanical complexity and/or electronic complexity. These complexities also may fail to achieve a suitable degree of shuffling, reordering or recompiling into a truly random order from one shuffling process to another. Accordingly, there is still a need for improved automated shuffling machines for playing cards that produce reordering of card decks in a manner which is closer to true randomness and which is more difficult for skilled card players to decipher to change the odds so as to be relatively favorable to the player versus unfavorable portions of a deck or decks of cards.

One casino game commonly called "blackjack" or "21" is known to be susceptible to card counting and casinos are routinely spending significant amounts of money trying to prevent card counters from taking advantage of non-random sequences in the decks held within a dealing shoe that holds the decks being dealt. Poker has also grown in popularity and is played with a single deck, which makes any knowledge of cards of potential significance to a player.

The embodiments of the disclosure shown and described herein may be used to address one or more of such problems or other problems not set out herein and/or which are only understood or appreciated at a later time. The future may also bring to light currently unknown or unrecognized benefits which may be appreciated, or more fully appreciated, in association with the embodiments of the disclosure shown and described herein. The desires and expected benefits explained herein are not admissions that others have recognized such prior needs, since invention and discovery are both inventive under the law and may relate to the embodiments of the disclosure described herein.

BRIEF SUMMARY

In some embodiments, the present disclosure includes shuffler apparatuses for randomly shuffling a plurality of cards. The shuffler apparatuses include a card support surface for supporting a plurality of cards thereon, a repositioner for receiving and supporting the plurality of cards over the card support surface, and a card collector. The card support surface has an aperture extending through the card support surface for allowing cards of the plurality of cards to pass through the card support surface. The repositioner is configured to randomly reposition the plurality of cards over the aperture extending through the card support surface to allow one or more cards of the plurality of cards to sequentially pass through the aperture in a random order. The card collector is configured to sequentially receive the one or more cards of the plurality of cards therein as they pass sequentially through the card aperture and form a plurality of shuffled cards in the card collector. In some embodiments, the shuffler apparatuses are adapted to continuously and sequentially form playing card hands in the card collector as the playing card hands are sequentially removed from the card collector, employed in a playing card game, and returned and added to the plurality of cards over the card support surface without completely depleting the plurality of cards over the card support surface.

In additional embodiments, the present disclosure includes shuffler apparatuses that include a repositioner for receiving and supporting a plurality of cards over a card support surface, and an electronic controller configured to control operation of the repositioner. The repositioner may comprise opposing face guides configured to support opposing faces of a stack comprising the plurality of cards over the card support surface. At least one face guide of the opposing face guides may be mounted to move relative to another face guide of the opposing face guides. The electronic controller may be configured to cause the at least one face guide of the opposing face guides to move toward the another face guide of the opposing face guides and squeeze the stack comprising the plurality of cards over the card support surface. The electronic controller also may be configured to record at least one measurement relating to a distance between the opposing face guides as the opposing face guides squeeze the stack comprising the plurality of cards therebetween.

In additional embodiments, the present disclosure includes methods of using a card shuffler apparatus to form one or more playing card hands in a playing card game. In accordance with such methods, a stack of playing cards may be supported on edge over a card support surface. The stack may be moved and randomly repositioned over an aperture extending through the card support surface, and cards may be allowed to pass sequentially from the stack through the aperture and into a card collector to form a first playing card hand in the card collector. Passage of cards through the aperture and/or movement of cards resting on a card stop may be paused after formation of the first playing card hand in the card collector for removal of the first playing card hand from the card collector. Passage of cards through the aperture and/or off the card stop may be continued after removing the first playing card hand from the card collector to form a second playing card hand in the card collector.

In additional embodiments, the present disclosure includes methods of counting a number of playing cards present within a stack of playing cards using a shuffler apparatus. In accordance with such methods, at least one of a weight and a thickness of a stack of playing cards positioned over a card support surface within the card shuffler apparatus is measured to obtain at least one first measurement. All cards in the stack of playing cards are dispensed from the card shuffler apparatus, and a number of the cards dispensed from the card shuffler apparatus is counted upon dispensing all cards in the stack of playing cards from the card shuffler apparatus. Cards of the stack of playing cards dispensed from the card shuffler apparatus then may be repositioned over the card support surface within the card shuffler apparatus, and at least one of a weight and a thickness of the stack of playing cards repositioned over the card support surface within the card shuffler apparatus may be measured to obtain at least one second measurement. The at least one second measurement may then be compared with the at least one first measurement.

In additional embodiments, the present disclosure includes methods of using a plurality of shuffler apparatuses within a gaming establishment. In accordance with such methods, a first number of shuffler apparatuses may be provided in a gaming establishment. Each shuffler apparatus of the first number of shuffler apparatuses may comprise a receptacle for receiving an activation device therein. Operation of each shuffler apparatus of the first number of shuffler apparatuses is precluded when an activation device is not received within the receptacle. A second number of activation devices are provided in the gaming establishment, and the second number is less than the first number so as to preclude simultaneous use of all shuffler apparatuses of the first number of shuffler apparatuses in the gaming establishment.

DETAILED DESCRIPTION

Figure 1:
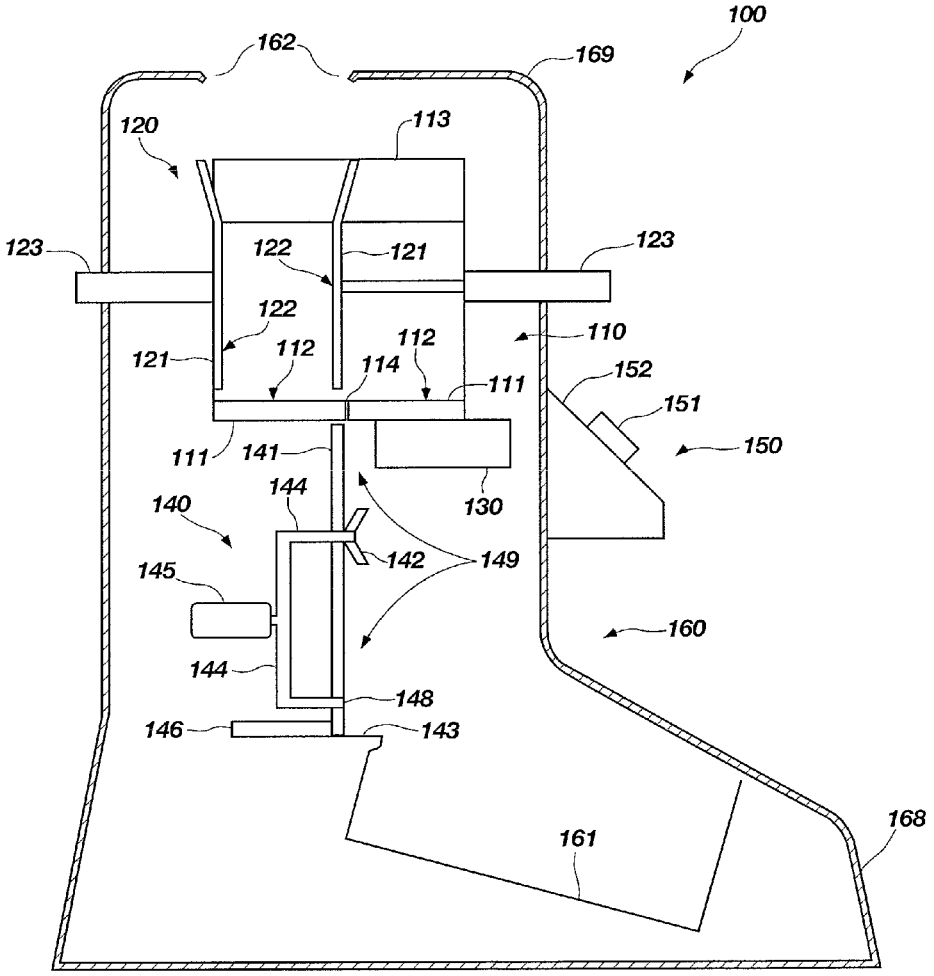
FIG. 1 is a diagrammatic elevational view of an apparatus according to at least one embodiment of the disclosure.

The readers of this document should understand that the embodiments described herein may rely on terminology used in any section of this document and other terms readily apparent from the drawings and the common language therefore as may be known in a particular art and such as known or indicated and provided by dictionaries. Dictionaries were used in the preparation of this document. Widely known and used in the preparation hereof are Webster's Third New International Dictionary, 1993, The Oxford English Dictionary, 2$^{nd}$ Ed., 1989, and The New Century Dictionary, 2001-2005, all of which are hereby incorporated by reference for interpretation of terms used herein and for application and use of words defined in such references, with the exception of those words and terms otherwise defined herein, to more adequately or aptly describe various features, aspects and concepts shown or otherwise described herein using more appropriate words having meanings applicable to such features, aspects and concepts.

As used herein, the term "gaming establishment" means and includes any establishment at which a card game takes place. Gaming establishments include, but are not limited to, casinos, card rooms, cruise ships, clubs, pubs, event centers, and private abodes.

As used herein, the term "card game" means and includes any game of chance played with organized rules using playing cards, played for gambling stakes or recreation. Card games include, but are not limited to, specialty casino games such as THREE CARD POKER®, LET IT RIDE®, CARIBBEAN STUD®, as well as standard games such as poker, blackjack, baccarat, and pai gow poker.

As used herein, the term "playing card hand" means any set of cards bearing a marked indicia or combination of marked indicia on each individual card, such as a number, suit, picture, or other symbol, which set is intended to be used by a participant in a playing card game.

As used herein, a "deck" of playing cards is any collected set of playing cards intended to be used in the formation of one or more playing card hands. For example, standard poker requires a deck of 52 cards with each card bearing a unique combination of suit (spades, hearts, clubs, diamonds), and number (two through ace), with or without one or more jokers. However, for purposes of this document, a deck of playing cards may also include less than or more than 52 cards, including without limitation, multiple 52-card decks combined into one deck, or a collection of less than 52 cards in which certain cards have been removed in compliance with rules of a game.

This document is premised upon using one or more terms with one embodiment that may also apply to other embodiments for similar structures, functions, features and aspects of the disclosure. Wording used in the claims is also descriptive of the embodiments of the disclosure, and the text and meaning of the claims and Abstract are hereby incorporated by reference into the description in their entirety as originally filed. Terminology used with one, some or all embodiments may be used for describing and defining the technology and exclusive rights associated herewith.

The readers of this document should further understand that the embodiments described herein may rely on terminology and features used in any suitable section or embodiment shown in this document and other terms readily apparent from the drawings and common language or proper therefore. This document is premised upon using one or more terms or features shown in one embodiment that may also apply to or be combined with other embodiments for similar structures, functions, features and aspects to provide additional embodiments of the disclosure.

FIG. 1 shows one playing card shuffler apparatus 100 according to the disclosure. The card shuffler apparatus 100 is adapted to shuffle a plurality of playing cards, which have been omitted from FIG. 1 for clarity. The card shuffler apparatus 100 is made up of several subassemblies or subsystems. As shown in FIG. 1, the sections include an entry section, wherein cards are placed into the card shuffler apparatus 100, a staging section where unshuffled cards are held, a controlled drop section through which cards that are positioned on-edge drop in a fashion facilitated by vibratory action, an intermediate or medial section through which any guiding or directing of dropped cards are affected in their movement toward a collection section, wherein the dropped cards are collected and recompiled, and an egress section from which the recompiled or shuffled cards are withdrawn for use in playing the card game or games of interest.

Card shuffler apparatus 100 includes at least one card support or supporter 110, a repositioner 120, also referred to herein as a positioner, an exciter 130, a card receiver 140, a controller 150, and a housing 160. An overview of each of these components is provided immediately below, followed by a more detailed individual description further below.

Still referring to FIG. 1, the supporter 110 functions to support the cards that are to be shuffled. More specifically, the supporter 110 supports the cards in a position substantially above the card receiver 140. The repositioner 120 functions to reposition the supported cards relative to the card receiver 140. The exciter 130 is configured to impart vibration to the supported cards. The card receiver 140 is adapted to receive one or more cards dropped from the supporter 110. The card receiver 140 may be advantageously configured to receive only one card at a time from the supporter 110. The controller 150 functions to control various operational aspects of the card shuffler apparatus 100. The housing 160 can have one or more functions including, but not limited to, that of a chassis or frame to support one or more of the other components of the card shuffler apparatus 100.

During a typical use of the card shuffler apparatus 100, at least one deck of playing cards can be placed into the housing 160 so as to rest on the supporter 110 in an upstanding orientation. The repositioner 120 is activated to move the supported cards to a first randomly selected position above the card receiver 140. The exciter 130 is activated to produce a mechanical vibration. This vibration is of a frequency and amplitude sufficient to cause playing cards to "dance," or otherwise vibrate, on the supporter 110. For example, the vibration can give the cards an appearance of floating just above the supporter 110 or the vibration may be almost or totally unperceivable by the naked eye.

One of the playing cards that is positioned substantially directly above the card receiver 140 will drop down into the card receiver 140 during operation of the card shuffler apparatus 100. When a card has dropped into the card receiver 140, the card receiver 140 is blocked so that no other cards can enter the card receiver 140. After the first card has dropped into, and is held within, the card receiver 140, the repositioner 120 shifts or moves the supported cards to a second, randomly selected position above the card receiver 140. After the supported cards are repositioned, the card receiver 140 is controlled to release the first card. For example, the card receiver 140 can be configured to help guide the card into a card collector 161. Releasing the first card from the card receiver 140 unblocks the card receiver 140. More specifically, when the first card is released from the card receiver 140, the card receiver 140 is now able to receive a second card.

Accordingly, a second card drops into the card receiver 140 from the supporter 110. The second card is held in the card receiver 140 so that the card receiver 140 is blocked again, preventing any other cards from entering the card receiver 140. After the second card drops into the card receiver 140, the repositioner 120 is again activated to move or shift the supported cards to a third, randomly selected position substantially above the card receiver 140. The second card is then released from the card receiver 140, thus allowing a third card to drop into the card receiver 140 from the supporter 110. The second card may be placed onto the first card to begin forming a recompiled or shuffled array or stack of cards 20 (see FIG. 9). The third card is likewise stacked on top of the second card. This operation can be continued as desired to randomly reorder the deck or decks of cards. In practice, the card shuffler apparatus 100 can be configured to repetitively perform steps of the operation very quickly.

As mentioned above with reference to FIG. 1, the card shuffler apparatus 100 includes a card supporter 110. The card supporter 110 may include a card rest 111. The card rest 111 is adapted to support the playing cards to be shuffled in an orientation that is on-edge. The card supporter 110 can include a support surface 112. The support surface 112 may be defined on the card rest 111. Playing cards that are to be shuffled can contact the support surface 112 while being supported on the card supporter 110. More specifically, the cards to be shuffled can be supported on the support surface 112. The support surface 112 may be substantially flat and/or straight as depicted. The card shuffler apparatus 100 can be configured such that the support surface 112 is in a substantially horizontal orientation during normal operation of the card shuffler apparatus 100.

The card supporter 110 can include one or more edge guides 113. The card supporter 110 may include a pair of edge guides 113, between which the cards to be shuffled are positioned and advantageously supported, such as at the ends laterally. The card supporter 110 may be configured to support the cards in a substantially upstanding orientation. More specifically, the card supporter 110 may be configured to support playing cards oriented on-edge. According to an embodiment of the disclosure, cards to be shuffled are supported in an orientation substantially normal to the support surface 112 and substantially normal to the one or more edge guides 113. It is to be understood, however, that the descriptions and depictions provided herein are not intended to limit the shape and/or orientation of one or more components of the card supporter 110. For example, it should be understood that the support surface 112 need not be substantially flat, and that the support surface 112 need not be substantially horizontal. The lateral face and end of support surface 112 may also vary in shape and orientation. The bottom of support surface 112 can have at least one of a number of possible shapes, contours and/or orientations.

One or more components of the card supporter 110 can be designed and/or configured to have at least one resonant frequency, or a range of resonant frequencies. The resonant frequency can be selected to desirably affect imparting vibratory action to the cards supported by the card supporter 110. For example, a resonant frequency can be selected to enhance vibration that is produced by the exciter 130, and which is imparted to the playing cards, such as via card rest 111.

With continued reference to FIG. 1, one or more card apertures 114 is or are preferably defined in the card rest 111. However, as depicted, one card aperture 114 preferably passes through the support surface 112. The card aperture can be configured substantially in the manner of a slot through which at least one playing card can pass. Preferably, the card aperture 114 is configured to allow passage of only one card at a time. More specifically, the width of the card aperture 114 is greater than the thickness of a single playing card, but less than twice the thickness of a single playing card. Card aperture 114 as shown may be substantially straight. The card aperture 114 has a width that may be substantially constant along its length. The card aperture 114 may have a length that exceeds a length of a card edge to enable a card to drop through the card aperture 114.

The card aperture 114 or apertures in the card rest 111 can be configured in a manner, wherein the card aperture 114 is selectively operable. Such card aperture 114 or apertures may be configured to be selectively opened and closed or blocked and unblocked according to at least one embodiment of the disclosure. For example, the card rest 111 can be made up of two portions. The two portions of the card rest 111 can be made to move together to substantially close or block the card aperture 114 or apertures.

Conversely, two portions of the card rest 111 can be made to move away from each other to form a card aperture 114 or apertures. Alternatively, one or more gate elements such as described below can be included. Such a gate element or elements can be adapted to move relative to the card rest 111 so as to selectively close or block the card aperture 114.

Preferably, the card rest 111 is adapted to support playing cards until the cards are released through one or more card apertures 114. In accordance with at least one preferred embodiment of the disclosure, the card rest 111 is adapted to support playing cards on-edge. For example, the card rest 111 can be adapted to support playing cards in a substantially upright or upstanding orientation. It is to be understood that when playing cards are supported on-edge by the card rest 111, the cards need not be truly vertical. For example, in accordance with at least one embodiment of the disclosure, the card rest 111 is adapted to support playing cards on-edge, wherein the cards are not truly vertical. For example, the card rest 111 can be adapted to support playing cards on-edge in an oblique or leaning, non-vertical, or acceptably tilted orientation, which can vary dependent upon the specific construction of each card shuffler apparatus 100.

The card rest 111 may be adapted to selectively impart a vibratory action to playing cards supported on the card rest 111. In accordance with an embodiment of the disclosure, the card rest 111 is adapted to selectively impart a vibratory action to the playing cards while the cards are supported on-edge by the card rest 111. For example, the card rest 111 can be caused to vibrate, which in turn, can impart a vibratory action to playing cards supported thereon. Vibratory action can preferably be imparted to the card rest 111 by the exciter 130, which is described in greater detail below.

The preferred vibratory action imparted to playing cards by the card rest 111 may cause the cards to have an appearance of dancing or floating on the card rest 111 and/or support surface 112. The vibratory action is operable at a range of frequencies, such as in the order of 10 Hz to 100,000 Hz, more preferably 100 Hz to 10,000 Hz, even more preferably 1000 Hz to 10,000 Hz. The amplitude may be of varying amounts depending upon the dynamics of the card rest 111 and how it is mounted.

The vibratory action of the card rest 111 can have at least one of a number of possible types of motions or movements. For example, the card rest 111 can be caused to vibrate with a substantially random motion. Alternatively, for example, the card rest 111 can be caused to vibrate with a substantially defined or substantially repetitive motion. Vibratory motion of the card rest 111 can be of different types, such as substantially two-dimensional in nature. Alternatively, vibratory motion of the card rest 111 can be substantially three-dimensional.

FIG. 1 also indicates the repositioner 120 is shown as a component of the card shuffler apparatus 100. The repositioner 120 functions to reposition, or move in a relative manner, the relative position of an array of upstanding playing cards relative to and supported by the card supporter 110. Preferably, the repositioner 120 is adapted to reposition or move playing cards supported on the card rest 111. More preferably, the repositioner 120 is configured to reposition or move playing cards supported on the support surface 112. The repositioner 120 may be adapted to reposition or move supported playing cards relative to the card receiver 140, which is described in greater detail hereinbelow. Preferably, the repositioner 120 is adapted to move or reposition supported playing cards relative to the card aperture 114 or slot.

The repositioner 120 can include one or more repositioner guides or face guides 121. The face guide 121 is adapted to contact a face of playing cards supported on the card supporter 110. More specifically, the face guide 121 is adapted to contact and/or engage a top side and/or bottom side or face of playing cards supported on the card supporter 110. According to an embodiment of the disclosure, the face guide 121 is substantially parallel to playing cards supported on the card supporter 110. Preferably, the face guide 121 is substantially perpendicular or normal to the edge guide 113. The face guide 121 may be substantially perpendicular to the support surface 112. The face guide 121 can be substantially in the form of a flat plate in one form of the disclosure.

The face guide 121 defines a contact surface or face 122. Preferably, the face 122 is substantially flat. The face 122 is adapted to contact a flat side of playing cards supported on the card supporter 110. More specifically, the face 122 is adapted to contact and/or engage a top side and/or bottom side or face of playing cards supported on the card supporter 110. According to an embodiment of the disclosure, the face 122 is substantially parallel to playing cards supported on the card supporter 110. The face 122 is substantially perpendicular or normal to the edge guide 113, as depicted. As shown, the face guide 122 is substantially perpendicular to the support surface 112.

The repositioner 120 can include a pair of face guides 121. The pair of face guides 121 may be maintained in juxtaposed orientation relative to each other. More preferably, the pair of face guides 121 is maintained in a substantially parallel juxtaposed orientation, as shown. The pair of face guides 121 are preferably maintained in a spaced apart relationship. More specifically, each of the pair of face guides 121 may be located on opposing sides of playing cards supported on the card rest 111. For example, supported playing cards are preferably located between the pair of face guides 121 of repositioner 120.

The spacing between the pair of face guides 121 may be variable. Such variable spacing between the face guides 121 can facilitate keeping supported cards in an upstanding orientation, as the number of supported cards changes. For example, as the card shuffler apparatus 100 shuffles playing cards, the number of playing cards supported on the card rest 111 will decrease. Thus, as the number of supported playing cards decreases, the face guides 121 of repositioner 120 may, in controlled response, move closer to each other to compensate for the decrease in the number of supported cards.

The repositioner 120 can include at least one actuator 123. The at least one actuator 123 may be adapted to actuate or move at least one repositioner guide 121. According to an embodiment of the disclosure, the at least one actuator 123 is connected or linked to at least one face guide 121. For example, the repositioner actuator 123 can be a linear actuator as depicted. Preferably, the repositioner 120 includes a pair of actuators 123 as shown in FIG. 1. More preferably, the repositioner 120 includes a pair of face guides 121 and a pair of actuators 123, wherein each actuator 123 is exclusively associated with one of the face guides 121, as depicted. More specifically, each of the face guides 121 is individually movable or repositionable according to an embodiment of the disclosure. Each of the face guides 121 is individually movable or repositionable by way of an associated actuator 123 in some embodiments.

According to an embodiment of the disclosure, the face guides 121 of repositioner 120 are adapted to reposition supported playing cards by pushing and/or sliding the cards along the card rest 111 and/or the support surface 112. Such repositioning of supported cards may be performed while vibratory action is imparted to the cards by the exciter 130, which is described in greater detail below. The face guides 121 are adapted to reposition or move supported playing cards, as well as being adapted to move relative to each other. By moving relative to each other, the face guides 121 are able to vary the spacing between each other to account for varying numbers of supported cards.

With continued reference to FIG. 1, the card shuffler apparatus 100 includes at least one exciter 130. The at least one exciter 130 is adapted to impart vibratory action in playing cards supported by the card supporter 110. The at least one exciter 130 may be adapted to impart vibratory action to playing cards supported by the card rest 111. The at least one exciter 130 may be configured to impart vibratory action to playing cards supported on the support surface 112. In accordance with at least one embodiment of the disclosure, the at least one exciter 130 is adapted to impart vibratory action to the card rest 111. For example, imparting vibratory action to the card rest 111 can be accomplished in a manner wherein vibratory action is, in turn, imparted from the card rest 111 to playing cards supported thereon. Thus, according to at least one embodiment of the disclosure, the at least one exciter 130 is adapted to impart vibratory action to the playing cards by imparting vibratory action to the card rest 111, which in turn imparts vibratory action to cards supported thereon.

The exciter 130 may be adapted to create a mechanical vibration. The vibration created by the exciter 130 can be at least one of a number of possible types of vibration. For example, the vibration created by the exciter 130 can be substantially two-dimensional in nature. Alternatively, the vibration created by the exciter 130 can be substantially three-dimensional in nature. As a further example, the vibration created by the exciter 130 can consist of substantially random vibratory motion. Alternatively, vibratory motion of the exciter 130 can be substantially regular and/or repetitive in nature. The vibratory action created by the exciter 130 can be of a relatively high-frequency. The vibratory action created by the exciter 130 may be of a relatively low-amplitude. The vibratory action created by the exciter 130 may be of substantially high-frequency and low-amplitude. In some embodiments, the vibratory action created by the exciter 130 may be of a frequency and/or amplitude that causes supported cards to behave in a manner that is advantageous to the operation of the card shuffler apparatus 100 as described herein.

The exciter 130 may be connected to the card supporter 110. For example, the exciter 130 can be connected and/or linked with the card rest 111, as shown. The exciter 130 may be connected with at least a portion of the card supporter 110, so as to impart vibratory action from the exciter 130 to playing cards supported on the card supporter 110. According to an embodiment of the disclosure, the exciter 130 is connected to and/or mounted directly on the card supporter 110. For example, the exciter 130 can be connected to and/or mounted directly on the card rest 111, as shown. According to an alternative embodiment of the disclosure, the exciter 130 is substantially integrated with the card supporter 110.

The exciter 130 can be configured to operate according to at least one of various possible manners of creating vibratory action, both known and yet to be discovered. Such manners of creating vibratory action can include, for example, mechanical means, electrical means, and electro-mechanical means, among others. For example, one way of creating vibratory action is by employing a rotary actuator (not shown) such as a rotary motor to rotate a weight that is eccentrically positioned relative to its axis of rotation. Another example of creating vibratory action is to subject a movable ferric object (not shown) to an electro-magnetic field of dynamically alternating polarity to cause the ferric object to oscillate or vibrate. In accordance with at least one embodiment of the disclosure, the frequency and/or the amplitude of the vibratory action created by the exciter 130 is selectively adjustable.

Still referring to FIG. 1, the card receiver 140 is included in the card shuffler apparatus 100. The card receiver 140 is adapted to receive at least one playing card from the card supporter 110. The card receiver 140 may be adapted to receive only one playing card at a time. For example, the card receiver 140 can be sized and/or otherwise configured so that no more than one playing card at a time can be received into the card receiver 140. The card receiver 140 includes a slot or card space 149 into which one or more playing cards are received from the card supporter 110. The card space 149 of the card receiver 140 can have one of a number of possible specific configurations. The card receiver 140 is adapted to receive and hold one or more playing cards in the card space 149. In some embodiments, the card receiver 140 is adapted to selectively retain one or more received playing cards within the card space 149.

The card receiver 140 can include a card stop 143. The card stop 143 may define at least a portion of the card space 149 and is within the intermediate or medial section. The handling of the dropped card or cards in the medial section can have a number of different configurations. For example, the card stop 143 can define a lower end of the card space 149. Placement or location of the card stop 143 relative to the support surface 112 can be of significance to the operation of the card shuffler apparatus 100. Specifically, the card stop 143 may be located to be a certain distance from the support surface 112, wherein the distance is substantially equal to either a length or a width of playing cards being shuffled. In some embodiments, when a playing card has been received into the card receiver 140 from the card supporter 110, an upper edge of the received playing card may be substantially even, or flush, with the support surface 112. The significance of this aspect of the disclosure becomes clearer in view of later descriptions, which follow below with respect to the operation of the card shuffler apparatus 100.

The card receiver 140 can include one or more guides. For example, the card receiver 140 can include a first guide portion 141 and a second guide portion 142. The guide portions 141, 142 of card receiver 140 can define at least part of the card slot or card space 149 into which a playing card is received from the card supporter 110. The card space 149 may be substantially straight as depicted. The card space 149 may be substantially vertical in orientation, as is also depicted. The card space 149 may be substantially directly below the card aperture 114. According to an embodiment of the shuffler apparatus depicted in FIG. 1, a playing card is dropped from the support surface 112 through the card aperture 114, and is received into the card space 149 between the first guide portion 141 and the second guide portion 142. The received playing card may be supported substantially upon the card stop 143 such that a bottom edge of the received card rests upon the card stop 143 and an opposite upper edge of the received card is substantially flush or even with the support surface 112.

As shown, card receiver 140 may include at least one receiver actuator 145. The at least one receiver actuator 145 can be a linear actuator such as a linear solenoid, for example. The at least one receiver actuator 145 may be selectively controlled. The at least one receiver actuator 145 can be adapted for selective control by the controller 150, as is described in greater detail hereinbelow. The card receiver 140 can include a link or linkage 144. The link 144 can be connected to the receiver actuator 145, as depicted. More specifically, the link 144 can be operably connected to the actuator 145 for selective movement of the link 144. The link 144 can be connected to at least one portion of the receiver guides such as the second guide portion 142, as shown.

The link 144 can include a bottom guide 148. The bottom guide 148 is adapted to contact and/or engage a received playing card that is retained in the card space 149. The actuator 145, along with the link 144 and bottom guide 148, can make up and/or form portions of a release mechanism. The second guide portion 142 can be included in such a release mechanism. Specifically, the actuator 145 together with the link 144, bottom guide 148 and second guide portion 142 can be configured to facilitate release of a playing card retained in the card space 149. For example, according to an embodiment of the disclosure, the actuator 145 can be activated to move the link 144 toward the first guide portion 141.

Movement of the link 144 toward the first guide portion 141 can cause the second guide portion 142 to move away from the first guide portion 141, while at the same time causing the bottom guide 148 to push a lower end of the retained card away from the first guide portion 141 and past the card stop 143. This operation is described hereinbelow in greater detail. Such an operation of the actuator 145 and the link 144 in this manner can cause release of a retained playing card from the card space 149. A playing card released from the retained position in the card receiver 140 can cause the card to fall into a card collector 161. Following release of a retained playing card, the actuator 145 can be activated to return to the original position shown in FIG. 1. With the second guide portion 142 and bottom guide 148 in their original respective positions, the card receiver 140 is ready to receive another playing card from the card supporter 110.

The card receiver 140 can include at least one card sensor 146. The at least one card sensor 146 can be adapted to detect presence of a playing card that has dropped into the medial zone. More specifically, in accordance with the apparatus depicted in FIG. 1, the at least one card sensor 146 can be adapted to detect that a playing card is present and/or is retained within the card space 149. Such detection of a playing card retained within the card space 149 can facilitate operation of the card shuffler apparatus 100. For example, a playing card can be allowed to drop from the card supporter 110 and into the card space 149 of the card receiver 140.

The sensor 146 is adapted to detect that a playing card is fully received into the medial section. The sensor 146 can send a signal to the controller 150 in response to detecting that a playing card has been fully dropped onto the card stop 143 and received into the card space 149. When the controller 150 receives this signal from the sensor 146, the controller 150 can, in response, activate the repositioner 120 to reposition playing cards supported by the card supporter 110.

It is also possible that the sensor 146 can be employed to detect the absence of any playing card or cards from the stopped medial position in card space 149. This can be accomplished by configuring the controller 150 to recognize that all cards have been shuffled when the sensor 146 or other sensor so indicate the presence or absence of playing cards in the card space 149 or at other locations.

It is noted that the card receiver 140 is depicted as being separate and distinct from the card supporter 110 and/or other components of the card shuffler apparatus 100. However, it is to be understood that one or more portions of the card receiver 140 can be at least substantially integral with one or more portions of the card supporter 110. For example, in accordance with at least one alternative embodiment of the disclosure, the first guide portion 141 is integral and/or connected with the card rest 111. Similarly, the card aperture 114 can be at least partially integrated with the card receiver 140 according to at least one embodiment of the disclosure.

Figure 2:
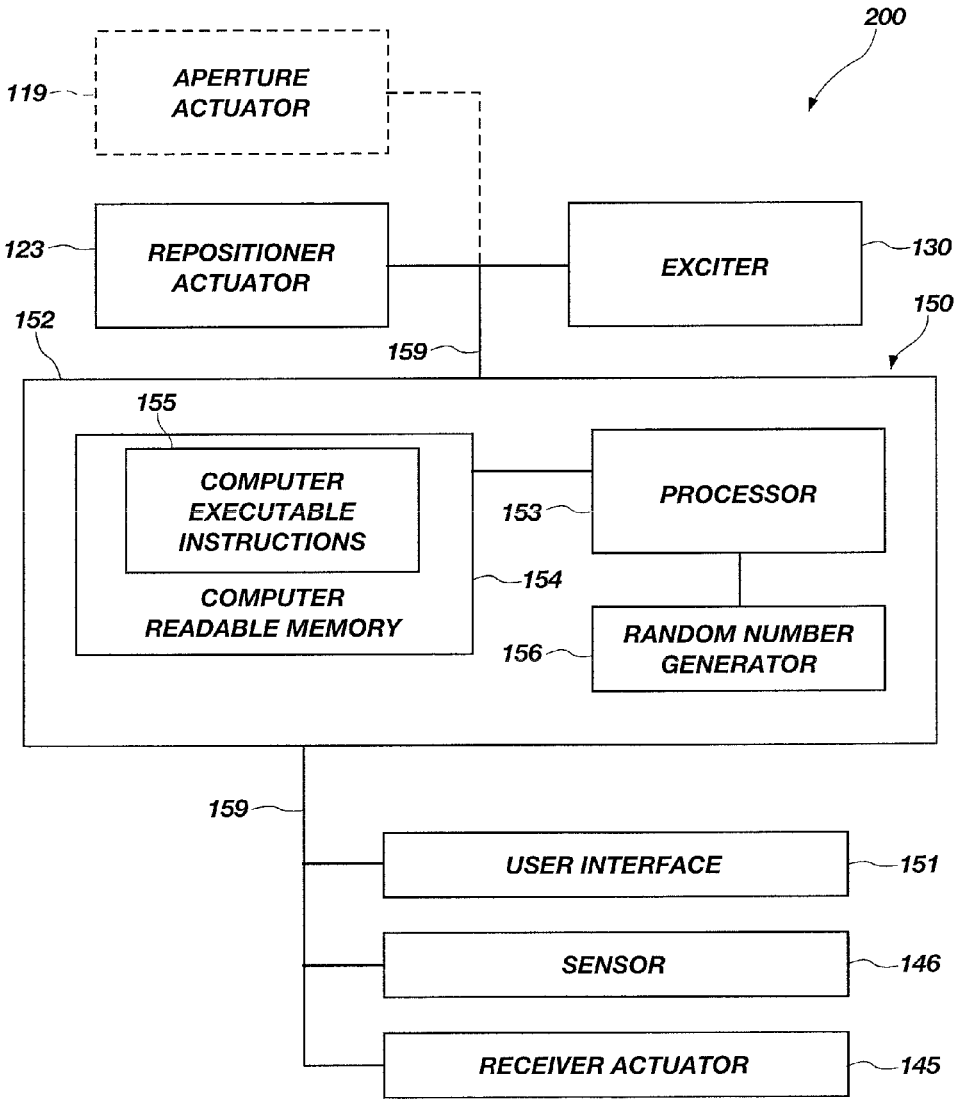
FIG. 2 is a diagrammatic view of a control system according to at least one embodiment of the disclosure.

With reference now to FIGS. 1 and 2, the card shuffler apparatus 100 can include a controller 150. The controller 150 can be at least a portion of a control system 200, which can include at least one additional component, such as but not limited to, the actuator 123 of repositioner 120, the exciter 130, the receiver actuator 145, the sensor 146, and the user interface 151. The controller 150 and/or the control system 200 is adapted to perform one or more various control functions in facilitation of operation of the card shuffler apparatus 100. Examples of various control functions that can be performed by the controller 150 and/or the control system 200 are provided further below with respect to description of operation of the card shuffler apparatus 100.

The controller 150 can be supported on or mounted to the housing 160. The controller 150 can be mounted within the housing 160 or on the exterior of the housing 160. The controller 150 can include a user interface 151. The user interface 151 may be configured to facilitate input of operational commands by a user of the card shuffler apparatus 100. For example, the user interface 151 can include and/or can be substantially in the form of a switch. Such a switch can be an on/off switch, a stop/start switch, or a power switch, for example. The user interface 151 can be adapted for other input commands. For example, the user interface 151 can be adapted to input and/or select optional dimensions or other characteristics of playing cards to be shuffled. Specifically, for example, the user interface 151 can be substantially in the form of a control panel having multiple command input parameters available to a user of the card shuffler apparatus 100. In some embodiments, the user interface 151 may comprise an alpha-numeric keypad for enabling a user to input data into the control system 200, and/or a display screen for providing visual data output to a user. As a non-limiting example, the user interface 151 may comprise a touch screen display device that may be used to both input data into the control system and to output data from the control system. In additional embodiments, the user interface 151 may include an audio sensor configured to receive voice commands from a user of the shuffler apparatus, and the control system may be configured to respond to one or more voice commands received from a user of the shuffler apparatus by the audio sensor.

In a further alternative version, the need for user controls may be eliminated or simplified to a great degree. The card shuffler apparatus 100 may be constructed so as to sense when a card array is input and then merely automatically perform the shuffling process as a result of a sensor that detects cards placed within the input supports.

The controller 150 can include an enclosure 152. The user interface 151 can be mounted on, or supported by, the enclosure 152. A processor 153 may be included as part of the controller 150. The processor 153 can be a digital processor such as a microprocessor, or the like. The processor 153 may be contained within the enclosure 152. The controller 150 may include a computer readable memory 154. The computer readable memory 154 may be housed within the enclosure 152. The processor 153 and the computer readable memory 154 are preferably linked for signal transmission. More specifically, the processor 153 may be able to read data and/or computer executable instructions 155 from the computer readable memory 154. According to at least one embodiment of the disclosure, the processor 153 is able to write or store data in the computer readable memory 154. The controller 150 can include a random number generator 156. The random number generator 156 can be adapted to facilitate generation of random positions of the supported playing cards, as is described in greater detail hereinbelow. The random number generator 156 can be integral with the processor 153 and/or the computer executable instructions 155.

The controller 150 can be linked for signal transmission to one or more components of the card shuffler apparatus 100. More specifically, the control system 200 and/or the card shuffler apparatus 100 can include at least one communication link 159 adapted to facilitate signal transmission between the controller 150 and other components of the card shuffler apparatus 100 and/or control system 200. For example, the controller 150 can be linked for signal transmission with one or more of the positioner actuators 123, the exciter 130, the receiver actuator 145 and the sensor 146. The controller 150 can be linked for signal transmission with an optional aperture actuator 119 that is shown by dashed lines in FIG. 2. According to an alternative embodiment of the disclosure, the card shuffler apparatus 100 and/or the control system 200 can include the aperture actuator 119 to selectively open and close (or block and unblock) at least one card aperture 114 (shown in FIG. 1). The controller 150 can include various electrical and/or electronic components that are not shown such as, as but not limited to, relays, timers, counters, indicators, switches, sensors and electrical power sources.

The controller 150 may be adapted to facilitate operation and/or function of one or more components to which it is linked for signal transmission. For example, the controller 150 can be adapted to send on and off signals to the exciter 130. The controller 150 can be adapted to send control signals to at least one actuator including, but not limited to, one or more positioner actuators 123, receiver actuators 145, and aperture actuators 119 (shown in FIG. 2). For example, the controller 150 may be adapted to control positioning and/or activation of one or more actuators 123, 145. The controller 150 may be configured to receive and/or process input commands and/or data from the user interface 151. Preferably, the controller 150 is adapted to receive and/or process signals generated by the sensor 146. The controller 150 may be adapted to generate and/or determine random positions of the supported cards, and to command the repositioner 120 to move the supported cards to the randomly generated positions.

With reference to FIG. 1, the card shuffler apparatus 100 includes at least one housing 160. The housing 160 can function as a chassis or frame for one or more additional components of the card shuffler apparatus 100. More specifically, one or more components of the card shuffler apparatus 100 can be mounted on, or supported by, the housing 160. For example, the housing 160 may be adapted to support one or more of the card supporter 110, the positioner or repositioner 120, the exciter 130, the card receiver 140, and the controller 150. The housing 160 can be adapted to function as an enclosure for one or more components of the card shuffler apparatus 100, wherein the housing 160 is adapted to substantially protect enclosed components from damage and/or contamination. More specifically, one or more components of the card shuffler apparatus 100 can be enclosed within the housing 160 to decrease likelihood of damage and/or contamination. For example, the housing 160 may be adapted to enclose one or more of the card supporter 110, the repositioner 120, the exciter 130, the card receiver 140, and the controller 150.

The housing 160 can include one or more features to facilitate operation and/or use of the card shuffler apparatus 100. For example, the housing 160 can include a card collector 161. The card collector 161 may be adapted to catch and/or collect playing cards released from the card receiver 140. The card collector 161 can be configured to form a stack of collected playing cards. For example, the card collector 161 can be sloped or tilted to facilitate collection of playing cards into a substantially orderly stack. According to at least one embodiment of the disclosure, the card collector 161 is adapted to vibrate. Such vibration of the card collector 161 can facilitate collection of playing cards and/or formation of an orderly stack of collected and shuffled playing cards. For example, the exciter 130 can be configured to impart vibratory action to the card collector 161.

The housing 160 can have at least one opening 162. The at least one opening 162 can serve one, or more, of a number of possible uses or purposes. For example, the at least one opening 162 can be adapted to provide for placing a deck of cards into the card supporter 110. The housing 160 preferably has at least one other opening (not shown) proximate the card collector 161 to facilitate retrieval of the shuffled cards from the card collector 161. Still other openings (not shown) in the housing 160 can be provided for one, or more, of a number of purposes. For example, at least one opening (not shown) can be provided in the housing 160 to facilitate access to one or more components for repair and/or maintenance.

The housing 160 has a lower end 168 and an opposite, upper end 169. The lower end 168 may include and/or form a base for contacting or engaging a support surface such as a tabletop, counter top or shelf (not shown). The at least one opening 162 may be positioned near the upper end 169, as shown, to facilitate placement of playing cards into the card supporter 110. The card supporter 110 may be proximate the upper end 169. The card collector 161 may be proximate the lower end 168. The card receiver 140 may be situated substantially between the card supporter 110 and the card collector 161, as depicted. According to at least one embodiment of the disclosure, the housing 160 is configured so that the support surface 112 is substantially horizontal under normal operating conditions, as shown.

Figure 11:
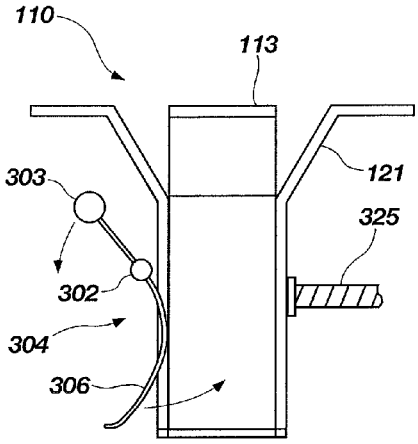
FIG. 11 is a side diagrammatic elevational view of an alternative means for biasing a card array.
Figure 12:
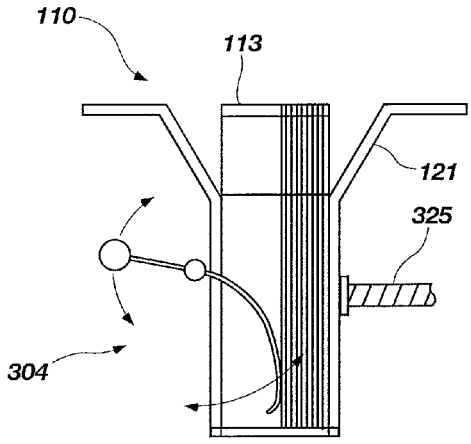
FIG. 12 is a side diagrammatic elevational view of the mechanism of FIG. 11 with playing cards shown.

FIGS. 11 and 12 show an alternative mechanism for biasing the array of upstanding cards. The card support or supporter 110 is fitted with one or more gravity biasing mechanisms 304. As shown, biasing mechanism 304 has a pivot 302. A counterbalancing weight 308 is forced downward by gravity to swing the contact arm 306 against the upstanding unshuffled card array 320.

The contact arm 306 is advantageously formed in a convex shape as seen from the array of cards 320. This minimizes any potential wear or marking of the cards. It also applies a relatively light force automatically without precise control of a stepper motor. However, precise control may not be necessary since friction between the cards is minimal and sufficiently low to allow individual cards to drop through the card aperture 114 without sufficient impedance to stop dropping by gravity from occurring. The vibratory action of the unshuffled card array 320 further reduces any impedance against dropping since the coefficient of friction is typically lower in a dynamic or moving relationship versus the static coefficient of friction. Thus, one advantage of embodiments of the shufflers is that the vibratory action has the cards effectively "floating," due to the vibratory excitation of the unshuffled card array 320.

Figure 13:
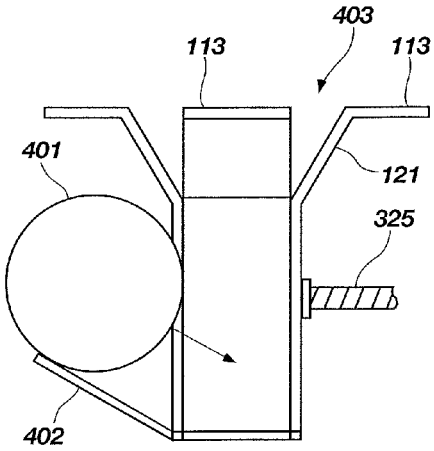
FIG. 13 is a side diagrammatic elevational view of a further alternative mechanism for biasing the array of playing cards.
Figure 14:
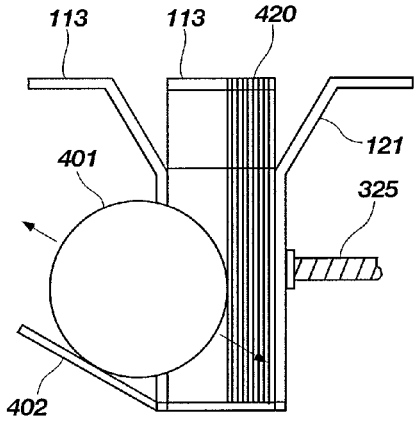
FIG. 14 is a side diagrammatic elevational view similar to FIG. 13 with an array of playing cards therein.

FIGS. 13 and 14 show a further alternative means for biasing an unshuffled card array 420. The means shown in these figures includes a ball 401. The ball 401 is positioned on a lateral guide 402, which is sloped toward an unshuffled card input support chamber 403. As illustrated in FIG. 14, the ball 401 is biased or forced by gravity to apply a lateral component of force to the unshuffled card array 420. A relatively small amount of force may be employed, such as a small ball of light weight. One possible form is a ping-pong ball or other small ball or other shape, which can urge the unshuffled card array 420 using gravity, a spring (not shown), or other suitable biasing means that apply a relatively small amount of force to keep the unshuffled card array 420 in a sufficiently upstanding orientation to facilitate card dropping sequentially through the card aperture 114 and into the medial zone of the shuffling machine.

Figure 15:
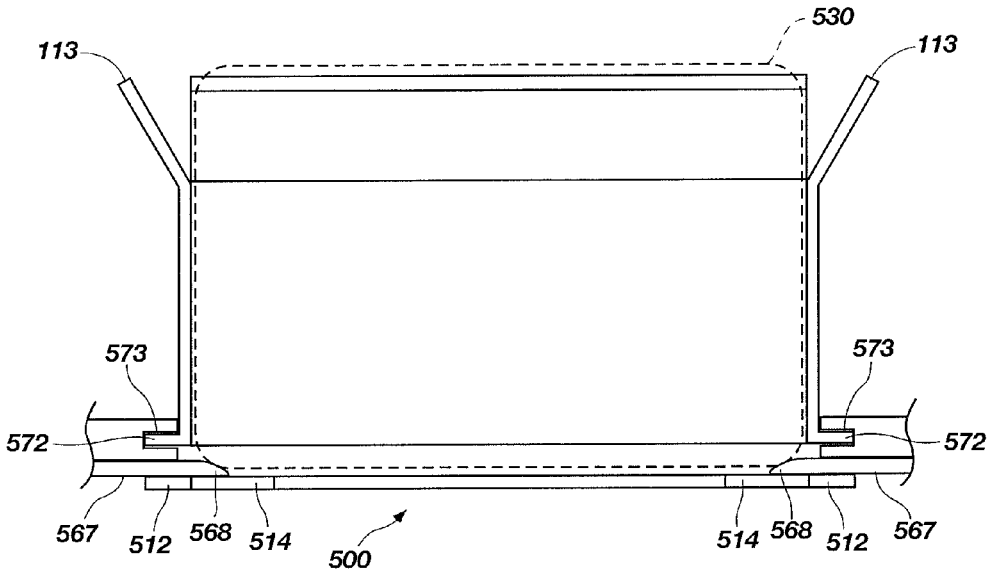
FIG. 15 is a diagrammatic elevational view showing another alternative construction for intermittently supporting the array of playing cards.
Figure 16:
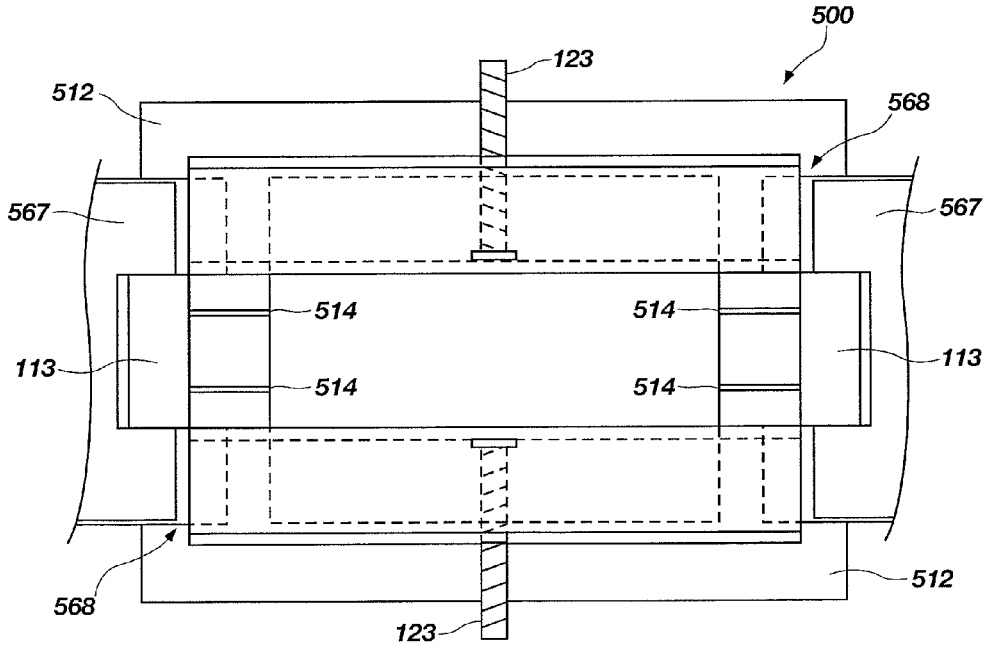
FIG. 16 is a top view of the subject matter shown in FIG. 15.

FIGS. 15 and 16 show pertinent features of a further embodiment of a card shuffler apparatus 500 according to the disclosure hereof FIG. 15 shows an unshuffled card array 530 in phantom. The unshuffled card array 530 is supported alternatively by a card rest 512 and movable gates or gate pieces 567 on opposing sides (ends of cards as shown).

The card shuffler apparatus 500 has edge guides 113, which may also be referred to as lateral supports, that may be provided with flanges 572, which can be constructed to slide within support channels 573. This construction allows the edge guides 113 to move with the unshuffled card array 530. The relative motion may in fact involve motion of the supports and cards, the cards relative to the supports or both the supports and cards to move relative to a fixed reference point and relative to a card slot or slots 514.

Card rest 512 is as shown provided with two card slots 514 formed in each card rest or rests 512. A pair of gate pieces 567 is mounted to slide inwardly and outwardly upon the card rests 512 using actuators (not shown but similar to actuator 123 or suitable alternatives thereof). When the gate pieces 567 are controlled to slide inwardly, the rounded corners of the playing cards on the bottom are engaged and supported on the noses 568 of gate pieces 567, thus preventing them from dropping through slots 514. Thus the unshuffled card array 530 may be lifted slightly and relative motion between the unshuffled card array 530 and slots 514 is performed and then the gate pieces 567 are opened by moving them outwardly and cards may then drop through the slots 514.

This construction may be controlled or configured so that the gating action occurs independently for each slot 514 relative to the other slot 514. Furthermore, the cards can be simultaneously dropped and the guiding parts contained in the medial section of the card shuffler apparatus 500 may appropriately accommodate the recompiling of the cards.

Figure 3:
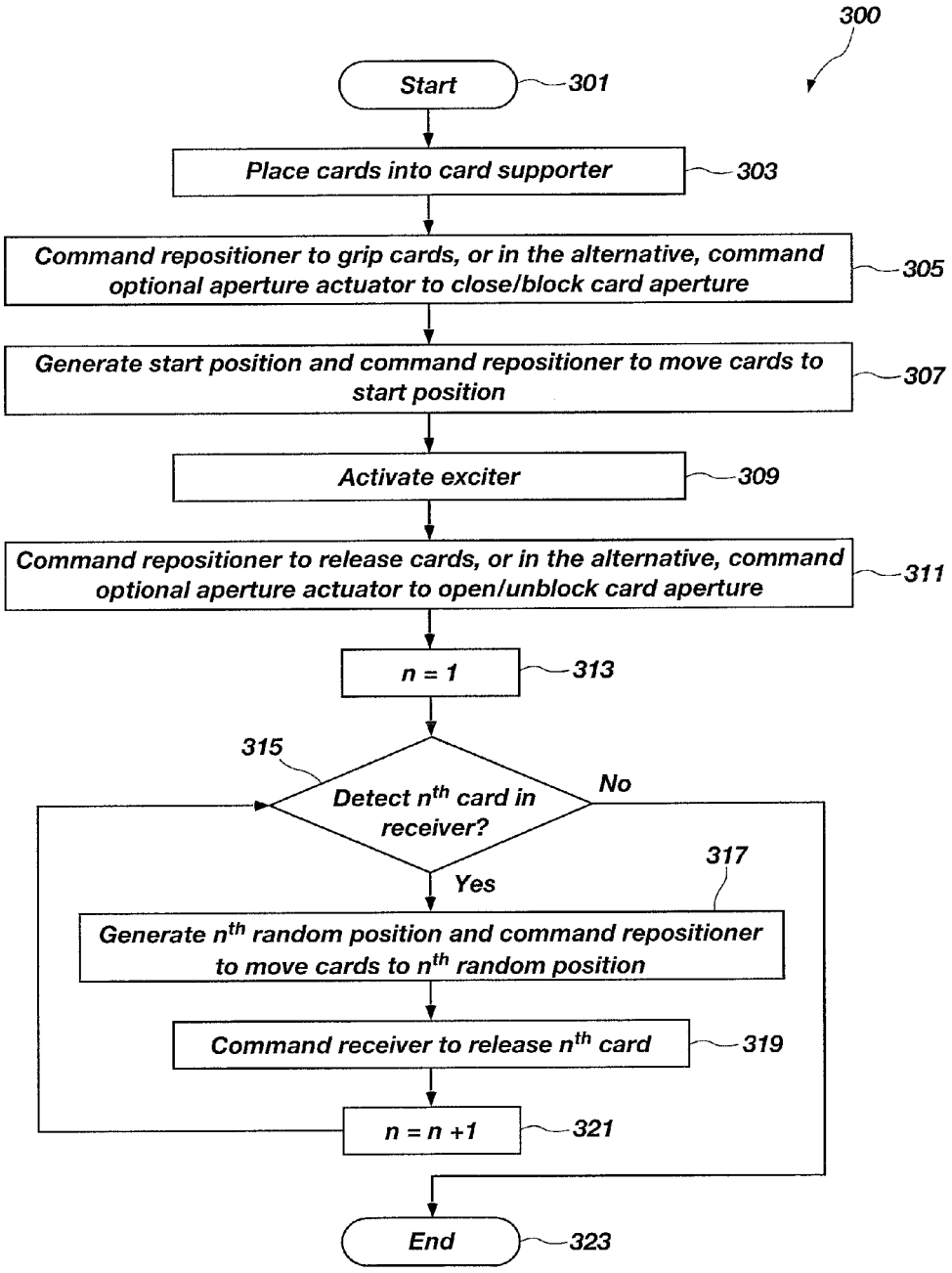
FIG. 3 is a flow diagram depicting an operational sequence according to at least one embodiment of the disclosure.

With reference now to FIG. 3, a flow diagram depicts a sequence 300 of operational steps that can be carried out by one or more components of the card shuffler apparatus 100 according to at least one embodiment of the disclosure. With reference to FIGS. 1-3, the sequence 300 moves from a starting point 301 to step 303, wherein a plurality of playing cards is placed onto the card supporter 110. The step of placing the cards into the card shuffler apparatus 100 according to step 303 can be accomplished by a user of the apparatus. The starting point 301 can include turning the apparatus on, or initializing the card shuffler apparatus 100. This can be accomplished by the user. For example, the user can turn the card shuffler apparatus 100 on or initialize the apparatus by manipulating the user interface 151.

The next step 305 is to command the repositioner 120 to grip the supported cards. In accordance with an alternative embodiment of the disclosure, an optional aperture actuator 119 (shown in FIG. 2) is commanded to close or block the card aperture 114 (shown in FIG. 1). This step of generating and transmitting command signals can be carried out by the controller 150. From step 305, the sequence 300 moves to a step 307 that includes generating a start position of the supported cards relative to the card aperture 114, and commanding the repositioner 120 to move the supported cards to the start position. The start position may be randomly determined. This step of generating the start position and commanding the repositioner 120 to move the supported cards can be accomplished by the controller 150.

The sequence 300 moves next to a step 309 of activating the exciter 130. More specifically, the exciter 130 is turned on or operated so as to impart vibrational action to the supported cards. The step of activating the exciter 130 can be carried out by the controller 150. The step 309 of activating the exciter 130 can have other alternative positions in the sequence 300. For example, the step of activating the exciter 130 can be the first step of the sequence 300. Once the exciter 130 is turned on, the sequence 300 moves to a step 311 of commanding the repositioner 120 to release the supported cards. In accordance with an alternative embodiment of the disclosure, the optional aperture actuator 119 (shown in FIG. 2) is commanded to open/unblock the card aperture 114 (shown in FIG. 1). This step 311 can be performed by the controller 150. From step 311, the sequence 300 moves to step 313 during which a counter is initialized to unity. More specifically, for example, a variable "n" is set to a value of "1" according to this step 313, which can be accomplished by the controller 150.

From the step 313, the operational sequence 300 moves to a query 315. The query 315 asks whether the nth card is detected in the card receiver 140. More specifically, the query 315 asks whether the nth card has dropped into a fully received position within the card receiver 140. This query 315 can be performed by the controller 150 in conjunction with the sensor 146. For example, the sensor 146 looks for a card to drop into a fully received position within the card space 149. When the sensor 146 detects the presence of the card, the sensor 146 transmits a signal to the controller 150 by way of the respective communication link 159. The controller 150 receives the signal from the sensor 146 as indication that the nth card has been fully received into the card receiver 140.

If the answer to the query 315 is "yes," then the sequence 300 proceeds to a step 317, wherein the nth position is randomly generated and the repositioner 120 is commanded to move the supported cards to the nth random position. This step 317 can be performed by the controller 150, for example. From this step, the sequence 300 moves to a step 319, in accordance with which the card receiver 140 is commanded to release the nth card. For example, the nth card is released from a retained position in the card space 149, and is allowed to drop into the card collector 161. This step of commanding the card receiver 140 to release the nth card can be performed by the controller 150, for example. From the step 319, the sequence 300 proceeds to a step 321, wherein the counter is incrementally increased to the next value. Specifically, the value of the variable, "n" is increased by a value of one.

From the step 321, the sequence 300 returns to the query 315 described above. As is described above, if the answer to the query 315 is "yes," then the steps 317, 319 and 321 are repeated. For example, the steps 317, 319 and 321 of generating the nth random position for the supported cards, moving the supported cards to the nth random position, releasing the nth card from the card receiver 140, and incrementing the counter, continue as long as the sensor 146 continues to detect the nth card being fully received into a retained position within the card space 149. However, if the answer to the query 315 is "no," then the sequence 300 proceeds to end point 323. For example, if the controller 150 does not receive a signal from the sensor 146 for a predetermined period of time (i.e., the sensor 146 fails to detect the presence of a card being fully received into a retained position within the card space 149), then the controller 150 will assume that there are no additional cards to process, and the controller 150 will end the operational sequence.

Figure 4:
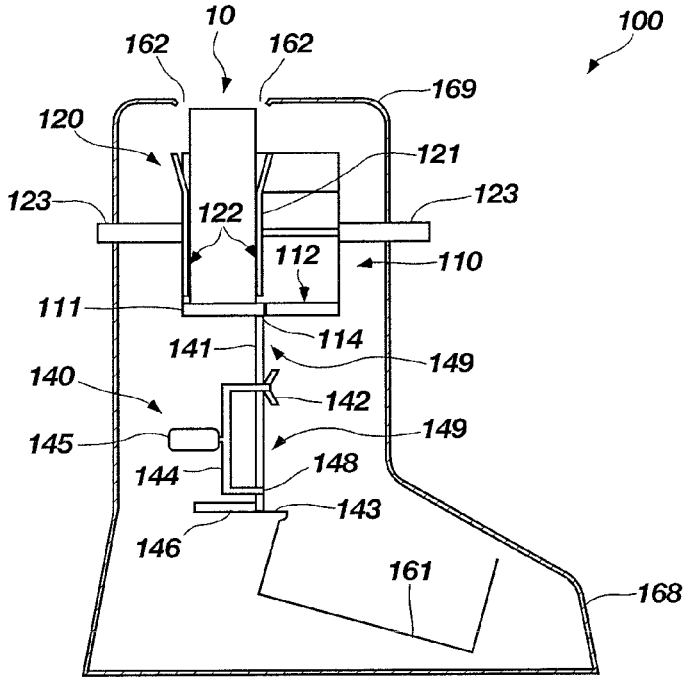
FIG. 4 is a side diagrammatic elevational view depicting one of a series of operational steps of an apparatus according to at least one embodiment of the disclosure.

Referring now to FIGS. 4-9, a series of elevational views of the card shuffler apparatus 100 illustrates an operational sequence according to at least one embodiment of the disclosure. With reference to FIG. 4, the card shuffler apparatus 100 is shown in a card loading mode or status. With the card shuffler apparatus 100 in the loading mode, the repositioner guides 121 are positioned to receive a deck of cards 10 through the loading opening 162. As shown, the plurality of cards 10 to be shuffled has been inserted through the loading opening 162 and has been set on the card supporter 110. More specifically, the plurality of cards 10 to be shuffled has been placed on the support surface 112. According to an embodiment of the disclosure, when the card shuffler apparatus 100 is in the loading mode, the cards 10 to be shuffled are not above the card aperture 114. More specifically, when in the loading mode the repositioner guides 121 are offset relative to the card aperture 114, as shown, so that the card aperture 114 is not below the supported cards 10.

Still referring to FIG. 4, the receiver actuator 145 is in a deactivated status. More specifically, the receiver actuator 145 is in a position, wherein the link 144 is in a withdrawn position. With the link 144 in a withdrawn position, the bottom guide 148 is also withdrawn, as shown. The second guide portion 142 is in a card retention position, wherein the first guide portion 141 and the second guide portion 142 together, are configured to receive a card into the card space 149. Cards to be shuffled can be loaded by insertion of the cards through the loading opening 162 and placement of the cards onto the support surface 112. A user of the card shuffler apparatus 100 can start the operational sequence 300 (FIG. 3) of the card shuffler apparatus 100 after the cards are loaded into the card shuffler apparatus 100. Commencement of the operational sequence 300 can be effected by manipulation of the user interface 151, for example.

In response to commencement of the operational sequence 300, the repositioner guides 121 are activated to grip the supported cards 10. Gripping of the supported cards 10 by the repositioner guides 121 can be accomplished, for example, by causing the positioner actuators 123 to cause the repositioner guides 121 to move and/or exert a force toward each other, thereby squeezing or trapping the cards therebetween. The exciter 130 is activated in response to commencement of the operational sequence. Activation of the exciter 130 may cause the exciter 130 to impart vibratory action to the supported cards 10. For example, as described above, the exciter 130 can be adapted to impart vibratory action to one or more components of the cards shuffler apparatus 100, such as the card supporter 110. In response to commencement of the operational sequence 300, the controller 150 (FIGS. 1 and 2) can define a starting position of the cards 10 relative to the card aperture 114. This starting position of the cards 10 may be randomly selected or generated. The controller 150 can then command the repositioner actuator 123 to cause the repositioner guides 121 to move the cards 10 to the starting position, while also maintaining a grip on the cards.

Figure 5:
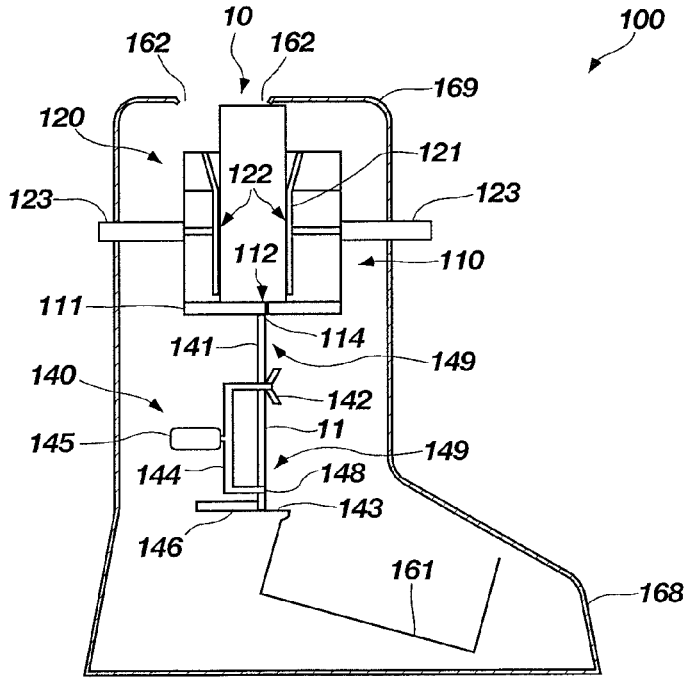
FIG. 5 is a side diagrammatic elevational view depicting one of a series of operational steps of an apparatus according to at least one embodiment of the disclosure.

With reference now to FIG. 5, it is seen that the cards 10 have been moved to the starting position. The starting position places the cards 10 above the card aperture 114. More specifically, when the cards 10 are in the starting position, the cards 10 are situated substantially above the card space 149. After the cards 10 have been moved to the start position, the repositioner 120 may transmit a signal to the controller 150 to indicate that the movement is complete. The controller 150 then may command the repositioner 120 to release its grip on the cards 10. This can be accomplished, for example, by commanding one or more of the positioner actuators 123 to move the repositioner guides 121 away from each other so that substantially little force is exerted on the cards 10 by the repositioner guides 121.

When the cards 10 are released by the repositioner 120, the cards 10 will come to rest substantially on the support surface 112. Vibrational action of the support surface 112 will be imparted to the cards 10 supported thereon. Vibrational action may be imparted to the support surface 112 by the exciter 130. Impartation of vibrational action to the supported cards 10 will result in a first card 11 dropping from the support surface 112 through the card aperture 114 into a retained position within the card space 149, as shown. After dropping through the card aperture 114 and into the card space 149, a lower edge of the first card 11 comes to rest substantially on the card stop 143. When the first card 11 is resting substantially upon the card stop 143, the first card 11 has been substantially dropped and received into the medial receiver area.

With a lower edge of the first card 11 resting substantially on the card stop 143, an opposite upper edge of the first card 11 is substantially flush or even with the support surface 112, as shown. With an upper edge of the first card 11 being substantially even or flush with the support surface 112, the card receiver 140 and/or the card aperture 114 is substantially blocked or closed so that no other cards can enter the card aperture 114 or card receiver 140. The sensor 146 may detect that the first card 11 has dropped into a fully received position within the card space 149. In response to detecting presence of the first card 11, the sensor 146 transmits a signal to the controller 150. The controller 150 receives the signal from the sensor 146 and interprets the signal to indicate that the first card 11 has been fully received into the card space 149. In response to recognizing that the first card 11 has been received into the card space 149, the controller 150 randomly selects or generates a new position of the supported cards 10 relative to the card aperture 114. The controller 150 can then command the repositioner 120 to move the supported cards 10 to a new randomly selected position.

Figure 6:
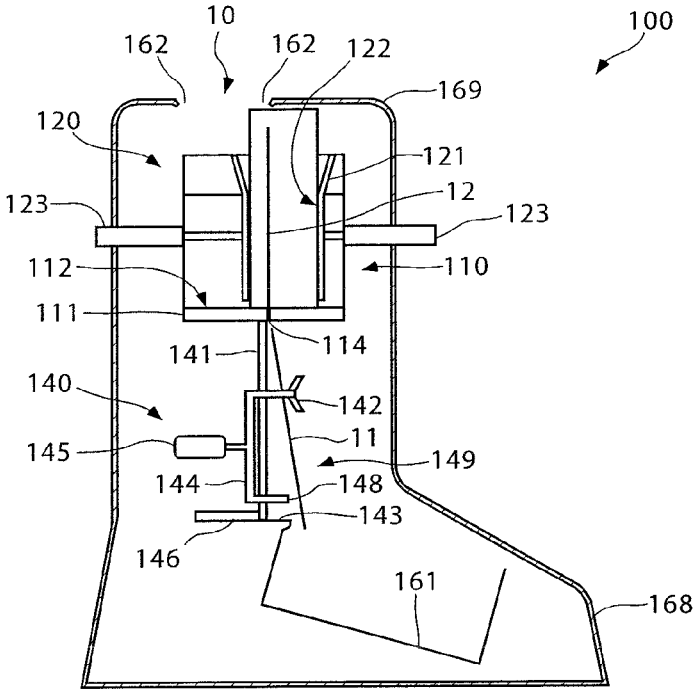
FIG. 6 is a side diagrammatic elevational view depicting one of a series of operational steps of an apparatus according to at least one embodiment of the disclosure.

Turning now to FIG. 6, it is seen that the supported cards 10 have been moved to the new, randomly selected position relative to the card aperture 114. The repositioner 120 may transmit a signal to the controller 150 to indicate that movement of the cards 10 to the new, randomly selected position is complete. The controller 150 then commands the receiver actuator 145 to activate. Activation of the receiver actuator 145 causes the first card 11 to be released and directed or guided from the card space 149, as shown. The first card 11 drops from the receiver into the card collector 161.

In some embodiments of the disclosure, the dropping of first card 11 from the support rest into the card receiver 140 causes the card aperture 114 to be opened or unblocked. With the card aperture 114 unblocked, and as a result of vibrational action of the supported cards 10, a second card 12 begins dropping through the card aperture 114 and into the card space 149 as shown. Sensor 146 can advantageously detect the first card 11 positioned in the card space 149, and transmit a signal to the controller 150 indicating that the first card 11 is in the stopped position waiting to be directed or released or otherwise guided from the medial card space and into the card collector 161.

Figure 7:
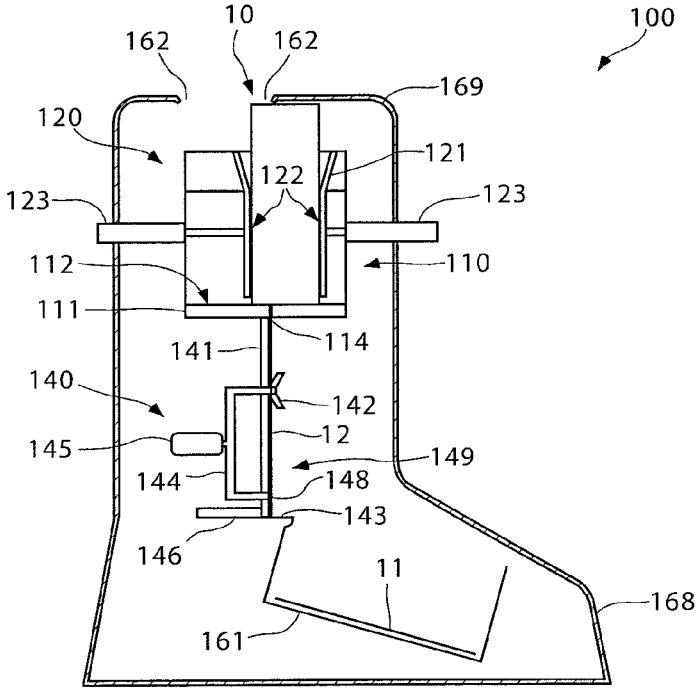
FIG. 7 is a side diagrammatic elevational view depicting one of a series of operational steps of an apparatus according to at least one embodiment of the disclosure.

Turning now to FIG. 7, it is seen that the second card 12 has been fully received into the card receiver 140. More specifically, it is seen from a study of FIG. 7 that the second card 12 has dropped through the card aperture 114, and a lower edge of the second card 12 has come to rest substantially on the card stop 143. With a lower edge of the second card 12 resting substantially on the card stop 143, an opposite, upper edge of the second card 12 is substantially flush or even with the support surface 112. With an upper edge of the second card 12 being substantially flush or even with the support surface 112, it is seen that the card aperture 114 is substantially blocked or closed by the second card 12. More specifically, with the second card 12 being in a fully retained position within the card receiver 140, the card receiver 140 is blocked so that no additional cards can drop and enter into the medial card space.

FIG. 7 shows that the first card 11 has come to rest within the card collector 161 after having been released from the card receiver 140. The sensor 146, may detect that the second card 12 has dropped into a fully received position within the card space 149. In response to detecting presence of the second card 12, the sensor 146 transmits a signal to the controller 150. The controller 150 receives the signal from the sensor 146 and interprets the signal to indicate that the second card 12 has been fully received into the card space 149. In response to recognizing that the second card 12 has been received into the card space 149, the controller 150 randomly selects or generates a new position of the supported cards 10 relative to the card aperture 114. The controller 150 can then command the repositioner 120 to move the supported cards 10 to the new, randomly selected position.

Figure 8:
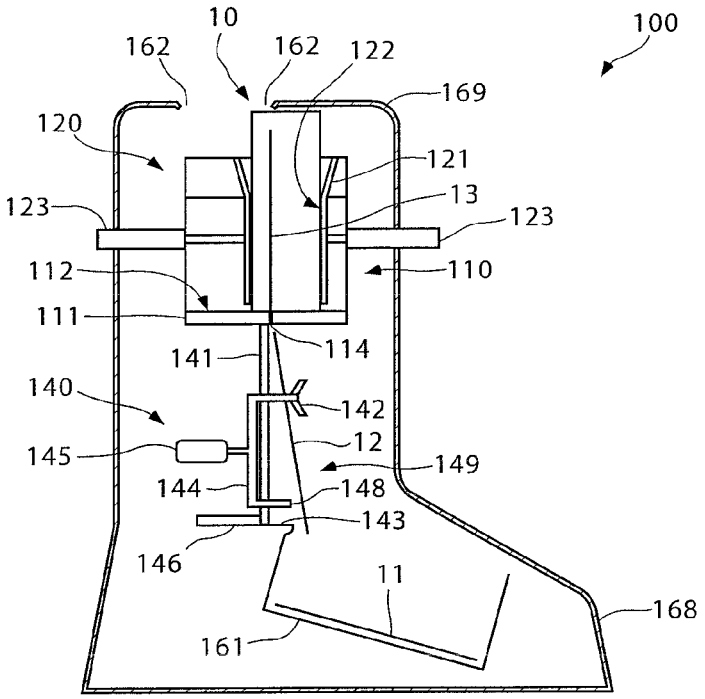
FIG. 8 is a side diagrammatic elevational view depicting one of a series of operational steps of an apparatus according to at least one embodiment of the disclosure.

With reference now to FIG. 8, it is seen that the supported cards 10 have been moved to the new, randomly selected position relative to the card aperture 114. The repositioner 120 may transmit a signal to the controller 150 to indicate that movement of the cards 10 to the new, randomly selected position is complete. The controller 150 then commands the receiver actuator 145 to activate. Activation of the receiver actuator 145 causes the second card 12 to be released from the card space 149, as shown. The second card 12 may drop from the card receiver 140 into the card collector 161. Release of the second card 12 from the card receiver 140 causes the card aperture 114 to be opened or unblocked. With the card aperture 114 unblocked, and as a result of vibrational action of the supported cards 10, a third card 13 begins dropping from the group of cards through the card aperture 114 and into the card space 149, as shown. The operational sequence described hereinabove can be continued as desired to shuffle a desired number of playing cards.

Figure 9:
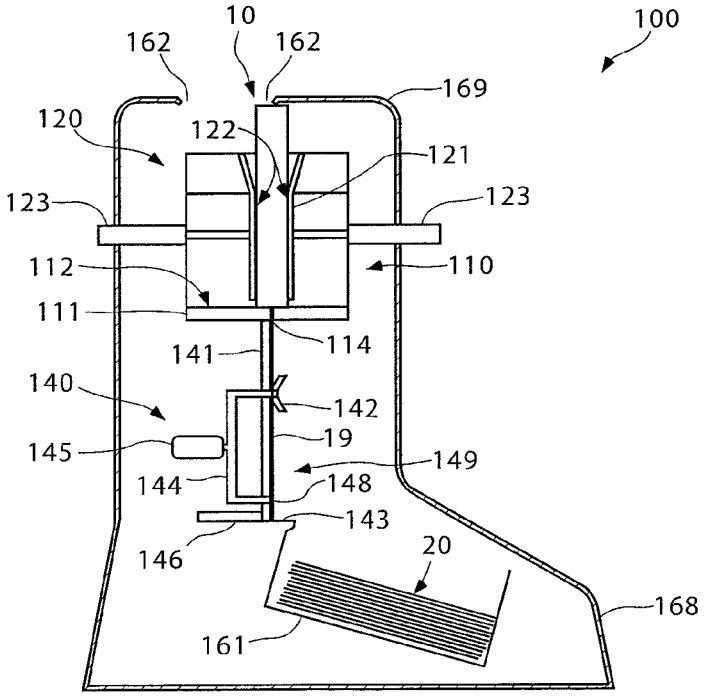
FIG. 9 is a side diagrammatic elevational view depicting one of a series of operational steps of an apparatus according to at least one embodiment of the disclosure.

Turning now to FIG. 9, it is seen that the above-described operational sequence has continued to produce a stack of shuffled cards 20, which are held in the card collector 161. The operational sequence continues with a retained card 19 shown in a fully received position in the card space 149, and a plurality of supported cards 10 remaining to be shuffled. It is seen that the quantity of supported cards 10 has been depleted as the result of continuation of the operational sequence of the card shuffler apparatus 100. It can also be seen that the repositioner guides 121 have been repositioned relative to each other. Specifically, the repositioner guides 121 have moved closer to each other in response to depletion of the quantity of supported cards 10. In this manner, the repositioner 120 facilitates maintaining the supported cards 10 in a substantially upstanding orientation. Continued processing of the supported cards 10 according to the operational sequence 300 (FIG. 3), results in deposition of all cards in the card collector 161. More specifically, upon completion of processing of all cards according to the operational sequence 300, the shuffled cards 20 can be retrieved from the card collector 161.

Figure 10:
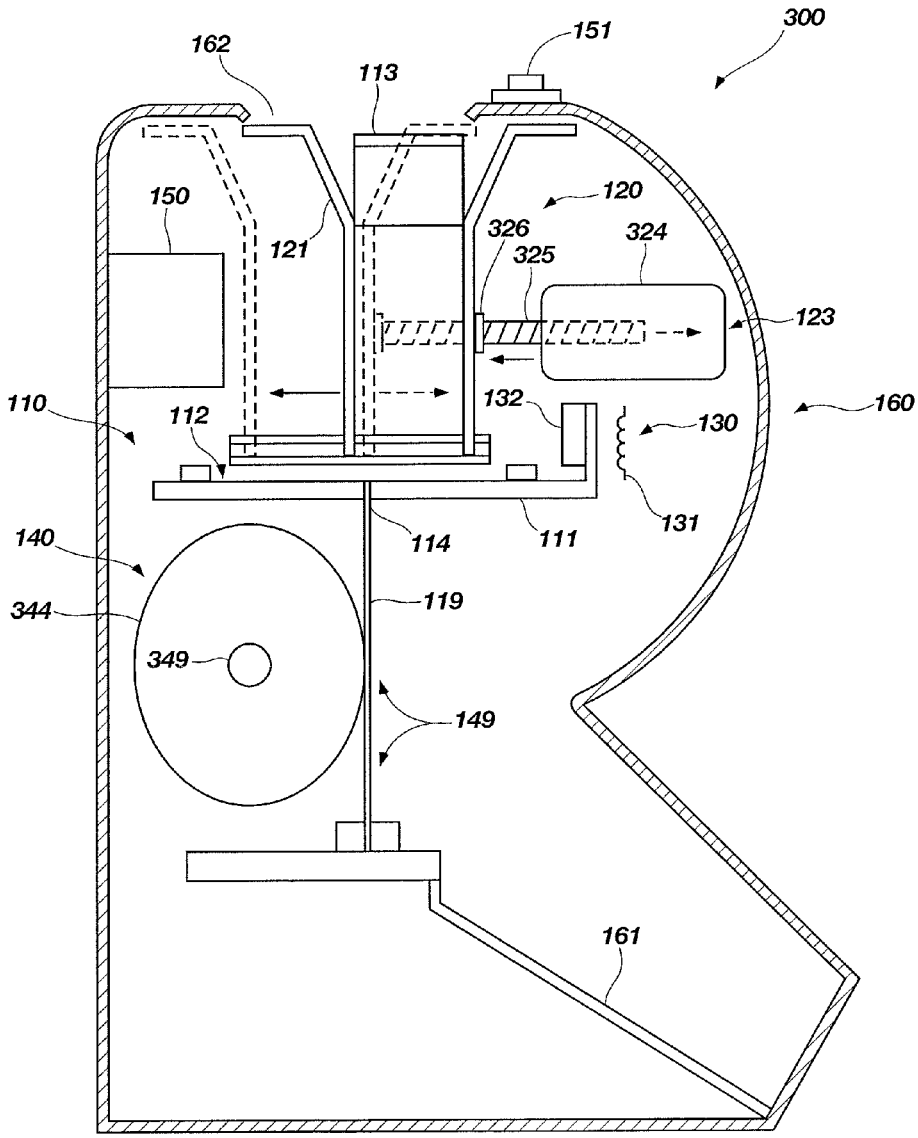
FIG. 10 is a side diagrammatic elevational view of an apparatus according to another embodiment of the disclosure.

Turning now to FIG. 10, an elevational view shows an apparatus 400 according to another embodiment of the disclosure. The apparatus 400 may function in a manner substantially similar to that of the card shuffler apparatus 100. However, the apparatus 400 includes alternative aspects and/or configurations of various components. For example, from a study of FIG. 10, it is seen that the user interface 151 can be mounted in a location relative to the housing 160, which is different from that of the card shuffler apparatus 100 (shown in FIG. 1). The repositioner guides 121 of the apparatus 400 can have a shape that is different from those of the card shuffler apparatus 100. For example, the repositioner guides 121 of the apparatus 400 can be configured to overlap the loading opening 162, as is shown in FIG. 10. As a further example, the controller 150 can be located substantially within the housing 160, as shown in FIG. 10.

With continued reference to FIG. 10, the repositioner 120 can include a rotary actuator 324, a lead screw 325 and a connector or follower 326. The rotary actuator 324 can be, for example, a rotary electric motor such as a stepper motor, or the like. The rotary actuator 324 may be fixedly supported by the housing 160. The motor 324 is configured to selectively drive or rotate the lead screw 325. Activation of the motor 324 may be controlled by the controller 150. The connector 326 is engaged with the externally threaded lead screw 325. A follower forming part of the rotary actuator 324 is connected causing the lead screw 325 to extend and retract the repositioner guides 121. The motor 324 can be selectively activated to rotate in a desired direction, which in turn, causes the lead screw 325 to rotate. Rotation of the lead screw 325 relative to the follower 326 causes the follower 326 and one or more of the repositioner guides 121 to move relative to the motor 324. In this manner, the repositioner guides 121 can be positionally controlled.

The exciter 130 can include a coil 131 and vibrational follower 132. The vibrational follower 132 may be ferromagnetic. The coil 131 can be mounted on or supported by the housing 160. The vibrational follower 132 can be mounted on or supported by the card rest 111. The vibrational follower 132 can be substantially integral with the card rest 111. The coil 131 can be subjected to intermittent direct current of a given polarity to cause vibrational movement of the vibrational follower 132. Alternatively, the coil 131 can be subjected to current of alternating polarity to cause vibrational movement of the vibrational follower 132. Such vibrational movement of the vibrational follower 132 may be imparted to the card rest 111, which in turn, imparts vibrational action to playing cards supported thereon.

With continued reference to FIG. 10, the card receiver 140 can have a configuration that is substantially different from that of the card shuffler apparatus 100 shown in FIG. 1. For example, as shown in FIG. 10, the card receiver 140 can include a cam lobe element 344. The cam lobe element 344 can have a cross-sectional shape, substantially in the form of an ellipse, as shown. The cam lobe element 344 can be rotationally supported by a shaft 349. The shaft 349 may be rotatably supported by the housing 160. The shaft 349 may be positioned in a manner to place the cam lobe element 344 substantially adjacent to the card space 149, into which a card 19 is dropped from the card rest 111.

As shown in FIG. 10, the cam lobe element 344 is in a card-retaining or card-receiving position, in which a card 19 is retained within the card space 149. More specifically, it is seen from a study of FIG. 10 that the cam lobe element 344 has a wider portion as well as a narrower portion because of its elliptical cross-sectional shape. It is also seen that when in the card-retaining position as shown, the cam lobe element 244 is rotationally oriented so that the narrower portion of the cam lobe element 344 is substantially adjacent to the card space 149. Thus, rotation of the cam lobe element 344 for approximately one-quarter of a turn can cause the wider portion of the cam lobe element 344 to move into adjacency with the card space 149. Rotation of the cam lobe element 344 approximately one-quarter of a turn will preferably cause release of the retained card 19 from the card space 149. More specifically, rotation of the cam lobe element 344 will preferably cause the retained card 19 to be pushed from its retained position in the card space 149, and to fall into the card collector 161.

Figure 17:
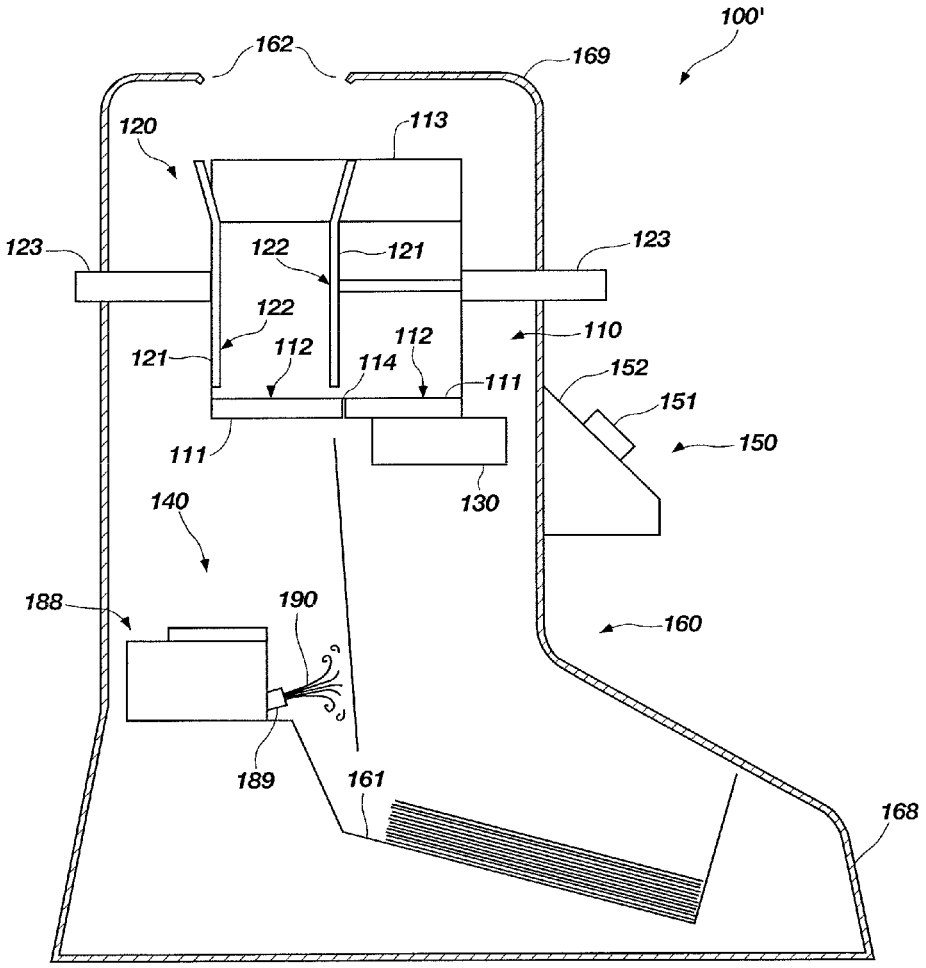
FIG. 17 is a diagrammatic elevational view of a still further version of the disclosure.

FIG. 17 shows a further alternative embodiment of a shuffler apparatus 100' similar to card shuffler apparatus 100 in almost all respects. However, the shuffler apparatus 100' of FIG. 17 uses a jet pulser 188 with a nozzle 189 that emits a jet or jets of air, or other suitable gas 190. In operation, a dropping card is not stopped in the medial section, but is directed by the jet or jets of gas so as to come to rest in the card collector 161. In other embodiments, a card that drops comes to rest on a card stop (like the card stop 143 in FIG. 6), and the jet pulser 188 may remove the card from the card stop.

Figure 18:
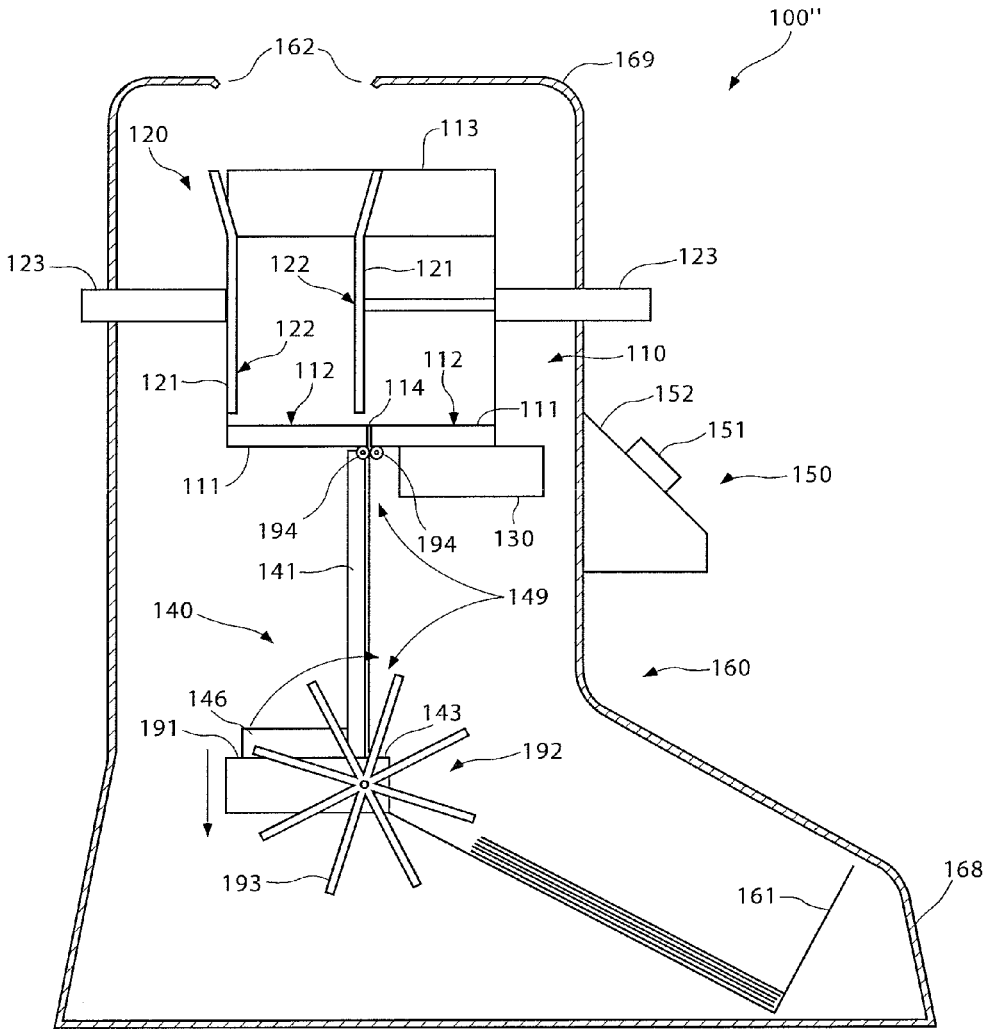
FIG. 18 is a diagrammatic elevational view of another embodiment of a shuffler apparatus of the disclosure.

FIG. 18 shows another medial guide configuration in a shuffler apparatus 100" similar to card shuffler apparatus 100 that has a support piece 191, which is connected or mounted upon the frame or housing 160, as shown. A guide wheel 192 has vanes 193 and performs by directing and reorienting the dropping cards onto a stack being formed in the card collector 161. The shuffler apparatus 100" of FIG. 18 is described in further detail hereinbelow.

Referring again to FIG. 18, the shuffler apparatus 100" includes, by way of non-limiting example, (a) a card supporter 110, which serves as a card input staging section wherein unshuffled playing cards are placed on edge by a dealer, participant, or other person into the shuffler apparatus 100"; (b) a card aperture 114 proximate to the bottom of the card supporter 110; (c) a repositioner 120 module for randomly repositioning the input staging section with respect to the card aperture 114; (d) an exciter 130 for imparting vibratory or other action to the deck of unshuffled cards to individualize them into a set of discrete cards; (e) a card receiver 140 wherein the cards fall sequentially from the card aperture 114; and (f) a card collector 161 wherein the shuffled cards from the card receiver 140 are collected, and which serves as a card output container (e.g., tray).

With continued reference to FIG. 18, the card supporter 110 functions to support the unshuffled cards that are to be randomly selected and dropped sequentially to provide randomized playing cards. More specifically, the card supporter 110 contains support surfaces, such as the walls 122 and support surface 112, which function to support the playing cards in a substantially vertical orientation over the card aperture 114.

The repositioner 120 functions to reposition the collection of vertically oriented cards horizontally in the card supporter 110 relative to the card aperture 114.

The exciter 130 is configured to impart vibrations to the unshuffled cards in the card supporter 110.

The card receiver 140 is adapted to direct cards one at a time sequentially to the card collector 161 as they pass sequentially through the card aperture 114. While the shuffler apparatus 100" may contain more than one card aperture 114, only one card passes through each card aperture 114 at a time. It may be advantageous to provide multiple card apertures 114 when randomizing groups of cards of larger size, such as groups including from four (4) to eight (8) decks of cards.

Controller 150 functions to control various operational aspects of the shuffler apparatus 100".

The card collector 161 is used to collect the randomly selected and individually sequentially dropped cards to produce as an output either a recompiled deck of shuffled cards, a series of participants' playing card hands, or individually dealt shuffled cards for a playing card game. The housing 160 can have one or more functions including, but not limited to, that of a chassis or frame to support one or more of the other components of the apparatus. It can also act as a cover to prevent viewing by game participants or others who might try to determine card sequences or specific cards passing through the shuffler apparatus 100", and to protect the components inside the shuffler apparatus 100". The housing 160 may also be sound insulated to minimize environmental noise caused by the operation of the shuffler apparatus 100".

During a typical use of the shuffler apparatus 100", at least one deck of playing cards can be placed through the opening 162 in the housing 160 and into the card supporter 110, so as to rest the cards on edge on the support surface 112 between contact surfaces or faces 122 of the respositioner 120 in an upstanding orientation. The repositioner 120 is activated to move the supported unshuffled deck of cards to a first randomly selected position above the card aperture 114, which is located vertically over the card receiver 140. The exciter 130 is activated to produce mechanical vibrations. The vibrations may be of a frequency and amplitude sufficient to cause the playing cards to oscillate, "dance," or otherwise vibrate on the support surface 112. The vibrations also may provide a "fluff" or air layer between adjacent cards in the deck to facilitate sequential dropping of individual cards through the card aperture 114. For example, the vibrations can give the cards an appearance of also jumping just above the support surface 112, or the vibrations may be almost or totally unperceivable to the naked eye.

One unshuffled playing card 10 contained within the deck of unshuffled cards placed inside the card supporter 110 (see FIGS. 4 through 9) is positioned directly over the card aperture 114 in the support surface 112 by means of the randomized positioning of the repositioner 120 relative to the card aperture 114. Such a card then may drop down through the card aperture 114 and into the card receiver 140 at least due at least in part to the force of gravity. When the card has dropped through the card aperture 114, it may rest temporarily on a card stop 143 (e.g., a surface) of the card receiver 140, so that an upper end of the card occludes the card aperture 114 in such a manner as to prevent additional cards from passing through the aperture 114 and into the card receiver 140.

In some embodiments, the card receiver 140 may include one or more acceleration devices used to drive or accelerate movement of the cards into the card space 149 as the cards pass through the card aperture 114 in the card rest 111. As a non-limiting example, such an acceleration device may include a pair of rotationally driven rollers 194 located below the card rest 111 and proximate a lower surface thereof, as shown in FIG. 18. The pair of rollers 194 may be located and configured such that cards passing through the card aperture 114 in the card rest 111 will pass between the rotationally driven rollers 194. The rollers 194 may be used to assist the force of gravity in moving cards into the card space 149 and onto the card stop 143. In other embodiments, the force of gravity alone may cause the cards to drop through the card aperture 114 and onto the card stop 143 in the card space 149.

After the first card has dropped into and is held within the card receiver 140, the repositioner 120 moves the unshuffled card deck contained within the card supporter 110 to a second randomly selected position over the card aperture 114. After the supported cards have been repositioned over the card aperture, the first card contained within the card receiver 140 is transferred to the card collector 161. Ejecting the first card from the card receiver 140 and into the card collector 161 unblocks the card aperture 114, such that another card may pass from the card supporter 110 through the card aperture 114 and into the card receiver 140.

Thus, the second card drops through the card aperture 114 from the card supporter 110. This second card temporarily rests in the card receiver 140 against the card stop 143, such that the card aperture 114 is again blocked or occluded, thereby preventing any additional cards from passing through the card aperture 114. With the second card in the card receiver 140 and occluding the card aperture 114, the repositioner 120 is again activated to move the unshuffled card deck contained within the card supporter 110 to a third randomly selected position over the card aperture 114. The second card is then transferred from the card receiver 140 to the card collector 161, and the third card is allowed to pass from the card supporter 110, through the card aperture 114, and into the card receiver 140.

The second card is placed on top of the first card in the collector 161 to begin forming a shuffled group of cards 20 (see FIG. 9) if a shuffled deck or shuffled participant's hand of playing cards is desired. The third card, if needed, is likewise preferably stacked on top of the second card. This operation of the shuffler apparatus 100" can be continued as desired to randomly reorder all or part of the cards contained within the unshuffled deck. Of course, if the shuffler apparatus 100" is meant to deal individual shuffled cards for the particular game being played, then the dealer will remove each card as it appears in the card collector 161 without allowing a stack of shuffled cards to form in the card collector 161. In practice, the shuffler apparatus 100" may be configured to repetitively perform the operational sequences relatively quickly. The shuffler apparatus 100" may be programmed to deliver shuffled decks of cards or a hand of cards. A sensor in the card collector 161 may sense an absence of cards after the user removes a hand of cards from the card collector 161, and the processor 153 may direct the shuffler apparatus 100" to form the next hand in the same card collector 161.

To further improve the speed of operation of the shuffler apparatus 100", in additional embodiments, the control system 200 of the shuffler apparatus 100" may be programmed and configured to first randomly select a region in a deck of unshuffled cards, and to then randomly sequentially select a number of cards within the first preselected region of the deck of cards. A second region in the remaining deck of cards then may be randomly selected, and a number of cards then may be randomly, sequentially selected from within the second randomly selected region of the deck. In this configuration, the average distance traveled by the repositioner 120 between the randomly selected positions may be reduced during operation of the shuffler apparatus 100", resulting in the ability to operate at a faster speed.

As mentioned above with reference to FIG. 18, the shuffler apparatus 100" includes card supporter 110, which serves as a card input staging section wherein unshuffled playing cards are placed on edge by a dealer, participant, or other person into the shuffler apparatus 100". This input card staging section preferably includes a card rest 111, a surface of which defines the card support surface 112. The card rest 111 is adapted to support playing cards in a vertical orientation on edge over the card support surface 112. The card support surface 112 may be at least substantially planar as depicted, or the card support surface 112 may be nonplanar. For example, the card support surface 112 may have a patterned surface that includes a shape or profile selected to facilitate the separation (e.g., "fluff") of the cards responsive to the vibrations imparted thereto by the exciter 130, as previously mentioned. In some embodiments, the shuffler apparatus 100" may be configured such that the support surface 112 is in an at least substantially horizontal orientation during normal operation of the shuffler apparatus 100".

The card supporter 110 can include one or more edge guides 113. For example, the card supporter 110 may include a pair of edge guides 113 between which the cards to be shuffled are positioned and that support two laterally opposing edges of the cards within the card support. The card supporter 110, in conjunction with the face guides 121 of the repositioner 120, supports the cards in a substantially upright orientation on edge over the card rest 111. The cards held in the card supporter 110 that are to be randomized may be supported in an orientation substantially perpendicular to the card rest 111 and the edge guides 113. It is to be understood, however, that the descriptions and depictions provided herein are not intended to limit the shape and/or orientation of one or more components of the card supporter 110. For example, it should be understood that the card support surface 112 need not be substantially flat and/or horizontal.

One or more components of the card supporter 110, such as the card rest 111 and/or the edge guides 113, optionally may be designed and configured to resonate at one or more frequencies, or over a range of frequencies (i.e., resonant frequencies). The resonant frequency or frequencies, which includes without limitation harmonics, may be selected to impart desirable vibrations to the unshuffled cards contained within the card supporter 110. By designing and configuring the card support 111 and/or the edge guides 113 to resonate at one or more resonant frequencies, the vibrations that are produced by the exciter 130 that are imparted to the playing cards may be enhanced.

With continued reference to FIG. 18, the one or more card apertures 114 may extend through the support surface 112 and the card rest 111. The card aperture 114 may comprise a slot through which only one playing card may pass at a time. More specifically, the width of the narrowest part of the card aperture 114 may be greater than the thickness of a single playing card, but less than twice the thickness of a single playing card. Card aperture 114, as shown, may be at least substantially straight. The width of the card aperture 114 may be constant, or may vary along a length of the card aperture 114.

In some embodiments, the card aperture 114 in the card rest 111 optionally may be configured in a manner wherein the aperture 114 is selectively blocked and unblocked by a gate or other device (other than a playing card), as previously described herein with reference to FIGS. 15 and 16.

The card rest 111 is adapted to support playing cards until the cards are released through the one or more card apertures 114. In accordance with at least one embodiment of the disclosure, the card rest 111 is adapted to support playing cards on-edge in an at least substantially upright or upstanding orientation. When playing cards are supported on-edge by the card rest 111, however, the cards need not be exactly vertically oriented. Thus, in accordance with some embodiments, the card rest 111 may be adapted to support playing cards on-edge, wherein the cards are not exactly vertically oriented, but instead are oriented at an acute angle, greater than zero degrees, relative to a line perpendicular to the card support surface 112. Of course, in additional embodiments of the present disclosure, the card aperture 114 may be oriented at an acute angle relative to vertical and the cards to be shuffled may be held at the same or a similar angle within the card repositioner 120 over the card rest 111.

The card rest 111 is preferably adapted to impart a vibratory action to playing cards supported on their edges on the card rest 111. For example, the card rest 111 can be caused to vibrate, which in turn, imparts a vibratory action to playing cards supported thereon. Vibratory action may be imparted to the card rest 111 by the exciter 130.

Card repositioner 120 is also shown in FIG. 18 as a component of the shuffling apparatus 100". The repositioner 120 functions to reposition the array of upstanding playing cards contained in the card supporter 110 over the card aperture 114. The repositioner 120 may include one or more positioner guides or face guides 121. Each of the face guides 121 may be adapted to contact an opposing face of the deck of unshuffled playing cards supported in the card supporter 110. Stated another way, each face guide 121 may be adapted to abut against and contact a top major surface or a bottom major surface (i.e., which may comprise a front surface or a back surface of a playing card) of the deck of unshuffled playing cards supported in the card supporter 110 on the card rest 111. In some embodiments, each face guide 121 may comprise a generally planar surface oriented at least substantially parallel to playing cards supported on the card rest 111. Thus, the face guides 121 may be oriented at least substantially perpendicular to the edge guides 113. The face guides 121 may be oriented at least substantially perpendicular to the support surface 112 of the card rest 111. Each of the face guides 121 may comprise a generally planar (e.g., flat) plate in some embodiments.

Each of the face guides 121 of the respositioner 120 includes a contact surface or face 122 that is configured to abut against the cards in the card supporter 110. The face 122 may be at least substantially flat or planar in some embodiments. In other embodiments, the face 122 may not be planar. The face 122 is adapted to contact a flat side of playing cards supported in the card supporter 110. More specifically, the faces 122 of the face guides 121 may be adapted to contact a front face or a back face of playing cards supported in the card supporter 110. In some embodiments, the faces 122 may be at least substantially parallel to playing cards supported in the card supporter 110. The faces 122 may be at least substantially perpendicular to the edge guides 113 in some embodiments. The repositioner 120 may include a pair of face guides 121. The face guides 121 may be maintained in juxtaposed parallel orientation relative to each other. The pair of guides 121 may be spaced apart from one another. More specifically, each of the face guides 121 may be located on opposing sides of playing cards supported on the card rest 111. The spacing between the pair of guides is variable. In other words, the repositioner 120 is capable of selectively varying a distance between the face guides 121. The spacing between the face guides 121 may be selectively varied so as to maintain the cards supported on the card rest 111 in an at least substantially vertical orientation as the number of cards supported on the card rest 111 changes during operation of the shuffler apparatus 100". For example, as the shuffler apparatus 100" shuffles the playing cards, the number of playing cards supported on the card rest 111 will decrease. Thus, as the number of supported playing cards decreases, the distance between the face guides 121 may, in controlled response, be decreased.

The repositioner 120 may include at least one actuator 123. The actuator is adapted to actuate or move at least one face guide 121 relative to the other face guide 121 so as to selectively increase and/or decrease a distance therebetween. Subtracting the width of a deck of unshuffled cards in the card supporter 110 (in a compressed state) from an actual distance between the opposing face guides 121 defines an "air gap." This air gap within the card supporter 110 between the face guides 121 allows the cards in the deck, with the aid of the vibrations provided by the exciter 130, to slightly separate from one another such that a "fluff" of air space is provided between the cards. This fluff may enhance operation of the shuffler apparatus 100", and may improve the reliability by which randomly selected individual cards in the deck fall through the card aperture 114.

The repositioner actuator 123 may be a linear actuator in some embodiments. In some embodiments, the repositioner 120 includes a pair of actuators 123. As a non-limiting example, one actuator 123 may be used to adjust a distance between the face guides 121 as previously described, and another actuator 123 may be configured to move the face guides 121 together in unison relative to the card aperture 114.

The repositioner 120 and the face guides 121 thereof are adapted to reposition playing cards supported over the card rest 111 by pushing and/or sliding the cards along the support surface 112 of the card rest 111. Such repositioning of supported cards may be performed while vibratory action is imparted to the cards by the exciter 130.

With continued reference to FIG. 18, the apparatus 100" includes at least one exciter 130. The exciter 130 is adapted to impart vibratory action to the playing cards supported on the card rest 111 within the card supporter 110. In some embodiments, the exciter 130 is adapted to impart vibratory action to the card rest 111. This vibratory action is, in turn, imparted from the card rest 111 to the playing cards supported thereon. The exciter 130 may be adapted to create mechanical vibrations. The vibrations created by the exciter 130 can be any of a number of possible types of vibration. For example, the vibrations created by the exciter 130 may be one-dimensional (i.e., linear), two-dimensional, or three-dimensional in nature. In some embodiments, the vibrations created by the exciter 130 may consist of at least substantially random vibratory motion. In additional embodiments, the vibratory motion of the exciter 130 may be substantially regular and/or repetitive in nature. The vibratory action created by the exciter 130 may be of a relatively high-frequency, and relatively low-amplitude. In some embodiments, the vibratory action created by the exciter 130 is of a sufficient frequency and amplitude to cause the necessary degree of vibration to generate the air fluff between individual cards in the deck, which may assist in overcoming any attractive forces between the cards in the deck, such as the attractive forces that can result due to buildup of static electricity.

At least a portion of the exciter 130 may be connected to the card supporter 110. For example, the exciter 130 may be connected and/or linked with the card rest 111. In some embodiments, at least a portion of the exciter 130 may be connected and/or linked with other components or portions of the card supporter 110 and/or the repositioner 120.

The exciter 130 may be configured to operate according to any of various possible manners of creating vibratory action. Such manners of creating vibratory action can include, for example, mechanical means, electrical means, and electromechanical means, among others. For example, one way of creating vibratory action is by employing a rotary actuator such as a rotary motor to rotate a weight that is eccentrically positioned relative to its axis of rotation. Another method for creating vibratory action is to subject a movable ferric object to an electro-magnetic field of dynamically alternating polarity to cause the ferric object to oscillate or vibrate. Another method of operation may utilize one or more piezoelectric elements driven at a desired frequency or frequencies to expand and contract in operably coupled relationship to card rest 111. In some embodiments, the frequency and/or the amplitude of the vibrations created by the exciter 130 may be selectively adjustable.

With continued reference to FIG. 18, the card receiver 140 is adapted to receive at least one playing card from the card supporter 110 as the card passes through the card aperture 114 in the card rest 111. The card receiver 140 may be adapted to receive only one playing card at a time from the card supporter 110. The card receiver 140 includes a card space 149 into which a playing card passing through the card aperture 114 falls. The card space 149 can have one of a number of possible specific configurations. In some embodiments, the card space 149 is adapted to temporarily retain one or more received playing cards.

The card receiver 140 may include a card stop 143. The card stop 143 may define a lower end of the card space 149. The card stop 143 may be located a certain distance from the support surface 112 of the card rest 111, wherein the distance is substantially equal to either a length or a width of the playing cards. Thus, when a playing card passes through card aperture 114 and come into contact with the card stop 143 of the card receiver 140, an upper edge of the received playing card may be at least substantially even or flush with the support surface 112, and may occlude the card aperture 114 extending through the card rest 111.

The card receiver 140 may include one or more guides to assist in guiding the playing cards as they pass into and through the card receiver 140. For example, the card receiver 140 may include a first guide portion 141 comprising a surface for maintaining the playing cards in an at least substantially vertical orientation as they fall into the card space 149. The received playing card is temporarily supported on the card stop 143 such that a bottom edge of the received card rests upon the card stop 143 and an opposite upper edge of the received card is substantially flush or even with the support surface 112, and such that a face of the received card rests against the surface of the guide portion 141.

A support piece 191 within the card receiver 140 may be connected or mounted upon a frame or housing of the shuffler apparatus 100". A guide wheel 192 having vanes 193 extending therefrom may selectively rotate to reorient the vertically oriented card temporarily held within the card receiver 140 with its lower edge on top of card stop 143, and to eject and direct the card from the card receiver 140 and into the card collector 161.

The card receiver 140 may include at least one card sensor 146. The card sensor 146 can be adapted to detect the presence of a playing card that has dropped into the card space 149 of the card receiver 140. In other words, the sensor 146 may be adapted to detect that a playing card is present and in a proper location and/or orientation within the card space 149.

The at least one card sensor 146 may be adapted to detect that a playing card is positioned in the card space 149, and to transmit a signal to the controller 150 in response to detecting that a playing card is in proper position within the card receiver 140. When the controller 150 receives this signal from the card sensor 146, the controller can, in response, cause the repositioner 120 to randomly reposition playing cards supported within the card supporter 110 over the card aperture 114, and then to activate the guide wheel 192 to eject the playing card from the card receiver 140 and into the card collector 161.

It is also contemplated that the at least one card sensor 146 may be positioned and employed to detect the absence or partial absence of any playing card in card space 149. The controller 150 can be configured to process the signal received from one or more card sensors 146 to determine proper subsequent mechanical action of the shuffler apparatus 100".

The shuffler apparatus 100" may include a control system 200, as previously described with reference to FIG. 2.

Referring again to FIG. 1, a method of shuffling a plurality of playing cards includes supporting the cards on an intake support surface 112. The method can include supporting the cards on a surface having at least one card aperture 114. The cards can be supported in a suitable orientation, for example, the cards can be supported substantially on-edge, and preferably upstanding.

Vibratory action is imparted to the cards. The vibratory action can be produced, for example, by an exciter 130, which is described hereinabove with respect to the card shuffler apparatus 100. The method also includes allowing one or more cards to drop into a medial zone advantageously provided with a card receiver 140. For example, one or more of the cards can be allowed to drop through the at least one card aperture 114 in response to imparting the vibratory action to the cards.

In some methods, at least one of the dropped cards is retained within the card receiver 140 in response to allowing the at least one card to drop. Retaining at least one of the cards includes retaining at least one of the cards so that the retained card substantially blocks the card receiver 140 and/or the card aperture 114. The method includes repositioning the supported cards relative to the card receiver 140. Repositioning the cards may include moving the supported cards to a randomly selected position relative to the card receiver 140. The method includes releasing the retained card from the card receiver 140 in response to repositioning the supported cards. Repositioning of the supported cards can be accomplished substantially by the positioner or repositioner 120.

The method can include detecting that at least one card is being retained in the card receiver 140. For example, this can include detecting that at least one card has been fully received into a retained position within the card receiver 140. The process of detecting can be accomplished substantially by way of the sensor 146, for example. Repositioning of the supported cards 10 can be performed in response to detecting that at least one card is retained. Retaining the at least one card may include holding the retained card in a position wherein an upper edge of the card is substantially flush or even with the support surface 112.

The method can include allowing a plurality of supported cards to sequentially drop into the card receiver 140 according to a random sequence. The method can also include sequentially retaining each of the dropped cards according to the random sequence. The supported cards can be repositioned during retention of each of the plurality of cards. The method can include sequentially releasing each of the retained cards according to the random sequence.

The method can include collecting cards that are released through the card aperture 114. The process of collecting the cards can be accomplished by a card collector 161, which is described hereinabove with respect to the card shuffler apparatus 100. The method can include forming a stack of the collected cards. The stack can be formed by the card collector 161, according to at least one embodiment of the disclosure. According to the method, the process of allowing the cards to be released through the card aperture 114 includes allowing the cards to drop through the card aperture 114. The stack of cards can comprise a complete deck, a partial deck, a hand of cards, a partial hand of cards, or another designated group of cards such as a community hand, dealer hand, or the like.

The process of allowing the cards to be released through the card aperture 114 can include substantially blocking and/or unblocking the card aperture 114, according to some preferred method.

Blocking and/or unblocking the card aperture 114 can also be accomplished, for example, by a gate system, which can include employing movable gates 567 to block and unblock the card aperture 114. The method can further include sensing whether the card aperture 114 is blocked or unblocked. Selective control of whether the card aperture 114 is blocked or unblocked can be accomplished, at least in part, by a controller 150 and an optional aperture actuator 119, which are described hereinabove with respect to the card shuffler apparatus 100.

According to at least one embodiment of the disclosure, the card shuffler apparatus 100 depicted in FIG. 1 can be used in the following manner. A plurality of cards is selected and is placed onto the card rest 111. For example, the plurality of cards can be substantially in the foam of one or more decks of cards. Preferably, the cards are placed onto the card supporter 110, so as to be substantially supported on the support surface 112. The cards can be supported by the card rest 111 in one or more of a variety of possible orientations, wherein the cards are supported on the support surface 112 substantially on-edge. For example, the cards can be supported in a substantially upright or upstanding orientation, which includes, but is not limited to, a substantially vertical orientation.

The card shuffler apparatus 100 can be turned on or otherwise activated so as to be in an operational mode. An operational mode of the card shuffler apparatus 100 may include imparting vibratory action to the cards. Imparting vibratory action to the cards can include, but is not limited to, imparting vibratory action to the card rest 111. According to an embodiment of the disclosure, vibratory action is provided by the exciter 130. More preferably, the exciter 130 is adapted to impart vibratory action to the cards supported on the card rest 111. Additionally, or alternatively, the exciter 130 is adapted to impart vibratory action to the card rest 111.

Preferably, vibratory action imparted to the cards supported on the card rest 111 results in an appearance of the cards "dancing" or "floating" on the card rest 111. For example, vibratory action imparted to the cards preferably results in the cards bouncing substantially upward and downward while being substantially contained above the card rest 111. According to at least one embodiment of the disclosure, vibratory action imparted to the cards causes the cards to bounce on the card rest 111, which in turn, results in overcoming a static force such that one or more of the cards fall or drop through one or more of the card apertures 114 (only one card aperture 114 is depicted). The card aperture 114 can be controlled by a gate system according to at least one embodiment of the disclosure. The gate system may be adapted to selectively block and/or unblock one or more of the card apertures 114. Such a gate system can include means of employing at least one playing card to block the card aperture 114 and/or to block the card receiver 140.

As the cards fall through the card aperture 114, the cards supported on the card rest 111 decrease in number. To compensate for the decreasing number of cards supported on the card rest 111, the repositioner 120 can be employed to maintain the cards substantially on-edge while also supported on the card rest 111. For example, the repositioner 120 can include one or more repositioner guides 121 that are adapted to move inward toward the cards as the number of cards supported on the card rest 111 decreases. In this manner, the repositioner 120 can function to maintain the cards substantially on-edge while being supported on the card rest.

The cards can be collected after they are released through the card aperture 114, as described hereinabove. Collection of the cards after being released through the card aperture 114 can be accomplished by a card collector 161, which is described hereinabove with respect to the card shuffler apparatus 100. Operation of the card shuffler apparatus 100 may be continued until a desired quantity of cards is either released from the card rest 111 or collected and/or stacked by the card collector 161. Shuffled cards can be retrieved from the card collector 161. In accordance with at least one embodiment of the disclosure, a plurality of cards can be fed or processed through the card shuffler apparatus 100 more than once to increase the degree of shuffling.

As described hereinabove, embodiments of shuffler apparatuses as described herein may be used to randomly shuffle a batch of cards. For example, one or more unshuffled decks of cards may be randomly shuffled to provide one or more complete decks of shuffled cards. In additional embodiments, shuffler apparatuses as described herein may be used to randomly form and dispense playing card hands or other subsets of cards for use in a playing card game. Further, such shuffler apparatuses may be used to continuously randomly form and dispense playing card hands or other subsets of cards in one or more sequential rounds of a playing card game while dispensed and played cards are returned to the shuffler apparatuses between rounds of the playing card game. This continuous operation of the shuffler apparatus may be continued without any need for unplayed cards within the shuffler apparatuses to be dispensed, discarded, and returned to the shuffler apparatus between rounds to maintain at least substantially the same degree of randomness in the generation of the playing card hands for each sequential round of the playing card games.

Figure 19A:
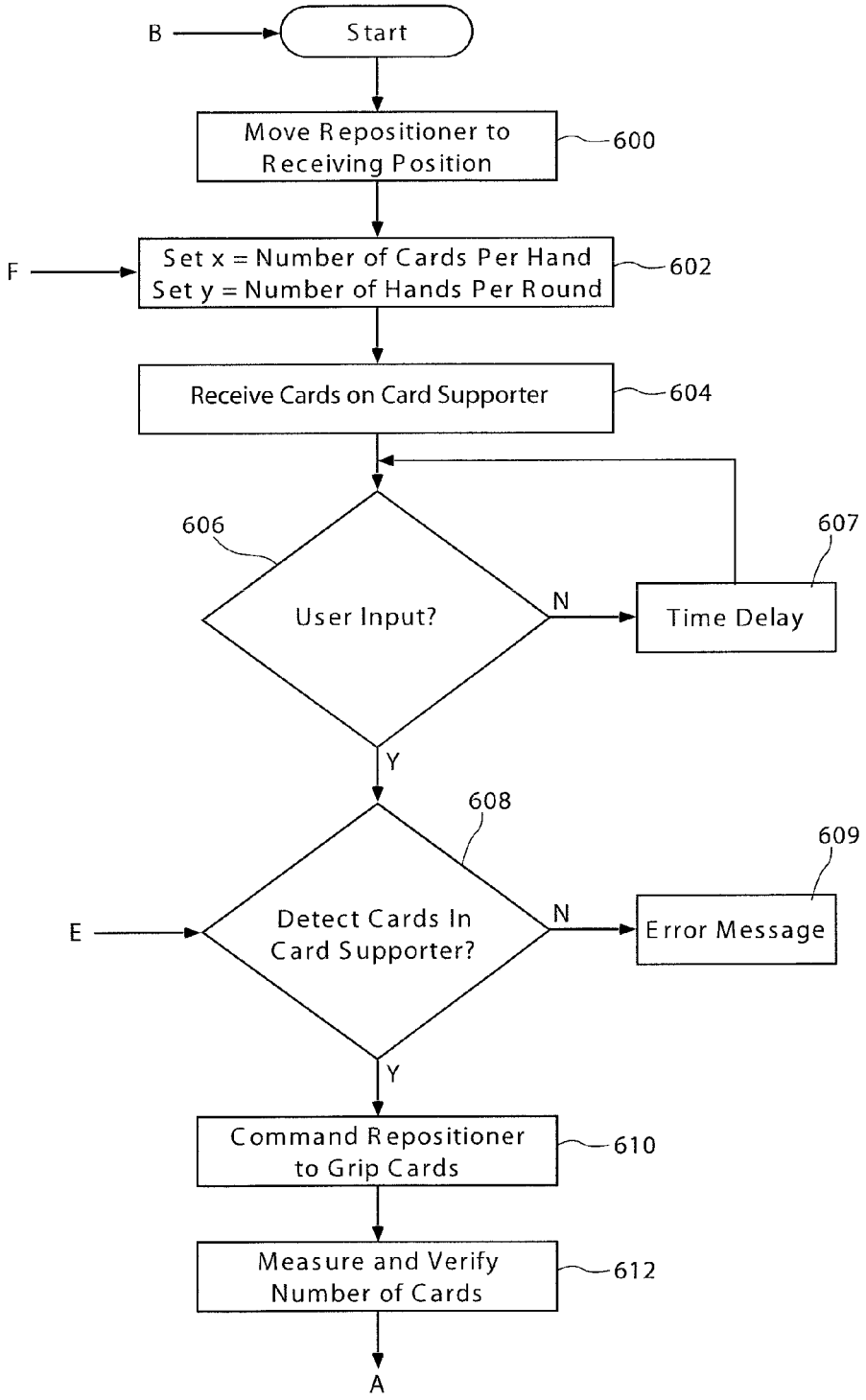
FIGS. 19A through 19C depict a flow diagram illustrating another operational sequence that may be performed using a shuffler apparatus as described herein.
Figure 19B:
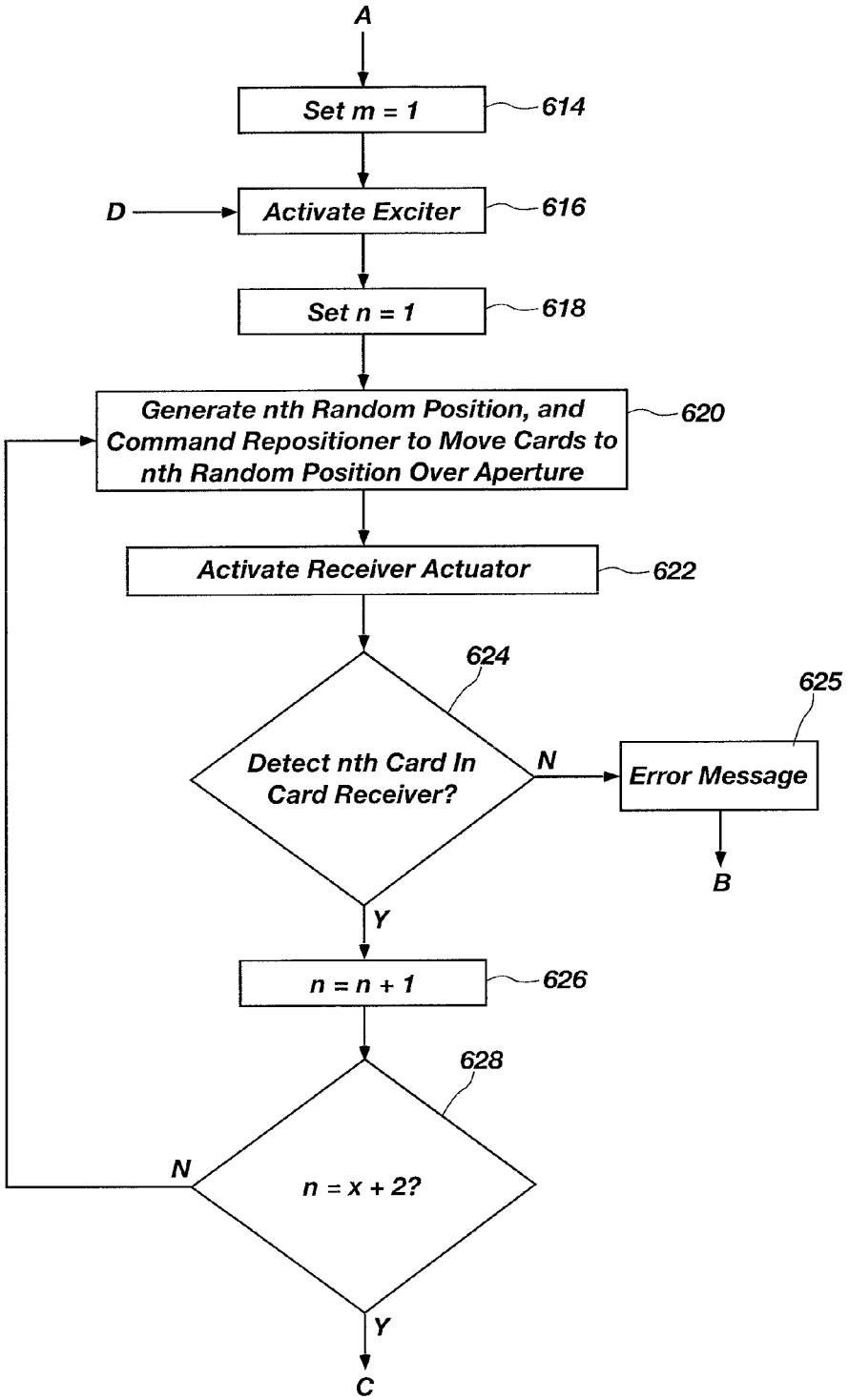
Figure 19C:
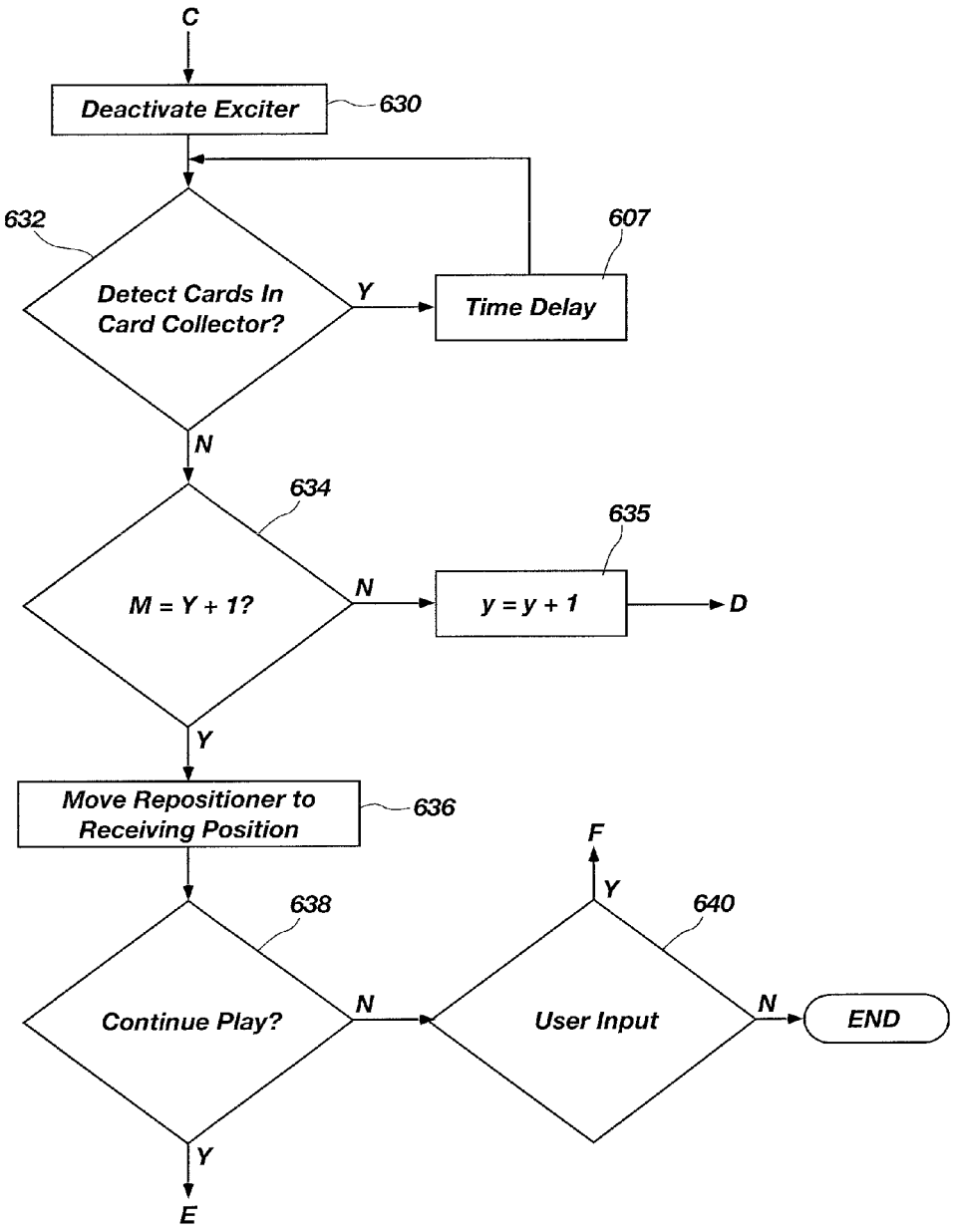
Figure 20:
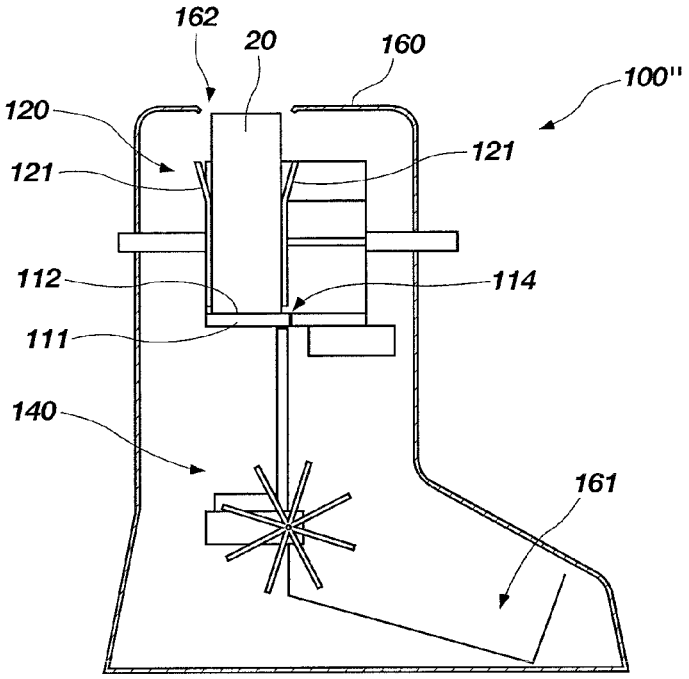
FIGS. 20 through 25 are simplified diagrammatic elevational views like that of FIG. 18 illustrating the shuffler apparatus shown therein at various points in an operational sequence as depicted in FIGS. 19A through 19C.

FIGS. 19A-19C illustrate a process flow chart used to describe additional processes that may be carried out using embodiments of shuffler apparatuses as described herein, wherein the shuffler apparatuses are used to generate playing card hands in one or more rounds of a playing card game. Any of the shuffler apparatuses described herein may be programmed to carry out processes as described herein with reference to FIGS. 19A-19C, although the description of the methods of FIGS. 19A-19C is set forth below with reference to FIGS. 20 through 25, which illustrate the shuffler apparatus 100" of FIG. 18 at various points in a process according to the process flow of FIGS. 19A-19C.

As a general overview, the processes of FIGS. 19A-19C may be carried out by a card shuffler apparatus as described herein and a person, such as a card dealer, using the card shuffler apparatus. Generally, the processes include supporting a stack of unshuffled playing cards on edge over a card support surface, and moving and randomly repositioning the stack over an aperture extending through the card support surface and allowing cards to pass sequentially from the stack through the aperture and into a card collector to form a first playing card hand in the card collector. Passage of cards through the aperture is paused after formation of the first playing card hand in the card collector. The first playing card hand is removed from the card collector, and passage of cards through the aperture is continued after removing the first playing card hand from the card collector to form a second playing card hand in the card collector. The second playing card hand then may be removed from the card collector.

Referring to FIG. 19A, the electrical power may be supplied to the shuffler apparatus 100" to start the operational sequence. In action 600, the control system 200 may cause the repositioner 120 to move to a receiving position shown in FIG. 20, wherein the face guides 121 of the repositioner 120 are separated from one another, and the space therebetween is aligned with the opening 162 in the housing 160. In this card receiving position, a user may insert a stack 20 of unshuffled playing cards through the opening 162 and into the card supporter 110 and the card support 110 may receive the cards 604 in the space between the face guides 121 of the respositioner 120.

In action 602 of FIG. 19A, certain variables in a computer program of the control system 200 (FIG. 2) may be set as desirable for any operational mode of the shuffler apparatus 100". For example, in action 602, a user may employ the user interface 151 of the control system to select a game to be played using the shuffler apparatus 100". A variable x, which may define the number of cards per hand for that particular game may be set, and a variable y, which defines the number of hands per round of game play, may also be set. In other embodiments, a user may manually select the values for variables x and y without selecting any particular game, which may have predefined values for the variables x and y. In other embodiments, the user interface 151 may provide a menu of game options, and selecting a game may determine how many cards per hand to deliver. Hands may be delivered until the device receives an instruction to stop delivering hands or a maximum number of hands have been delivered.

With continued reference to FIG. 19A, in action 604, a user may insert, and the card supporter 110 may receive, a stack 20 of unshuffled playing cards through the opening 162 and into the card supporter 110 in the space between the face guides 121 of the respositioner 120. Action 604 may be performed before, during, or after performance of action 602.

In action 606, the control system 200 may determine if a user has input any signal using the user interface 151 (FIG. 2), such as a "deal" or "begin play" signal. If not, the control system 200 may carry out a time delay as depicted in FIG. 19A prior to again determining if a user has input any signal using the user interface 151. Once a user has input a signal using the user interface 151, in action 608, the control system may determine whether any stack 20 of playing cards is present in the card supporter 110. The control system 200 may include a card present sensor (not shown in FIG. 18) used to detect the presence of one or more cards in the card supporter 110. If no cards are detected within the card supporter 110 by the control system 200, an error message may be provided to the user by the user interface 151 as shown in action 609. If cards are detected within the card supporter 110 in action 608, the control system 200 may command the repositioner 120 to grip the stack 20 of playing cards in the card supporter 110 in action 610.

Optionally, the control system 200 may be configured to measure and verify a number of cards within the stack 20 of unshuffled cards in action 612. The control system 200 may be configured to cause the face guides 121 to move toward one another and squeeze the stack 20 of unshuffled playing cards, and to record at least one measurement relating to a distance between the opposing face guides 121 as they squeeze the stack 20 of unshuffled playing cards. After acquiring the one or more measurements relating to the distance between the opposing face guides 121 as they squeeze the stack 20 of unshuffled playing cards, the control system 200 may be configured to run all cards in the stack 20 of unshuffled playing cards and to count and record the number of cards that pass through the shuffler apparatus 100". Thus, when the playing cards are again returned to the space between the face guides 121 in the card supporter 110, the control system 200 may again cause the face guides 121 to move toward one another and squeeze the stack 20 of unshuffled playing cards, and to record at least one measurement relating to a distance between the opposing face guides 121 as they squeeze the stack 20 of unshuffled playing cards. This second measurement may be compared with the first measurement obtained prior to running the cards through the shuffler apparatus 100" to verify whether or not the number of cards in the stack 20 of playing cards is the number of playing cards that are supposed to be present within the card supporter 110. This measurement and verification process of action 612 may be used to ensure that cards are not missing and that no additional cards are present in the stack 20 of playing cards before each round of game play. It is noted that the stack 20 of playing cards also may be weighed by the shuffler apparatus 100" using one or more load cells, in addition to, or instead of, obtaining a measurement relating to the distance between the opposing face guides 121 as they squeeze the stack 20 of unshuffled playing cards for such verification purposes.

Thus, in some embodiments of methods of the disclosure, the stack 20 of unshuffled playing cards may be positioned over the card support surface 112 within the card shuffler apparatus 100", and at least one of a weight and a thickness of the stack 20 of playing cards may be measured to obtain at least one first measurement. All cards in the stack 20 of playing cards may be dispensed from the card shuffler apparatus 100" and a number of the cards dispensed from the card shuffler apparatus 100" may be counted upon dispensing all cards in the stack of playing cards from the card shuffler apparatus. Cards of the stack 20 of playing cards dispensed from the card shuffler apparatus 100" then may be repositioned over the card support surface 112 within the card shuffler apparatus 100". At least one of a weight and a thickness of the repositioned cards may be measured to obtain at least one second measurement, and the at least one second measurement may be compared with the at least one first measurement. The control system 200 of the shuffler apparatus 100" may be configured to perform most of these actions, with the exception of the positioning and repositioning of the playing cards over the card support surface 112, which may be performed by a person using the shuffler apparatus 100".

Referring to FIG. 19B, after performing the optional measurement and verification process of action 612 (FIG. 19A), the control system 200 may set a counter variable m equal to the value one (1) in action 614, activate the exciter 130 in action 616, such that the card rest 111, the card support surface 112, and the playing cards supported therein begin to vibrate, and may set a counter variable n equal to the value one (1) in action 618.

At this point, the shuffler apparatus 100" is ready to begin formation of a first playing card hand comprising a plurality of playing cards randomly selected from the playing cards in the stack 20 of playing cards supported over the card support surface 112 in the card supporter 110. In action 620, the control system 200 may generate an "nth" random position for the repositioner 120 and cause the repositioner 120 to move (with the stack 20 of playing cards between the face guides 121 thereof) to the nth randomly selected position over the card aperture 114. In other words, the control system 200 may cause the repositioner 120 to move from the initial card receiving position shown in FIG. 20 to a randomly selected nth position over the card aperture 114, as shown in FIG. 21.

After moving the repositioner 120 to the randomly selected nth position over the card aperture 114, the control system 200 may command the receiver actuator 145 to actuate the guide wheel 192, so as to eject any card already present in the card space 149 of the card receiver 140 into the card collector 161. The actuation of the repositioner 120 in action 622 may be performed substantially at the same time that the repositioner 120 stops movement at the randomly selected nth position over the card aperture 114, or very quickly thereafter, such that the movement of the guide wheel 192 in action 622 will not prevent the nth card from falling into the card space 149 of the card receiver in the event that another card is not already present in the card space 149 of the card receiver.

Figure 21:
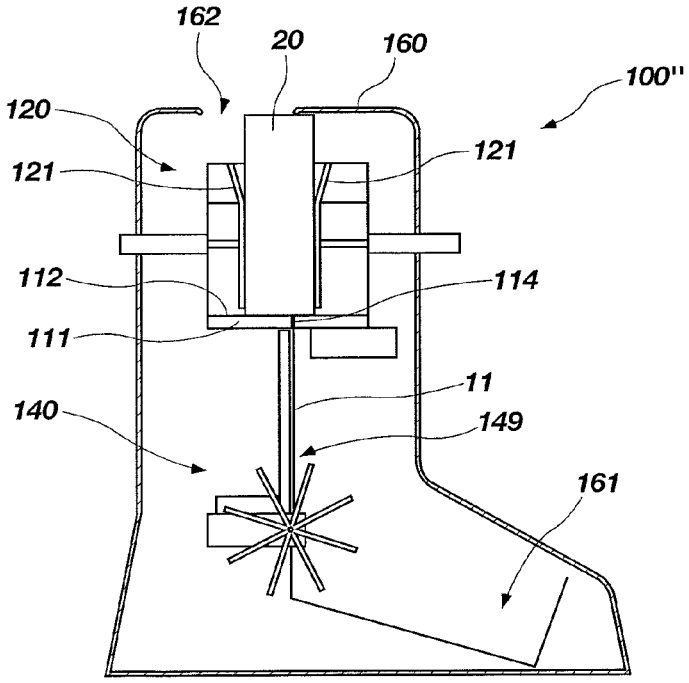

When the repositioner 120 stops at the randomly selected nth position over the card aperture 114, the nth (e.g., first) card 11 will drop through the card aperture 114 and fall into the card space 149 of the card receiver 140, as shown in FIG. 21.

The control system 200 may be configured to detect whether or not the nth card is present in the card space 149 of the card receiver 140 in action 624. If the nth card is not detected by the control system 200, an error message may be provided to a user by way of the user interface 151 of the control system 200, as shown in action 625, after which the control system 200 optionally reset and return to the start of the operational sequence (shown in FIG. 13A). If the nth card is detected in the card space 149 of the card receiver 140 by the control system 200, the counter variable n may be incremented by setting the counter variable n equal to the value n+1, as shown in action 626 of FIG. 19B.

After incrementing the counter variable n in action 626, the control system may determine whether or not the counter variable n is equal to x+2 (x representing the number of cards to be included in each playing card hand for the particular game being played). If the counter variable n is not equal to x+2, the number of cards in the card collector 161 will not equal the appropriate number of cards for the playing card hand to be performed, and the control system 200 will return to action 620. This loop will continue until the counter variable n does equal x+2, at which time the appropriate number of cards for the playing card hand to be formed will be present in the card collector 161.

Figure 22:
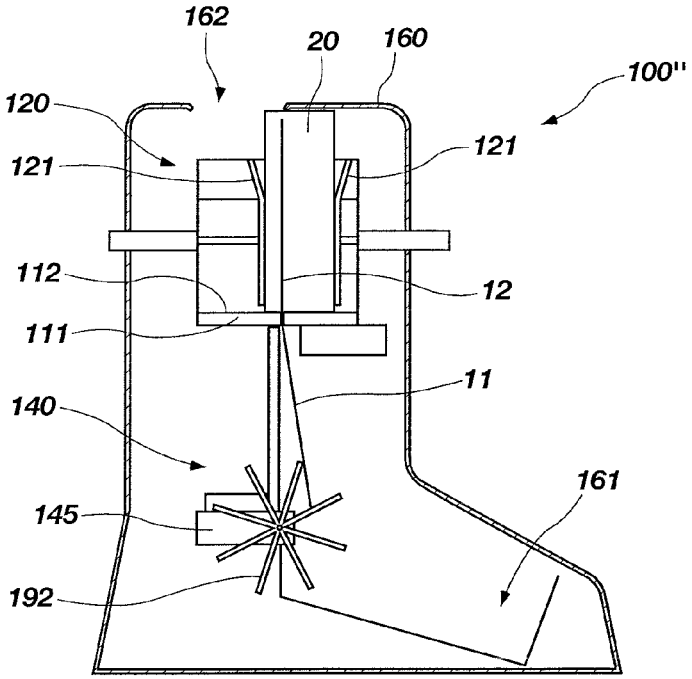

Thus, if each playing hand is to include three (3) cards, the first time the control system 200 reaches action 628, n will be equal to two (2), the first card of the hand being formed will be stored in the card space 149 of the card receiver 140, and no cards will be present in the card collector 161. Thus, the control system 200 will return to action 620. The control system 200 will then generate the $2^{nd}$ random position, and command the repositioner 120 to move the cards in the stack 20 to the $2^{nd}$ randomly generated position over the card aperture 114, as shown in FIG. 22. The presence of the first card 11 in the card space 149 of the card receiver 140 causes the card aperture 114 to be occluded by the first card 11, and prevents the second card from dropping through the card aperture 114. In action 622 (FIG. 19B), the control system 200 actuates the receiver actuator 145, which causes the guide wheel 192 to rotate and eject the first card 11 out from the card space 149 (as shown in FIG. 22) of the card receiver 140 and into the card collector 161.

Figure 23:
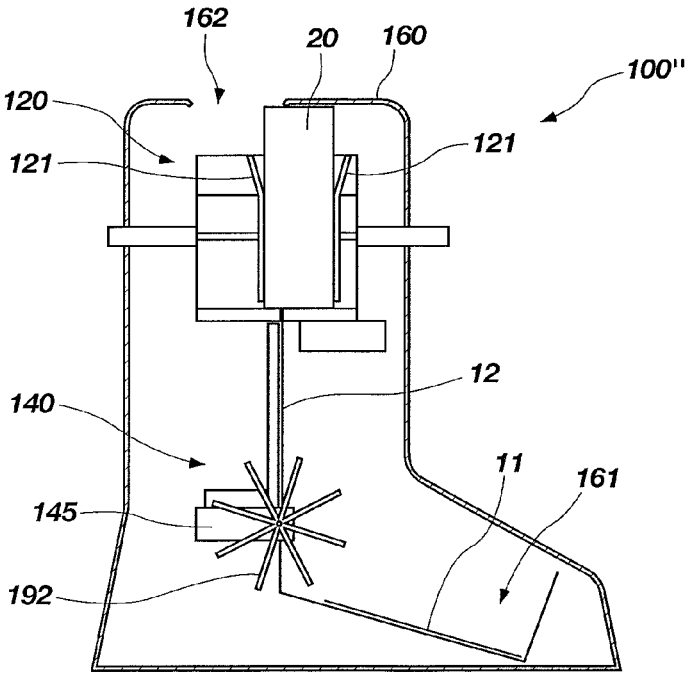
Figure 24:
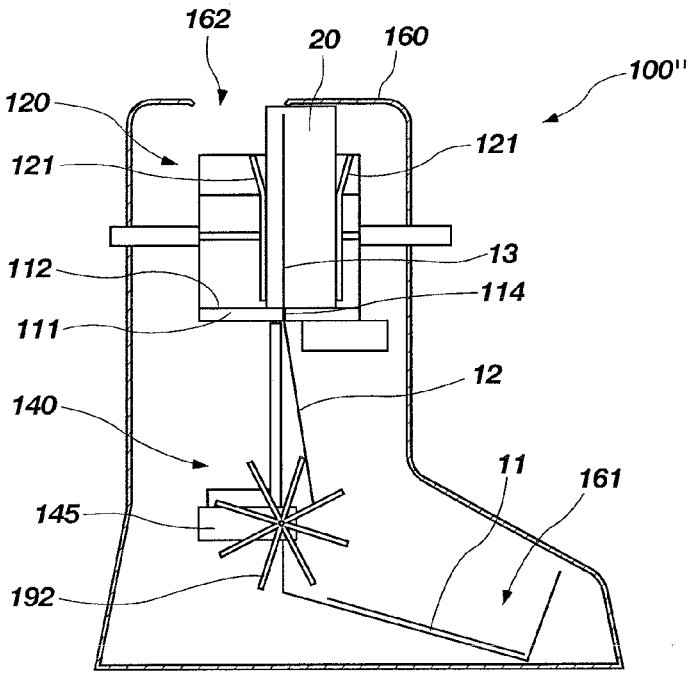

As the first card 11 is ejected out from the card space 149 and into the card collector 161, the card aperture 114 becomes unblocked, and the second card 12 falls through the card aperture 114 and into the card space 149 of the card receiver 140, as shown in FIG. 23. The control system will determine whether or not the second card 12 is detected in the card space 149 in action 624, and, if so, will increment the counter variable n from two (2) to three (3) in action 626. In action 628, the control system 200 will again determine whether or not the counter variable n, which at this point will have a value of three (3), equals x+2, which for a playing card hand of three (i.e., x=3) would be five (5). Since three is not equal to five, the control system 200 will again return to action 620. The control system 200 will then generate the 3rd random position, and command the repositioner 120 to move the cards in the stack 20 to the 3rd randomly generated position over the card aperture 114, as shown in FIG. 24. The presence of the second card 12 in the card space 149 of the card receiver 140 causes the card aperture 114 to be occluded by the second card 12, and prevents the third card 13 from dropping through the card aperture 114. In action 622 (FIG. 19B), the control system 200 actuates the receiver actuator 145, which causes the guide wheel 192 to rotate and eject the second card 12 out from the card space 149 of the card receiver 140 (as shown in FIG. 24) and into the card collector 161.

Figure 25:
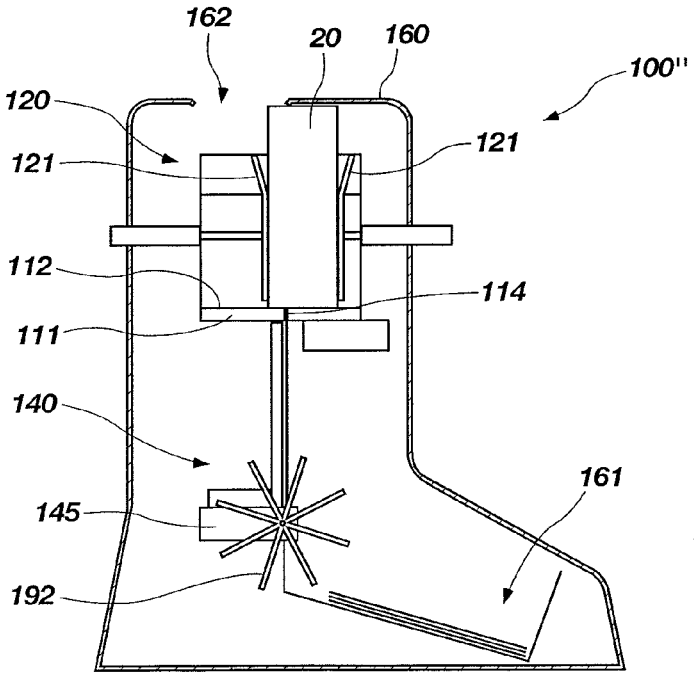

As the second card 12 is ejected out from the card space 149 and into the card collector 161, the card aperture 114 becomes unblocked, and the third card 13 falls through the card aperture 114 and into the card space 149 of the card receiver 140. The control system 200 will determine whether or not the third card 13 is detected in the card space 149 in action 624, and, if so, will increment the counter variable n from three (3) to four (4) in action 626. In action 628, the control system 200 will determine again determine whether or not the counter variable n, which at this point will have a value of four (4), equals x+2 (which, again, for a playing card hand of three would be five (5)). Since four is not equal to five, the control system 200 will repeat the process loop one more time, and, upon reaching action 628, three playing cards (cards 11, 12, and 13) will be present within the card collector 161 as shown in FIG. 25, and the counter variable n will be equal to x+2.

Referring to FIG. 19C, the control system 200 may then deactivate the exciter 630. At this point in time, the control system 200 waits for the user (e.g., a dealer) to remove the playing card hand from the card collector 161. For example, in action 632, the control system 200 may determine whether or not one or more cards are detected in the card collector 161 using a sensor. If cards are detected in the card collector 161, in action 607, the control system 200 may perform a time delay of, for example, as little as a fraction of a second to several seconds or more, prior to again returning to action 632 and determining if the cards have been removed from the card collector 161. Once the playing card hand has been removed from the card collector 161, and, for example, dealt to participant in a playing card game, cards will not be detected in the card collector in action 632, and the control system 200 will proceed to action 634. In action 634, the control system 200 determines whether or not the last playing card hand has been dealt for that particular round by determining whether or not the counter variable m is equal to the variable y, wherein y represents the number of playing card hands to be dealt in each round of game play. If the counter variable m is not equal to y, the control system will increment the value of m by one in action 635, return to action 616, and again generate another playing card hand within the card collector 161. This process is repeated until m does equal y, at which point a complete set of playing card hands have been randomly formed and dealt. At this point, m will equal y in action 634, and the control system 200 will move the repositioner 120 to the initial receiving position (shown in FIG. 20) in action 636, after which the control system 200 may employ the user interface 151 to determine whether or not a user would like to continue play of the same game in action 638. In other words, the control system 200 may determine whether or not a user would like to deal another round of playing card hands. In other embodiments, if fewer than the maximum number of players are at a gaming table, the user can input a command to stop delivery of hands when all players have received their cards.

If the control system 200 determines that a user would like to deal another round of playing card hands, the control system 200 will return to action 608 (shown in FIG. 19A) and randomly form and generate another round of playing card hands. If the user would not like to continue play in action 638, such as in the case that the number of players of the game changes, or the game to be played changes, the control system 200 may enter a standby mode and wait for user input as shown in action 640. If a user indicates that play would like to be resumed and provide input, the control system 200 may return to action 602 (shown in FIG. 19A) to allow the various operational parameters to be set by a user of the shuffler apparatus 100". At this point, a user may also end the process flow, and turn off the shuffler apparatus 100" in the event the user is finished using the shuffler apparatus 100".

The process flow described above with reference to FIGS. 19A-19C is set forth as one non-limiting example embodiment of methods by which shuffler apparatuses as disclosed herein may be used to form playing card hands for use in various playing card games, wherein each playing card hand includes randomly selected playing cards. Other process flows also may be carried out using shuffler apparatuses as described herein to form playing card hands in additional embodiments of methods of the disclosure.

Figure 26:
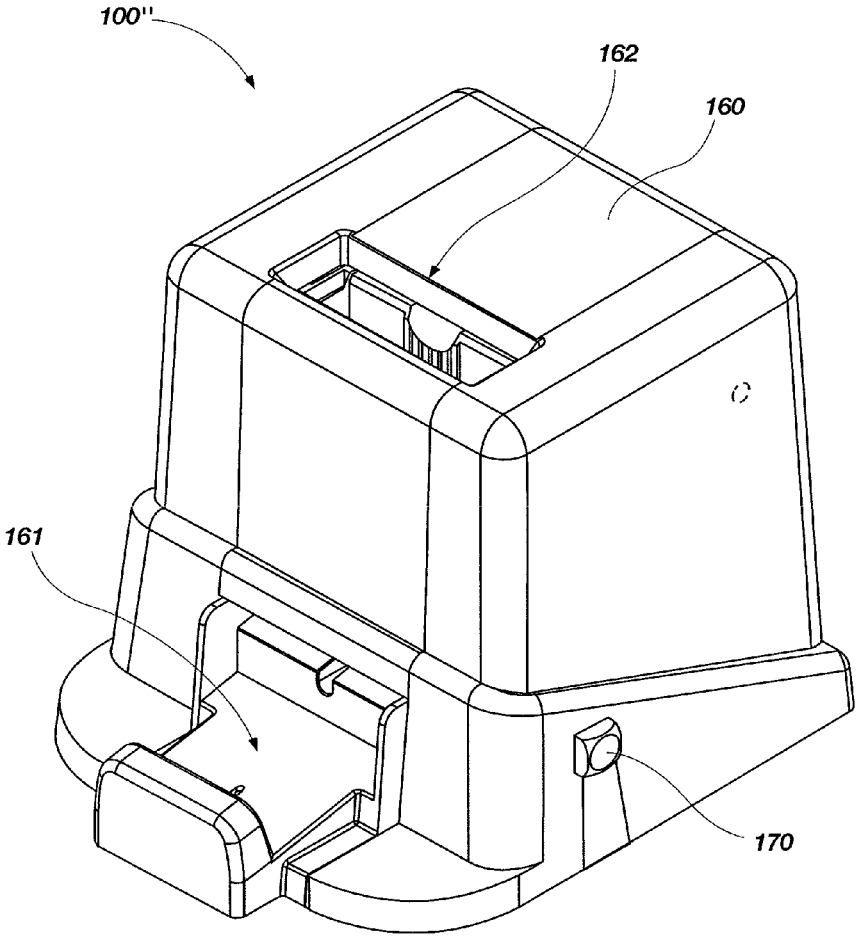
FIG. 26 is a perspective view of another embodiment of a shuffler apparatus of the disclosure, which accords generally to the shuffler apparatus diagrammatically depicted in FIGS. 18 and 20 through 25.

FIG. 26 is a perspective view of a non-limiting example embodiment of a shuffler apparatus 100" according generally to the schematic description provided with reference to FIGS. 18 and 20 through 25.

As shown in FIG. 26, the shuffler apparatus 100" includes a housing 160, and an opening 162 through the housing 160, through which unshuffled cards may be inserted into the shuffler apparatus 100" by a user. FIG. 26 also illustrates a card collector 161 of the shuffler apparatus 100". The card collector 161 sequentially receives one or more cards therein as they pass sequentially through the shuffler apparatus 100" as described herein.

As shown in FIG. 26, the shuffler apparatus 100" includes a button 170 on a lateral side thereof, which may be part of the user interface 151 of the control system 200 illustrated in FIG. 2. A similar button 172 (shown in FIG. 27) is located on the opposing lateral side of the shuffler apparatus 100". In some embodiments, the buttons 170, 172 may have duplicative functionality such that a user may use either of the buttons 170, 172 to operate the shuffler apparatus 100".

Figure 27:
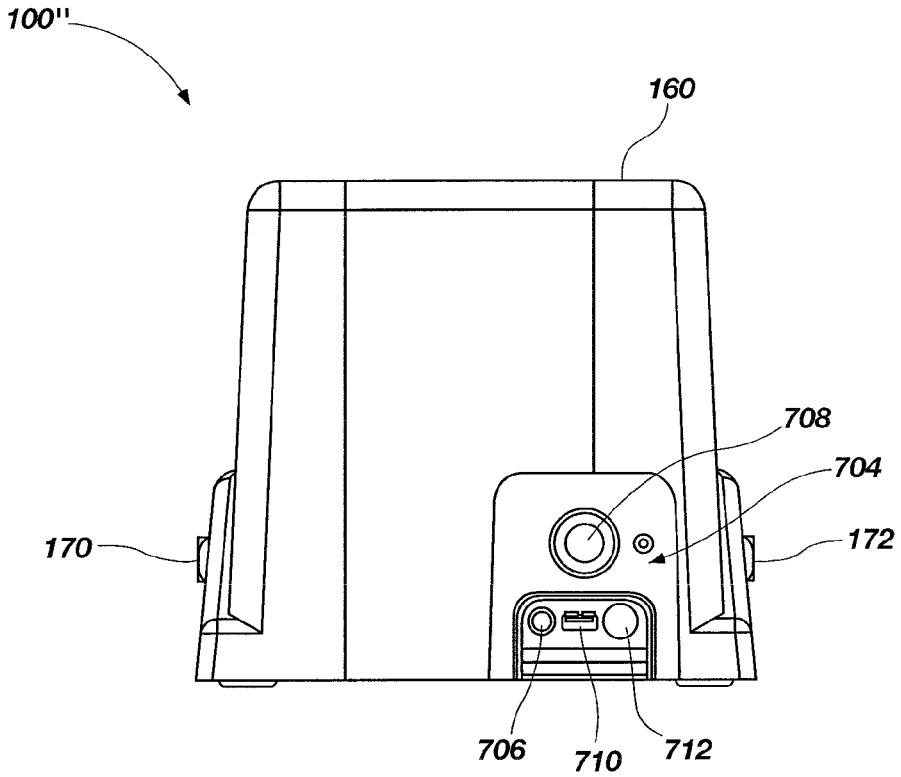
FIG. 27 is a plan view of a back side of the shuffler apparatus of FIG. 26.

As shown in FIG. 27, a control panel 704 may be exposed through the housing 160 on a back side of the shuffler apparatus 100". The control panel 704 may carry one or more components of the control system 200 (FIG. 2) of the shuffler apparatus 100". For example, the control panel 704 may include a power switch 706, a key-operated operational mode switch 708, and a USB port 710 for allowing the shuffler apparatus 100" to be connected to a computer or other data collection or control device. The control panel 704 may further include a plug 712. The plug 712 may be configured to receive an electronic activation device therein, and the shuffler apparatus 100" may be configured to operate only when the electronic activation device is inserted into the plug 712. The electronic activation device may comprise, for example, a key, which may include a radio frequency identification (RFID) device embedded therein. In this configuration, a manufacturer or seller (such term to include lease or rental) of shuffler apparatuses 100" may sell or lease a certain number of shuffler apparatuses 100" to a customer, such as a casino or other gaming establishment. A corresponding equal number of electronic activation devices may be provided for each of the shuffler apparatuses 100" sold or leased to the customer, so as to enable each of those shuffler apparatuses 100" to be operated simultaneously if desired. The manufacturer or seller of the shuffler apparatuses 100" may also provide one or more spare shuffler apparatuses 100" to the customer at reduced or no cost to the customer, without providing any additional electronic activation devices for those spare shuffler apparatuses 100". This may prevent the customer from using the spare shuffler apparatuses 100" unless one of the other shuffler apparatuses 100" is not being used, such that the customer can remove the electronic activation device from one of the other shuffler apparatuses 100" and use it to activate one or more of the spare shuffler apparatuses 100".

Figure 28:
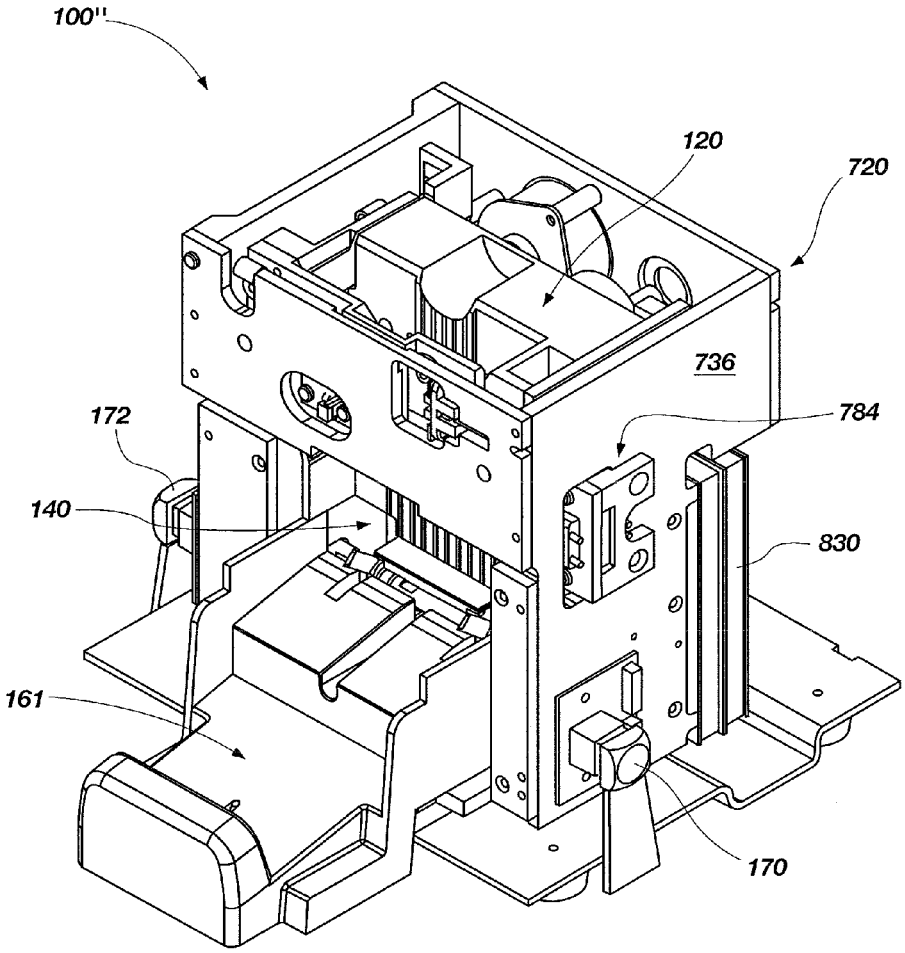
FIG. 28 is a perspective view of the shuffler apparatus of FIGS. 26 and 27 with an outer housing of the apparatus removed to reveal internal components thereof.
Figure 29:
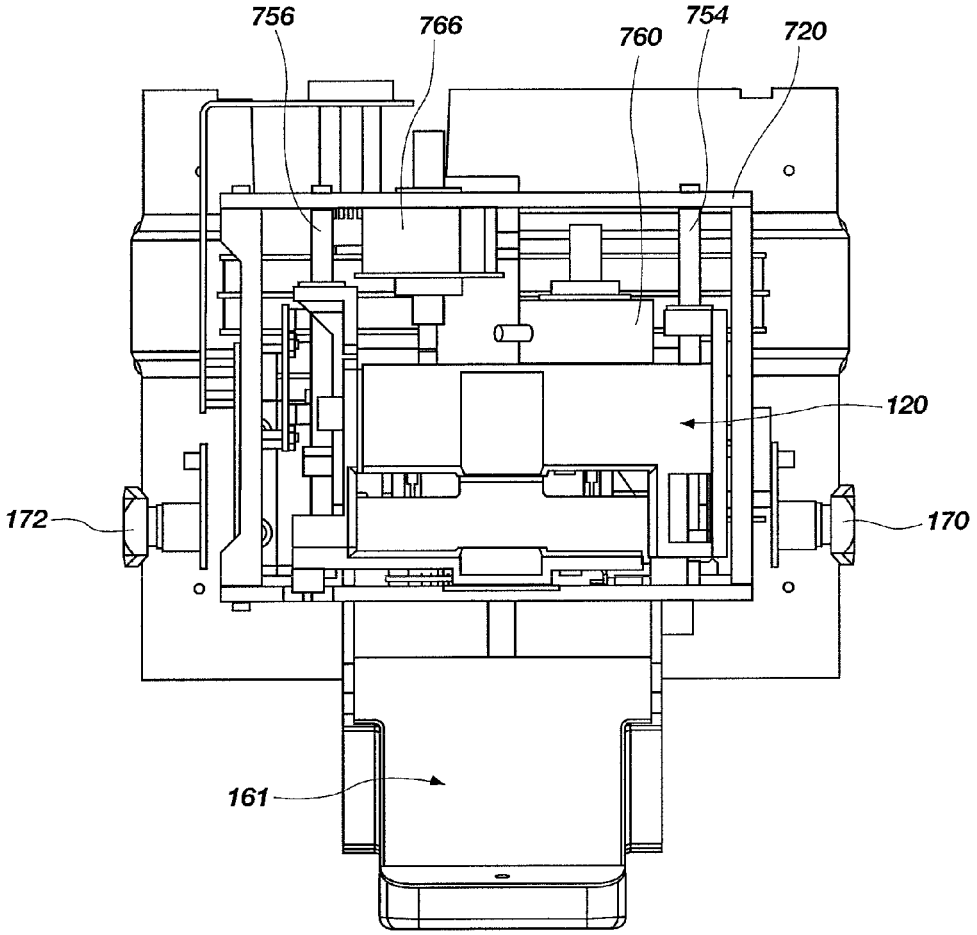
FIG. 29 is a plan view of a top side of the shuffler apparatus of FIGS. 26 and 27 with the outer housing of the apparatus removed to reveal internal components thereof.

FIGS. 28 and 29 show the shuffler apparatus 100" of the present disclosure with housing 160 removed. The shuffler apparatus 100" may comprise a frame or chassis 720, to which the other components of the shuffler apparatus 100" may be mounted. The chassis 720 may comprise one or more parts, which may be coupled together using, for example, bolts, screws, welds, etc., to form the assembled chassis 720. In some embodiments, the shuffler apparatus 100" may have a modular construction. For example, the shuffler apparatus may include a card input module, a card receiver module, and a card collector module, each of which may be separately formed as a subassembly and coupled to the chassis 720 during fabrication of the shuffler apparatus 100". The card input module may comprise the various components of the card supporter 110 and the repositioner 120, the card receiver module may include the various components of the card receiver 140, and the card collector module may include the various components of the card collected 161, as described herein. Such a modular construction may facilitate manufacture and/or repair of the shuffler apparatus 100".

Figure 30:
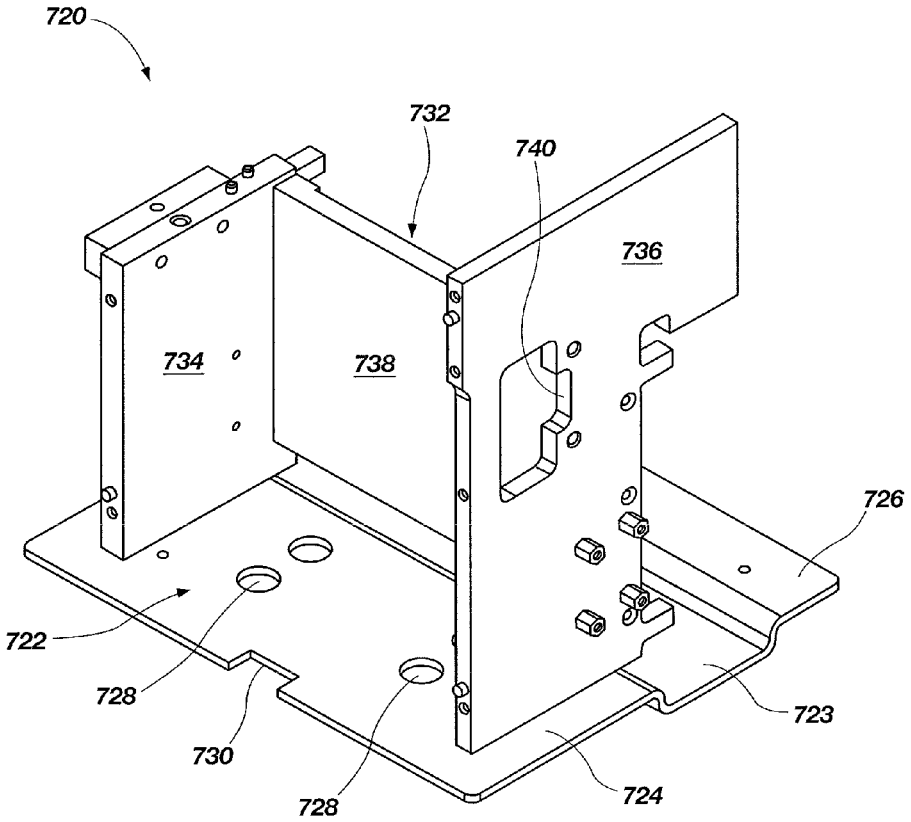
FIG. 30 is a perspective view of a chassis subassembly of the shuffler apparatus of FIGS. 26 through 29.

As shown in FIG. 30, the chassis 720 may include a base 722 having an elongated recess or trough 723 extending laterally across a width of the base 722 between a forward raised portion 724 and a rearward raised portion 726 of the base 722. A plurality of holes 728 may be formed through the forward raised portion 724. A notch 730 is also formed in the center of the edge of the forward raised portion 724 of the base 722. The chassis 720 further includes a support structure 732 comprising a left wall 734, a right wall 736, and a center wall 738 extending between the left wall 734 and the right wall 736. A key notch 740 may be formed through the right wall 736, as shown in FIG. 30.

Figure 31:
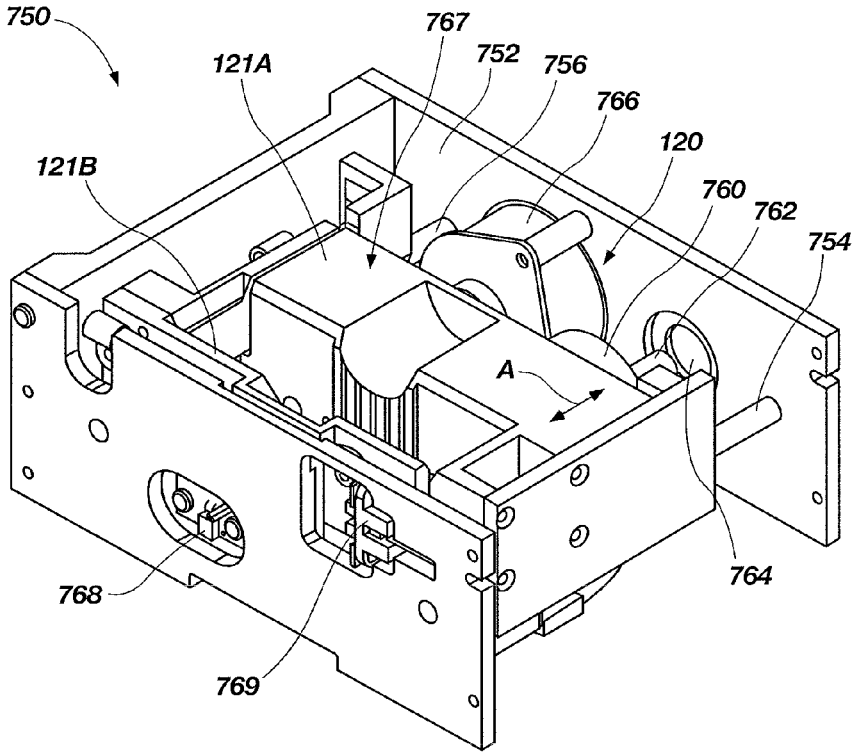
FIG. 31 is a perspective view of a positioner module of the shuffler apparatus of FIGS. 26 through 30.

The card input module 750 is shown in greater detail in FIG. 31. The card input module 750 includes a card supporter 110 and a card repositioner 120 as previously described herein. The card input module 750 includes a generally rectangular shaped frame 752, across which are mounted a first cylindrical guide shaft 754 and a second cylindrical guide shaft 756.

The frame 752 of the card input module 750 is configured to couple with the support structure 732 of the chassis 720 (FIG. 30). Complementary holes may be formed in the frame 752 and the support structure 732 for receiving one or more of alignment pins, bolts, screws, etc., therein to facilitate coupling of the frame 752 and the support structure 732.

The repositioner 120 includes two opposing face guides 121A, 121B, both of which slide along the guide shafts 754, 756. As shown by arrow A, a first face guide 121A is capable of moving toward or away from the second face guide 121B to increase or decrease a space between the face guides 121A, 121B in which unshuffled cards are inserted by a user.

The repositioner 120 may include a linear stepper motor 760 and associated flywheel 762, which may be mounted to a back side of the first face guide 121A and may be used to move the first face guide 121A toward or away from the second face guide 121B. As previously described, the distance separating the face guides 121A, 121B may be selectively adjusted to provide a predetermined amount of space ("fluff") between the cards in the space between the face guides 121A, 121B. A hole 764 may be formed through a wall of the frame 752 to accommodate the flywheel 762 of the stepper motor 760 as the first face guide 121A moves toward that wall of the frame 752. As a non-limiting example, the linear stepper motor 760 may comprise stepper motor Model No. 42 DBL-K commercially available from Portescap of West Chester, Pa.

With continued reference to FIG. 31, another linear stepper motor 766 may be used to move a carriage assembly 767 comprising each of the face guides 121A, 121B along the guide shafts 754, 756. The motor 766 moves the carriage assembly 767 under control of the control system 200 (FIG. 2) responsive to a randomizing algorithm performed by the control system 200. In this manner, the repositioner 120 may be used to randomly reposition the cards between the face guides 121A, 121B over the card rest 111 during operation of the shuffler apparatus 100", as previously described herein. As a non-limiting example, the linear stepper motor 766 may comprise stepper motor Model No. 42 DBL-K commercially available from Portescap of West Chester, Pa.

The repositioner 120 further includes an optical sensor 768 positioned within the second face guide 121B. The optical sensor 768 is used by the control system 200 of the shuffler apparatus 100" to detect the presence of playing cards inside the space between the face guides 121A, 121B. The repositioner 120 may further include an optical horseshoe sensor 769 located and configured to detect bending of the second face guide 121B. The second face guide 121B may be sized, shaped, and otherwise configured such that it will bend to a degree measurable by the optical horseshoe sensor 769 when playing cards are compressed between the opposing face guides 121A, 121B with a selected amount of force using the linear stepper motor 760. Thus, the control system 200 (FIG. 2) of the shuffler apparatus 100" may use the optical horseshoe sensor 769 to determine when to deactivate the linear stepper motor 760 when cards between the opposing face guides 121A, 121B have been compressed therebetween.

Figure 32:
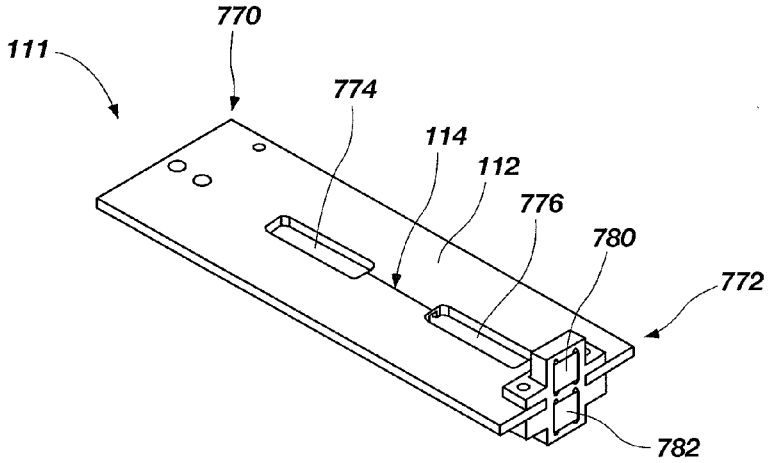
FIG. 32 is a perspective view of a cantilevered card support member of the positioner module of FIG. 31.

Although not visible in FIG. 31, the card input module 750 also includes a card rest 111, which is shown in FIG. 32. The card rest 111 may comprise an elongated cantilevered member having a card support surface 112. A card aperture 114 is faulted through the card rest 111, as shown in FIG. 32. The elongated card rest 111 may comprise a first end 770, and an opposing second end 772. The first end 770 may be fixedly attached to the support structure 732 of the chassis 720 (FIG. 30). The card rest 111 may be sized, configured, and located relative to the face guides 121A, 121B of the repositioner such that the card support surface 112 of the card rest 111 will support the cards positioned between the opposing face guides 121A, 121B when they are separated from one another by a maximum separation distance.

The card support surface 112 has a card aperture 114 extending through the card support surface 112 for allowing cards to pass through the card support surface 112. The card aperture 114 may be configured to allow passage of only one card through the aperture 114 at a time, as previously described.

As a non-limiting example, the aperture 114 may comprise a slot having a minimum width of between about 0.250 mm and about 0.580 mm. With continued reference to FIG. 32, in some embodiments, the card aperture 114 may comprise a first enlarged opening 774 passing through the card support surface 112 and the card rest 111 at a first end of the slot, and a second enlarged opening 776 passing through the card support surface 112 and the card rest 111 at an opposite second end of the slot. The enlarged openings 774, 776 may be used to accommodate playing cards that have been bent or otherwise deformed, which often occurs at the corners of playing cards, and reduce the occurrence of such cards jamming within the shuffler apparatus 100". The card aperture 114 may have any other shape or configuration that allows cards to pass sequentially therethrough one card at a time.

A majority of the length of the card rest 111 may be unsupported and free floating within the shuffler apparatus 100" to allow the card rest 111 to vibrate during operation of the shuffler apparatus 100", as described herein.

With continued reference to FIG. 32, two permanent magnets 780, 782 may be mounted to the unsupported second end 772 of the card rest 111. The permanent magnets 780, 782 may be secured within a bracket 786 that is attached to the unsupported second end 772 of the card rest 111.

Figure 33:
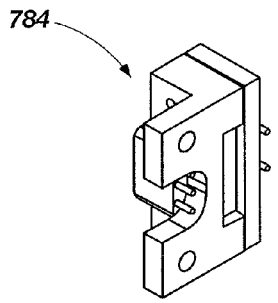
FIG. 33 is a perspective view of an electromagnet that may be used to cause the cantilevered card support member to vibrate.
Figure 34:
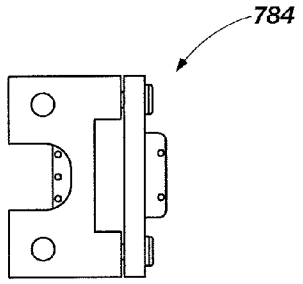
FIG. 34 is a plan view of a side of the electromagnet shown in FIG. 33.

FIGS. 33 and 34 illustrate an electromagnet 784, which may be mounted within the key notch 740 in the right wall 736 of the support structure 732 of the chassis 720, as shown in FIG. 28. The electromagnet 784 is positioned proximate the permanent magnets 780, 782 mounted on the unsupported second end 772 of the card rest 111 when mounted to the chassis 720.

The electromagnet 784 may comprise a 3-pole electromagnet. During operation, alternating current (AC) may be applied to the windings of the 3-pole electromagnet 784. As the current is applied, the three poles alternately reverse polarity. The electromagnet 784 interacts with the two permanent magnets 780, 782 mounted to the second end 772 of the card rest 111. The permanent magnets 780, 782 may be secured within the bracket 786 mounted with opposite polarities facing the electromagnet 784. As the polarities alternately reverse on the electromagnet 784, the permanent magnets 780, 782 experience alternating repulsive and attractive forces due to the magnetic field generated by the electromagnet 784. As a result, the card support 111 reacts by vibrating (e.g., oscillating up and down) as the poles of the electromagnet 784 alternately repel and attract the permanent magnets 780, 782 attached to the unsupported second end 772 of the card rest 111. In other words, the electromagnet 784 may operate in conjunction with the permanent magnets 780, 782 to cause the card rest 111 to vibrate in the vertical direction.

The vibrations may cause playing cards supported on the card support surface 112 of the card rest 111 to appear to be jumping or floating over the card support 111. As non-limiting examples, the vibrations of the card rest 111 may have a frequency in a range extending from about 10 Hz to about 100,000 Hz, more particularly in a range extending from about 100 Hz to about 10,000 Hz, and even more particularly in a range extending from about 1,000 Hz to about 10,000 Hz.

In some embodiments, it may be desirable to isolate the vibrating components from the frame to minimize vibration of the entire device. In such embodiments, the frame of the card input module 750 may be separate from the card receiver module 788, and the frame of the card input module 750 may be attached to other components of the shuffler apparatus 100" by means of springs and/or resilient grommets (not shown).

Figure 35:
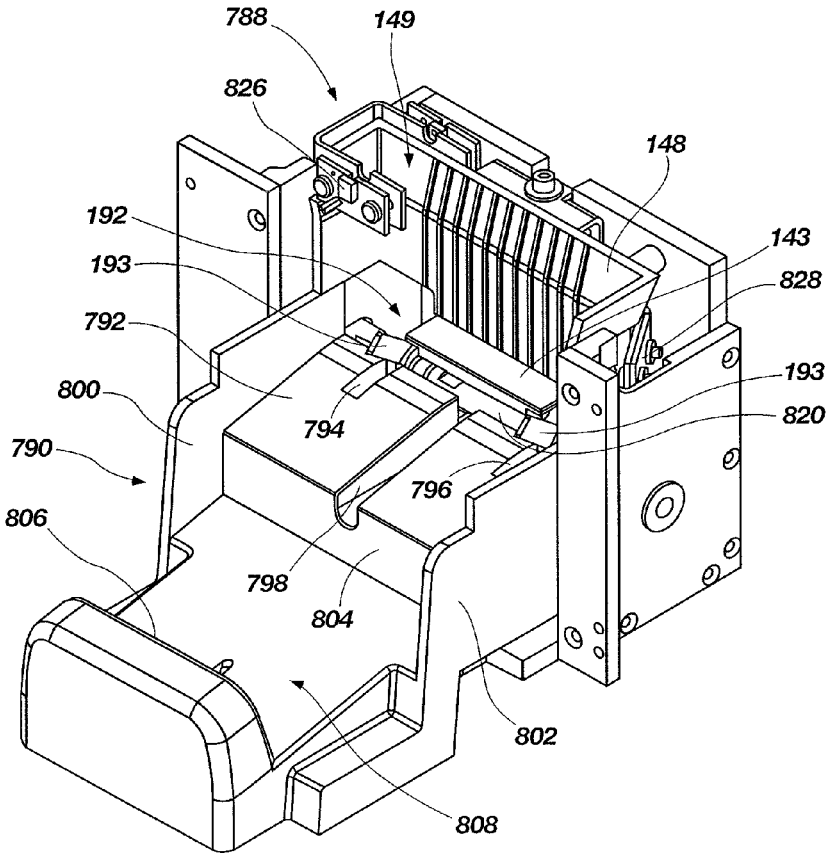
FIG. 35 is a perspective view of a card collector module of the shuffler apparatus shown in FIGS. 26 through 34.

FIG. 35 illustrates a card receiver module 788 and a card collector module 790 of the shuffler apparatus 100" assembled together. As shown in FIG. 35, the card receiver module 788 may include a U-shaped housing 792, which may be coupled to the chassis 720 (FIG. 30). The card collector 161 extends from the housing 792. The card collector 161 is shown separate from the U-shaped housing 792 in FIG. 36. As shown therein, the card collector 161 includes a ramp 792 having recesses 794, 796 therein, which are configured to allow the vanes 193 of the guide wheel 192 to pass therethrough as the guide wheel 192 rotates within the shuffler apparatus 100". A groove 798 may extend along the ramp 792, and may be used to provide access to a set screw (not shown) used to adjust a height of a card stop 143 of the card receiver 140 to compensate for different card dimensions. Side walls 800, 802, a knee wall 804, and a stop wall 806 of the card collector 161 may cooperatively define a card receptacle 808 in which shuffled cards may be collected and stacked. Each card that sequentially passes through the shuffler apparatus 100" will slide along the ramp 792, abut against the stop wall 806, and come to rest in the card receptacle 808 to form a playing card hand of randomly selected cards or a deck of randomly shuffled cards.

Referring again to FIG. 35, a card space 149 of the card receiver 140 is defined within the card receiver module 788. The card space 149 may be located directly below the card rest 111, a card stop 143 defines a lower boundary of the card space 149. As each card passes through the card aperture 114 in the card rest 111, it will move into the card space 149, and a lower edge of the card will abut against the card stop 143. Thus, the card may temporarily rest in place within the card space 149.

The card receiver 140 may include a sensor 826 located and configured to detect the presence of a card proximate a lower surface of the card rest 111 as the card passes through the card aperture 114 extending through the card rest 111. As a non-limiting example, the sensor 826 may comprise a radiation detector, such as Model No. QSE122 commercially available from Fairchild Semiconductor Corporation of San Jose, Calif., that operates in conjunction with a radiation emitter, such as Model No. OP240A commercially available from Optek Technology of Carrollton, Tex. The radiation emitter may be located and configured to emit radiation onto the radiation detector. As a card passes through the card aperture 114 of the card rest 111, however, the card may pass between the emitter and the detector and prevent the radiation from impinging on the detector, which will cause the sensor 826 to generate an electrical signal representing the presence of the card between the emitter and the detector.

The card receiver 140 may include an additional sensor 828, which may be located and configured to detect whether or not a card is properly positioned within the card space 149 such that a lower edge of the card is resting upon the card stop 143. By way of example and not limitation, the sensor 828 may comprise a sensor as described in relation to the sensor 826. Further, the presence of two sensors 826, 828 in the card receiver 140 may allow the control system 200 to determine the speed at which a card is moving into the card space 143.

In some embodiments, the card receiver 140 may comprise a selectively operable acceleration device, such as a pair of rotationally driven rollers 194 (FIG. 18) located below the card rest 111 and proximate a lower surface thereof. The pair of rollers 194 may be located and configured such that cards passing through the card aperture 114 in the card rest 111 will pass between the rotationally driven rollers 194. The control system 200 (FIG. 2) may be configured to detect when a card passing through the card aperture 114 and into the card space 149 is moving below a threshold speed using the two sensors 826, 828, and to selectively actuate the rotationally driven rollers 149 to accelerate such slowly moving cards into the card space 149 so as to enhance the consistency of the speed of operation of the shuffler apparatus 100". The rotationally driven rollers 194 may be driven by a motor (not shown) that is operably connected to a shaft of at least one of the rollers by a belt and pulley system. Operation may be continuous or intermittent. It may be possible to reduce the vibratory action imparted to the card support 111 by providing roller pairs 194. Roller pairs 194 may serve the additional function of overcoming static forces between adjacent cards on the card support 112.

To ensure that a card resting on the card rest 143 properly occludes the card aperture 114 as described herein, the relative distance between the card stop 143 and the card support surface 112 of the card rest 111 may be adjustable. For example, a card size adjustment system that includes a set screw (not visible in FIG. 35) may be used to raise or lower the card stop 143 relative to the card rest 111. The height of card stop 143 may be adjusted such that, when a playing card drops through the card aperture 114 in the card rest 111 and a lower edge of the card comes to rest on the card stop 143, an upper edge of the card will physically block the card aperture 114 and prevent additional cards from passing through the card aperture 114. In some embodiments, the shuffler apparatus 100" may be configured to automatically adjust the height of the card stop 143 using the assistance of one or more sensors to determine when the height of the card stop 143 results in proper occlusion of the card aperture 114 by a card in the card space 149 of the card receiver 140.

Figure 37:
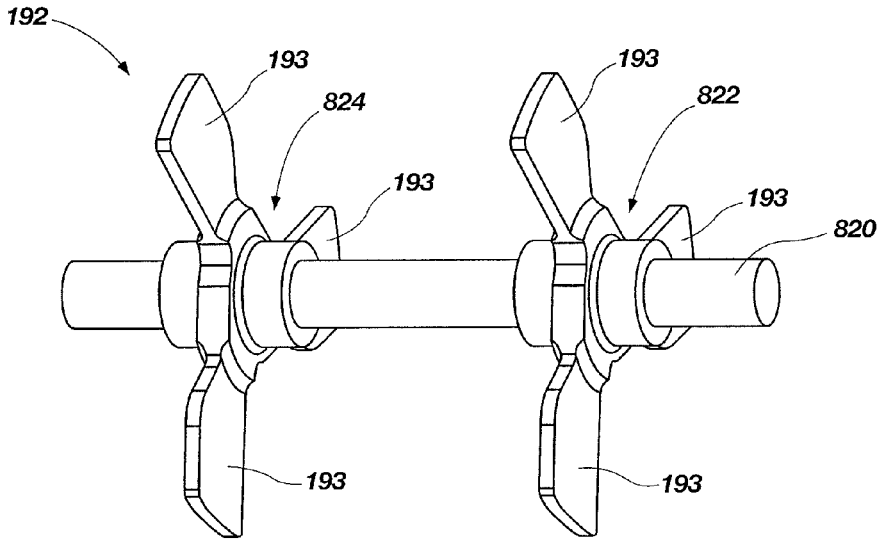
FIG. 37 is a perspective view of a paddle wheel assembly, which is part of the collector module of FIG. 35.

FIG. 37 illustrates the guide wheel 192 of the shuffler apparatus 100". The guide wheel 192 includes a shaft 820. The paddle wheels 822, 824 are carried on the shaft 820. Each of the paddle wheels 822, 824 includes a plurality of vanes 193 that extend in a radial outward direction from the shaft 820. Referring again to FIG. 35, the guide wheel 192 is shown installed within the card receiver module 788. The vanes 193 are illustrated in alignment with the recesses 794, 796 in the ramp 792 of the card collector 161. A rotational stepper motor (not shown) may be used to selectively rotate the shaft 820 and cause the vanes 193 to rotate about the rotational axis of the shaft 820. As a non-limiting example, the rotational stepper motor may comprise stepper motor Model No. 42S0100D1B commercially available from Portescap of West Chester, Pa. As the vanes 193 rotate, the vanes 193 will abut against and direct any playing card in the card space 149 out from the card space 149, onto the ramp 792, and into the card receptacle 808 of the card collector 161.

The card receiver 140 may further include a sensor (not shown) located and configured to detect rotation of the guide wheel 192. As a non-limiting example, such a sensor may comprise sensor Model No. OPB992T51Z commercially available from Optek Technology of Carrollton, Tex.

Figure 38:
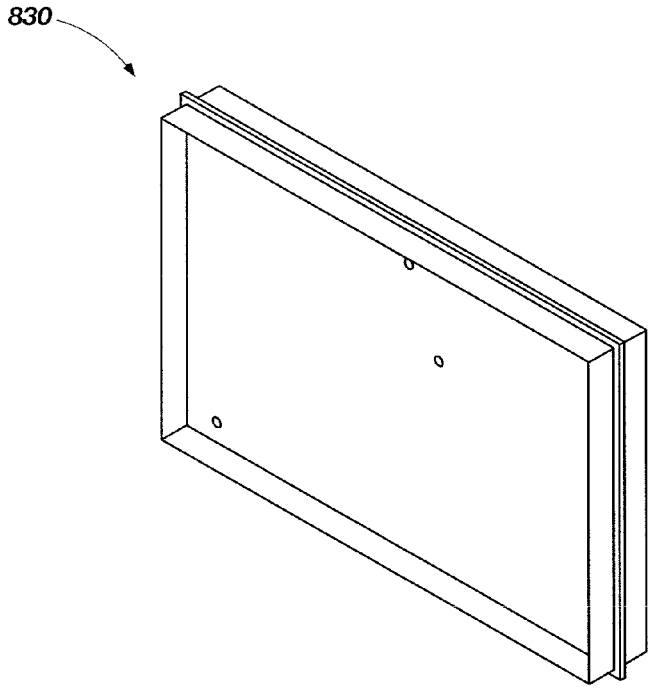
FIG. 38 is a perspective view of a circuit board of the shuffler apparatus of FIGS. 26 through 37.
Figure 39:
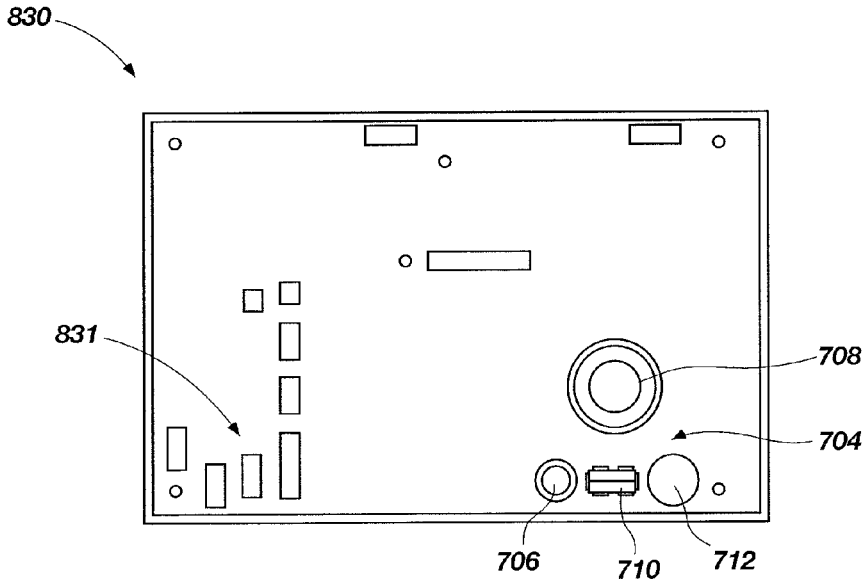
FIG. 39 is a plan view of the circuit board shown in FIG. 38.

The shuffler apparatus 100" comprises a circuit board 830, which is illustrated in FIGS. 38 and 39. The circuit board 830 may comprise or carry one or more of the various components of the control system 200 (FIG. 2), such as, for example, microprocessors, electronic memory devices, etc., used for controlling operation of the shuffler apparatus 100". The circuit board 830 may include a plurality of electrical connection sockets 831 used for electrically coupling the circuit board 830 with the various active components of the shuffler apparatus 100", including, for example, the stepper motors 760, 766 of the repositioner 120, the electromagnet 784, the guide wheel 192, and the various sensors of the shuffler apparatus 100". As shown in FIG. 28, the circuit board 830 may be mounted on a back side of the chassis 720 below the repositioner 120. At least some components of the control panel 704 may be carried on the circuit board 830, and may be exposed through the housing 160 as previously described with reference to FIG. 27.

Figure 36:
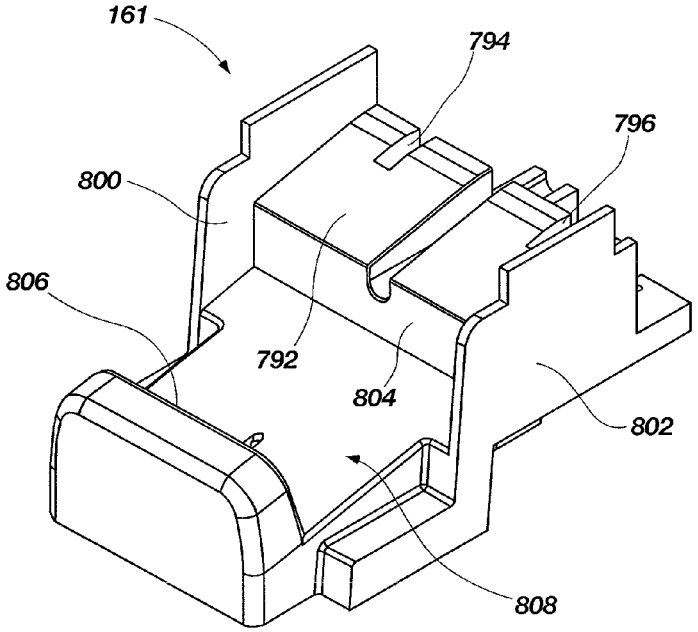
FIG. 36 is a perspective view of a card collection tray of the card collector module of FIG. 35.
Figure 40:
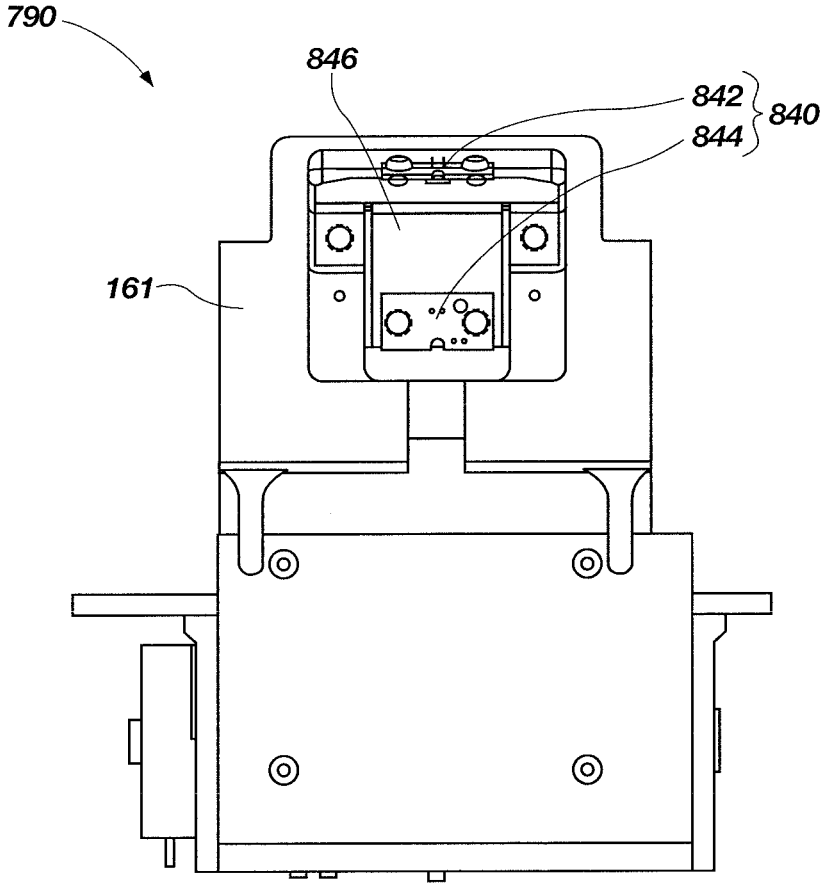
FIG. 40 is a plan view of a bottom side of the card collector module shown in FIG. 35.

FIG. 40 is a plan view of the bottom side of the card collector module 790. As shown therein, the card collector module 790 may include a sensor 840 that is located and configured to detect the presence of cards in the card receptacle 808 of the card collector 161 (FIG. 36). As a non-limiting example, the sensor 840 may comprise a radiation emitter 842, such as Model No. OP240A commercially available from Optek Technology of Carrollton, Tex., for example, and a radiation detector 844, such as Model No. QSE122 commercially available from Fairchild Semiconductor International, Inc., of San Jose, Calif., for example. The radiation emitter 842 may be mounted in the stop wall 806 of the card collector 161, and the detector 844 may be mounted in a bottom surface 846 of the card collector 161. The emitter 842 may be oriented to emit radiation onto the detector 844. Thus, when one or more cards are present within the card receptacle 808, the radiation emitted by the emitter 842 will be prevented from impinging on the detector 844, and the sensor 840 may generate an electrical signal indicating the presence of the one or more cards in the card receptacle 808.

Figure 41:
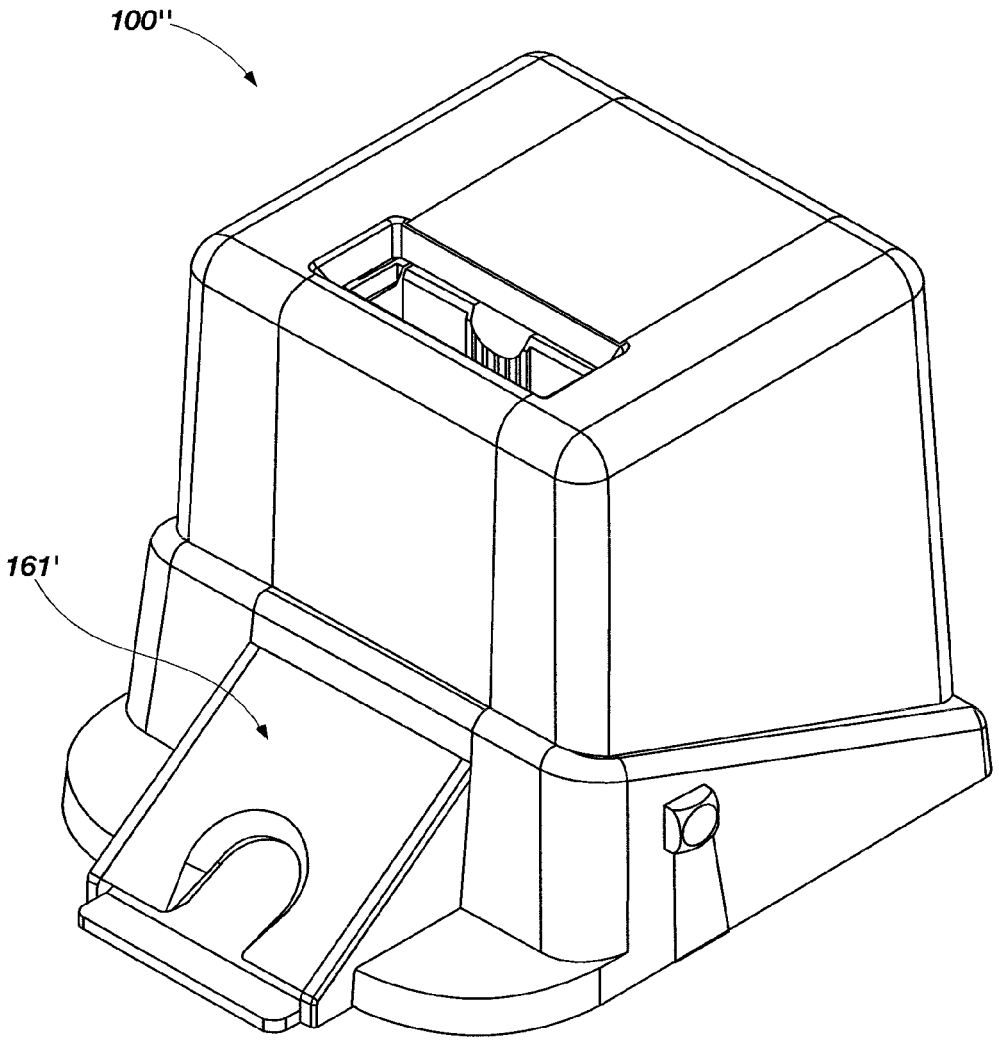
FIG. 41 is a perspective view of another embodiment of a shuffler apparatus of the present disclosure, which is similar to that described with reference to FIGS. 26 through 40, but includes a card collector tray in the card collector module that is configured as a card dealing shoe.

In additional embodiments, the shuffler apparatus 100" may comprise a card collector 161 having a different configuration. For example, FIG. 41 illustrates the shuffler apparatus 100" including a card collector 161' configured as a card shoe instead of a tray configuration. As shown more clearly in FIG. 42, card collector 161' comprises a mounting flange 850, which allows the card collector 161' to be removably inserted into and coupled with the card collector module 790 (FIG. 35). Such a card shoe configuration of the card collector 161' may be desirable for use, for example, in playing card games wherein single cards are to be randomly selected from the deck of playing cards, dispensed from the shuffler apparatus 100", and dealt one card at a time. Cards ejected into the card collector 161' by the guide wheel 192 (FIG. 35) will slide face down along a ramp 852 through a housing 854 to an card exit opening 856, from which the cards may be removed from the card collector 161' by a user. In some embodiments, cards may be positioned in the card collector 161' by means of card moving rollers, and held against a back surface of the front wall of the housing 854 by means of a sliding weight. The card support surface may be angled downward toward the finger opening 857. The sliding weight may be supported by the card support surface and hold delivered cards in place for manual removal.

In additional embodiments, the card shuffler apparatuses of the present disclosure may be configured to be mounted to a table such that upper surfaces of the shuffler apparatuses are generally flush with the upper surface of the table, and such that a majority of the operational components of the shuffler apparatuses are located below the plane of the upper surface of the table. A non-limiting example of such a card shuffling apparatus is described below with reference to FIGS. 43 and 44.

Figure 43:
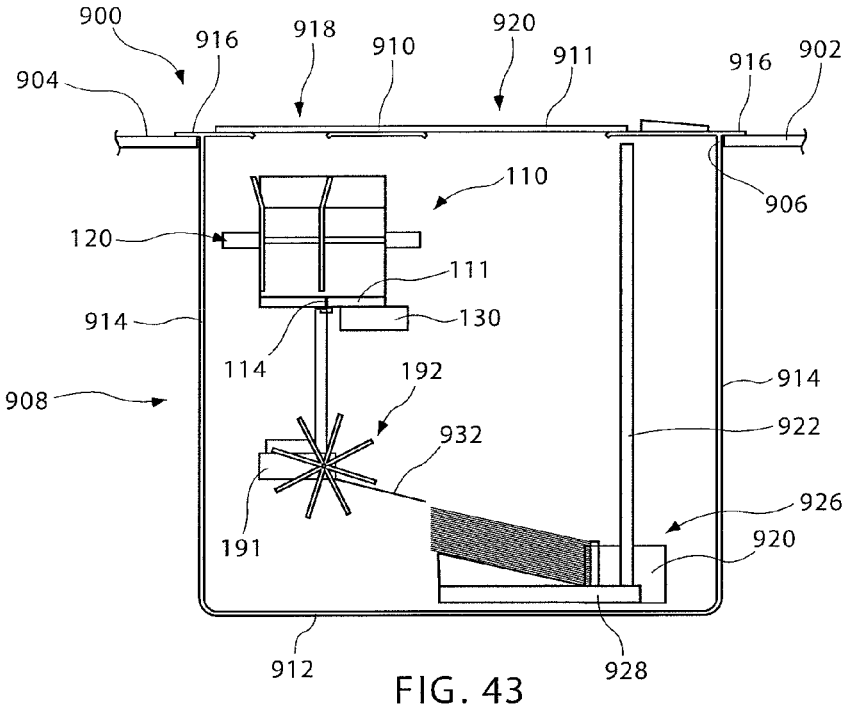
FIG. 43 is a diagrammatic view of another embodiment of a shuffler apparatus of the disclosure that includes an elevator system, and illustrates a platform of the elevator system in a lower position.

FIG. 43 is a simplified schematic illustration of another embodiment of a card shuffler apparatus 900 of the present disclosure. The card shuffler apparatus 900 has a card shuffling mechanism that is substantially similar to the card shuffler apparatus 100" of FIG. 18. For example, the card shuffler apparatus 900 includes a card supporter 110 having a card rest 111 with an upper support surface 112, and a repositioner 120 configured to randomly reposition a stack of cards held within the repositioner 120 over a card aperture 114 that extends through the card rest 111, as previously described herein. The card shuffler apparatus also includes an exciter 130 for exciting cards held within the repositioner 120 as they are moved over the card aperture 114. As cards drop through the card support 111 through the card aperture 114, they fall onto a card stop 191, as previously described herein. The card shuffler apparatus 900 also includes a device for moving cards off the card stop 191, such as a guide wheel 192 including vanes 193 as previously described herein.

The card shuffler apparatus 900 of FIGS. 43 and 44, however, are configured to be flush mounted in a table 902, such as a gaming table, such that upper surfaces of the card shuffler apparatus 900 are generally flush with an upper surface 904 of the table 902, and such that a majority of the operative components of the card shuffler apparatus 900, including the repositioner 120, the card support 111, the support piece 191, and the guide wheel 192, are located below the plane of the upper surface 904 of the table 902.

For example, the card shuffler apparatus 900 may include a housing 906. The housing 906 may include a horizontally oriented top wall 910, a horizontally oriented bottom wall 912, and one or more vertically oriented side walls 914 that extend between the top wall 910 and the bottom wall 912. The housing 906 also may include one or more flanges 916 that extend laterally outward at locations proximate the top wall 910 of the housing 908. A table 902 may include an aperture 906 extending therethrough that is sized and configured to allow the housing 908 of the card shuffler apparatus 900 to drop through the aperture 906 in the table 902 until the one or more flanges 916 come to rest on the surrounding areas of the upper surface 904 of the table 902 adjacent the aperture 906. Thus, the one or more flanges 916 may support the card shuffler apparatus 900 on the table 902 such that the card shuffler apparatus 900 is generally positioned below the table 902 and the upper surfaces of the card shuffler apparatus 900 are generally flush with the upper surface 904 of the table 902. In other embodiments, support brackets mounted to the bottom surface of the table may support the shuffler apparatus 900, even though flanges 916 may still be present. Of course, the card shuffler apparatus 900 may be supported relative to the table 902 using other techniques in additional embodiments of the disclosure.

Figure 44:
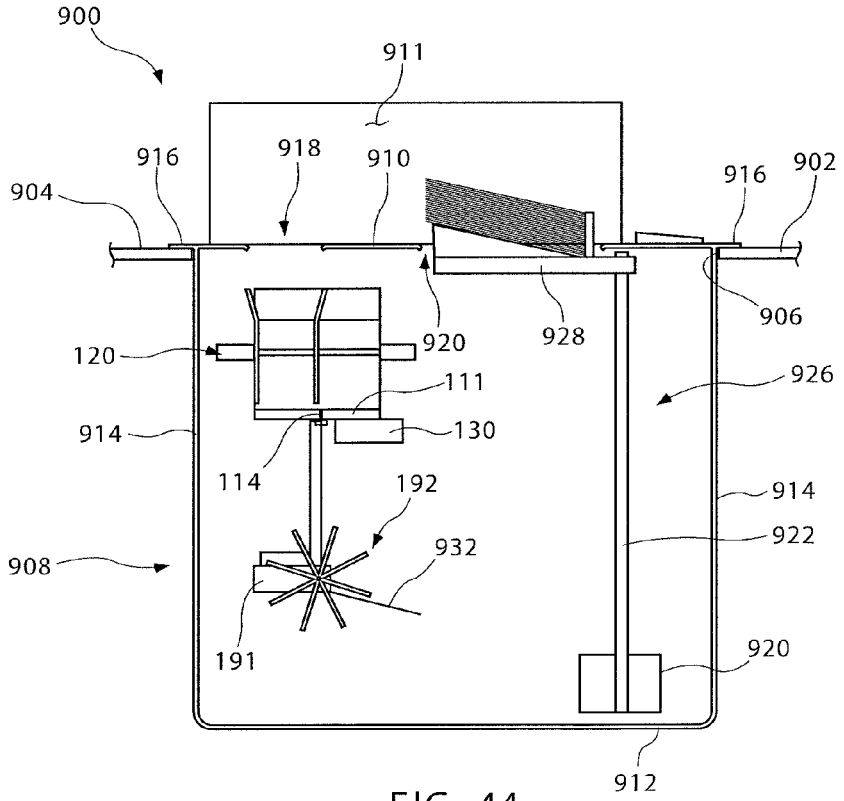
FIG. 44 is another view of the shuffler apparatus of FIG. 43 illustrating the platform of the elevator system in a raised position.

As shown in FIG. 43, the card shuffler apparatus 900 may include an optional lid 911, which may be movable between a closed position (as shown in FIG. 43) and an open position (as shown in FIG. 44). The lid 911 may be lifted and lowered mechanically or manually. One or more apertures may extend through the top wall 910 of the housing 908 to allow cards to be inserted into and retrieved from the card shuffler apparatus 900 during use. For example, a card input aperture 918 and a card output aperture 920 may extend through the top wall 910 of the housing 908.

The card shuffler apparatus 900 may include a device for raising a stack of shuffled cards to the surface 904 of the table 920. For example, an elevator system 926 may be used to raise shuffled cards to the surface 904 of the table 920. The elevator system 926 may include a platform 928 on which cards may be supported, and a device 930 for raising and lowering the platform 928. The device 930 is schematically illustrated in FIGS. 43 and 44. The device 930 may include, for example, a vertical track, a belt, and two or more pulleys. The platform 928 may be coupled to the vertical track, such that the platform 928 can slide up and down along the track within the card shuffler apparatus 900. In other words, the vertical track may guide movement of the platform 928 up and down within the card shuffler apparatus 900. Pulleys may be located at opposing ends (e.g., the top and bottom) of the vertical track, and the belt may be disposed on and positioned around the pulleys such that the belt may rotate in a circuitous manner as the pulleys rotate with rotation of the belt. The platform 928 may be coupled to the belt at a fixed location on the belt such that rotation of the belt around the pulleys causes the platform to move either up or down along the vertical track, depending upon the rotational direction of the belt. The device 930 may also include a motor which may be operably coupled with the belt and configured to selectively drive rotation of the belt. The device 930 may also include one or more sensors for sensing a position of the platform 928 to, for example, detect when the platform 928 is at the lowermost position (as shown in FIG. 43) and/or the uppermost position (as shown in FIG. 44) within the card shuffler apparatus 900.

Referring to FIG. 43, when the platform 928 is positioned at the lowermost position within the card shuffler apparatus 900, as cards are being shuffled using the repositioner 120, the card support 111, the support piece 191, and the guide wheel 192, the cards that are pushed off the support piece 191 by the guide wheel 192 may be directed onto the platform 928. For example, the cards may fall onto and slide along a guide surface 932, and the guide surface 932 may direct cards onto the platform 928 of the elevator system 926. In other words, cards pushed off the card support 191 by the guide wheel 192 may fall onto the guide surface 932 and then onto the platform 928 of the elevator system 926. In other embodiments, card moving elements may deliver the cards to the platform in a substantially horizontal orientation.

Once cards are disposed on the platform 928, the elevator system 928 may raise the platform 928 to the top of the card shuffler apparatus 900 and the upper surface 904 of the table 920. The optional lid 911 may automatically open as the platform 928 raises to the top of the card shuffler apparatus 900 and the upper surface 904 of the table 920, and may also automatically lower as the platform 928 is lowered within the card shuffler apparatus 900. The cards maybe elevated to a height near, at, or above the upper surface 904 of the table 920.

As previously mentioned, the card shuffler apparatus 900 may include a card input aperture 918 and a card output aperture 920 that extend through the top wall 910 of the housing 908. When the platform 928 is in the uppermost position shown in FIG. 44 and the optional lid 911 is open, the platform 928 may be positioned such that shuffled cards may be removed from the platform 928 through the card output aperture 920. Additional cards to be shuffled may also be inserted into the card shuffler apparatus 900 through the card input aperture 918 and disposed within the repositioner 120 when the platform 928 is in the uppermost position shown in FIG. 44 and the optional lid 911 is open.

The card shuffler apparatus 900 may be a batch shuffler that is configured to shuffle batches (e.g., decks) of cards. For example, a deck of unshuffled cards may be inserted into the card shuffler apparatus 900 through the card input aperture 918 and disposed within the repositioner 120. A card sensor may sense the presence of the cards in the repositioner 120. Another card sensor may sense the absence of cards on the platform 928. Upon sensing the presence of the unshuffled cards in the repositioner 120, and the absence of cards on the platform 928, the card shuffler apparatus 900 may automatically commence a shuffling cycle. In other embodiments, the card shuffler apparatus 900 may wait to receive a signal from a user to commence a shuffling cycle. Such a signal may be provided by pressing a button or making a selection on a control panel, for example. The platform 928 of the elevator system 926 may be lowered to the lowermost position shown in FIG. 43, and the cards in the repositioner 120 then may be shuffled as previously described herein with reference to FIGS. 18 through 25. The cards will be stacked on the platform 928 as they are shuffled, as previously described. When all the cards have been shuffled and stacked on the platform 928, the platform 928 may be raised to the upper most position shown in FIG. 44. The shuffled cards then may be removed from the platform 928 and used in a card game.

The shuffler apparatuses described herein may be programmed to enhance operation for a particular type of playing card used with the shuffler apparatuses. For example, both plastic and paper playing cards are used in the industry. The frequency and amplitude of the vibrations of the card support 111 caused by the exciter 130 that provide desirable speed and reliability in operation of the shuffler apparatus may differ depending on whether paper or plastic cards are being used. Further, the amount of air gap or "fluff" between cards in the repositioner 120 that results in desirable speed and reliability may differ depending on whether paper or plastic cards are being used. To accommodate such differences, the frequency and amplitude of the vibrations and the size of the air gap between the cards in the repositioner 120 (i.e., the distance separating the face guides 121 during operation) can be manually or automatically adjusted to improve the performance of the shuffler apparatuses. Thus, a first set of operational variables may be stored within memory controller for use by a computer program controlling operation of the shuffler when the playing cards used with the shuffler comprise a first type of playing cards (e.g., plastic), and a second set of operational variables may be stored within the memory of the controller for use by the computer program when the unshuffled playing cards comprise a different, second type of playing cards (e.g., paper).

The shuffler apparatuses described herein optionally may be used to measure and record various types of data relating to operation of the shuffler apparatuses. For example, the shuffler apparatuses may be programmed and configured to record the average number of playing card hands formed during each round of a playing card game over a period of time. Such data may be used to measure and analyze capacity utilization (e.g., table occupancy) for purposes of improving operational efficiency in a casino or other gaming establishment. As another example, the shuffler apparatuses may be programmed and configured to record the total number of playing card hands formed over a period of time. Such data may be used to measure and analyze the speed at which games are played using the shuffler apparatuses, and, hence, the efficiencies of dealers or other personnel using the shuffler apparatus.

Figure 42:
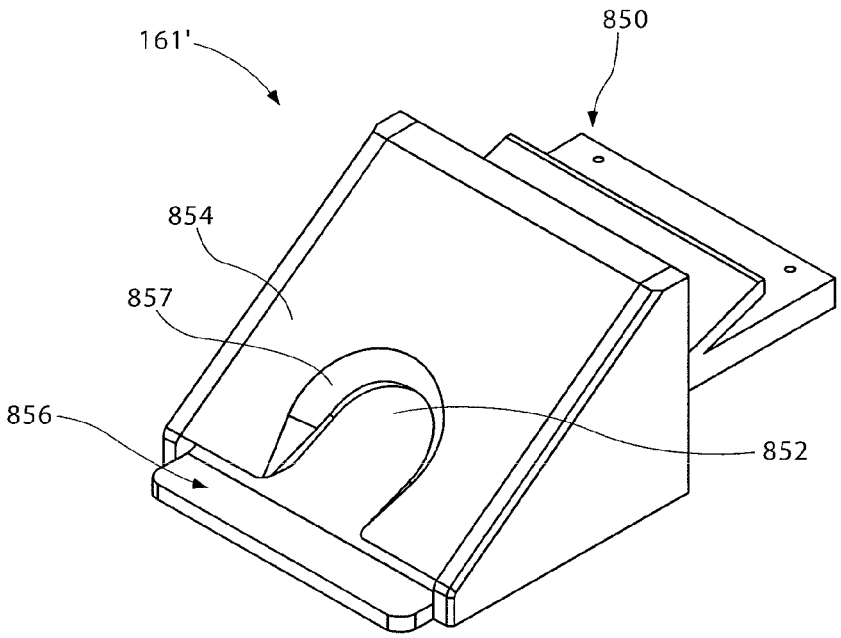
FIG. 42 is a perspective view of the card dealing shoe of the shuffler apparatus shown in FIG. 41.

The shuffler apparatuses described herein may be used to randomly shuffle a deck of playing cards to form playing card hands, each including cards randomly selected from a deck of playing cards, or to provide a continuous supply of cards delivered individually to a game. For example, the shuffler can be preprogrammed to deliver one or a few cards to a delivery shoe end 161' as shown in FIG. 42. In the continuous mode, the processor directs the card moving elements to deliver cards in response to receiving a sensor signal indicating that an inventory of cards in the shoe end 161' is low or depleted. Cards then may be delivered to the shoe end 161' until a sensor provides a signal that the card inventory is replenished, or a counter counts a predetermined number of cards moving into the shoe end 161' or that are present in the shoe end 161'. All cards coming off the table may be returned to the card support surface 111 to be randomized. In this embodiment, cards may always remain on the surface 111 during operation, and the group of cards on the surface 111 only unloads completely in response to a command input by the user through a user input device such as a button or a touch screen control.

The embodiments of shuffler apparatuses described herein may operate with fewer mechanical parts and reduced complexity, may operate at increased shuffling speed, and may operate with reduced incidences of cards jamming inside the apparatuses relative to previously known shuffler apparatuses, and, thus, may operate at an increased level of productivity and/or reliability relative to previously known shuffler apparatuses. Additionally, the shuffler apparatuses described herein may be characterized as two-stage shuffler apparatuses, wherein the first stage comprises a card input stage and the second stage comprises a card output stage. Playing cards may be selected and moved from the card input stage in a random, sequential order and passed directly to the card output stage in that same randomly selected sequential order without storing the cards in an intermediate carousel, cassette, or other storage compartment, as is performed in previously known three-stage shuffler apparatuses. In other words, cards may be passed into the card output stage in the same randomly selected order in which the cards are moved out from the card input stage in embodiments of shuffler apparatuses, as described herein.

While embodiments of the present disclosure have been described herein with reference to those example embodiments shown in the figures, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment to provide additional embodiments of the present invention as contemplated by the inventors.

What is claimed is:

1. A shuffler apparatus for randomly shuffling a plurality of cards, comprising:

a card support surface for supporting a plurality of cards thereon, the card support surface having an aperture extending through the card support surface for allowing cards of the plurality of cards to pass through the card support surface;

a repositioner for receiving and supporting the plurality of cards over the card support surface, the repositioner configured to randomly reposition the plurality of cards over the aperture extending through the card support surface to allow one or more cards of the plurality of cards to individually pass through the aperture in a random order; and a card collector for receiving the one or more cards of the plurality of cards therein in a same sequence with which the one or more cards pass through the card aperture and form a plurality of shuffled cards in the card collector;

wherein the shuffler apparatus is capable of forming a first playing card hand in the card collector and, in response to a signal received from a sensor that no cards are present in the card collector, forming an additional hand in the card collector.

2. The shuffler apparatus of claim 1, wherein playing card hands are supplied continuously, and wherein a plurality of cards remain on the card support surface during operation.

3. The shuffler apparatus of claim 2, wherein the shuffler apparatus is capable of continuously forming the playing card hands in the card collector as the playing card hands are sequentially removed from the card collector, employed in a playing card game, and returned and added to the plurality of cards over the card support surface without dispensing playing cards to be discarded from the shuffler apparatus.

4. The shuffler apparatus of claim 1, further comprising a shoe delivery end.

5. The shuffler apparatus of claim 1, wherein the aperture extending through the card support surface is configured to allow passage of only one card of the plurality of cards through the aperture at a time.

6. The shuffler apparatus of claim 5, wherein the aperture comprises a slot having an minimum width of between 0.250 mm and about 0.580 mm.

7. The shuffler apparatus of claim 6, wherein the aperture further comprises a first enlarged opening passing through the card support surface at a first end of the slot, and a second enlarged opening passing through the card support surface at an opposite second end of the slot.

8. The shuffler apparatus of claim 1, wherein the card support surface is at least substantially planar.

9. The shuffler apparatus of claim 1, wherein the card support surface is nonplanar.

10. The shuffler apparatus of claim 1, wherein the shuffler apparatus further comprises an exciter configured to vibrate the cards over the card support surface.

11. The shuffler apparatus of claim 10, wherein the card support surface comprises a surface on an elongated cantilevered member.

12. The shuffler apparatus of claim 1, further comprising a controller for controlling operation of the shuffler apparatus, the controller comprising:

at least one signal processor;

at least one memory device; and at least one computer program stored in the at least one memory device.

13. The shuffler apparatus of claim 12, wherein the at least one computer program is configured to cause the controller to store information in the at least one memory device relating to at least one of a number of playing card hands formed during a time period, a number of rounds of playing card hands formed during a time period, and a rate at which playing card hands were formed during a time period.

14. The shuffler apparatus of claim 12, wherein the controller further comprises at least one of an input device and an output device.

15. The shuffler apparatus of claim 14, wherein the at least one of an input device and an output device comprises an electronic alpha-numeric display device.

16. The shuffler apparatus of claim 14, wherein the at least one of an input device and an output device comprises a plurality of light-emitting diodes.

17. The shuffler apparatus of claim 14, wherein the at least one of an input device and an output device comprises an audio sensor configured to receive voice commands from a user of the shuffler apparatus, and wherein the controller is configured to respond to one or more voice commands received from a user of the shuffler apparatus by the audio sensor.

18. The shuffler apparatus of claim 12, wherein the controller is configured to control operation of the repositioner.

19. The shuffler apparatus of claim 18, wherein the controller is configured to record at least one measurement relating to a dimension of a stack comprising the plurality of cards over the card support surface.

20. The shuffler apparatus of claim 19, wherein the controller is configured to verify a quantity of cards in the stack of the plurality of cards over the card support surface using the recorded measurement.

21. The shuffler apparatus of claim 12, further comprising:

a first set of operational variables stored within the at least one memory device for use by the at least one computer program stored when the plurality of unshuffled playing cards comprise a first type of playing card; and a second set of operational variables, differing from the first set of operational variables, stored within the at least one memory device for use by the at least one computer program stored when the plurality of unshuffled playing cards comprise a second type of playing card differing from the first type of playing card.

22. The shuffler apparatus of claim 1, wherein the shuffler apparatus comprises:

a central module;

a card input module releasably coupled with the central module, the card input module comprising the card support surface and the repositioner; and a card output module releasably coupled with the central module, the card output module comprising the card collector.

23. The shuffler apparatus of claim 22, further comprising a vibration dampening device between the control module and the card input module.

24. The shuffler apparatus of claim 1, wherein the repositioner is configured to support the plurality of unshuffled cards on edge over the card support surface.

25. The shuffler apparatus of claim 1, further comprising at least one acceleration device configured and positioned to accelerate the one or more cards of the plurality of unshuffled cards as they sequentially pass through the aperture.

26. The shuffler apparatus of claim 25, wherein the at least one acceleration device comprises two rollers between which the one or more cards of the plurality of unshuffled cards pass as they sequentially pass through the aperture.

27. The shuffler apparatus of claim 1, wherein the one or more cards of the plurality of cards may move from the repositioner to the card collector without being stored in an intermediate holding compartment or receptacle.

28. The shuffler apparatus of claim 1, further comprising an activation device and a receptacle for receiving the activation device therein, operation of the shuffler apparatus being precluded when the activation device is not received within the receptacle.

29. A shuffler apparatus, comprising:

a repositioner for receiving and supporting a plurality of cards over a card support surface, the repositioner comprising opposing face guides configured to support opposing faces of a stack comprising the plurality of cards over the card support surface, at least one face guide of the opposing face guides configured to move relative to another face guide of the opposing face guides; and an electronic controller configured to control operation of the repositioner, the electronic controller configured to cause the at least one face guide of the opposing face guides to move toward the another face guide of the opposing face guides and squeeze the stack comprising the plurality of cards over the card support surface, the electronic controller further configured to record at least one measurement relating to a distance between the opposing face guides as the opposing face guides squeeze the stack comprising the plurality of cards therebetween.

30. The shuffler apparatus of claim 29, wherein the card support surface has an aperture extending through the card support surface for allowing cards of the plurality of cards to pass through the card support surface.

31. The shuffler apparatus of claim 29, wherein the repositioner is configured to randomly reposition the plurality of cards over the aperture extending through the card support surface to allow one or more cards of the plurality of cards to pass through the aperture in a random order.

32. The shuffler apparatus of claim 29, wherein the electronic controller is configured to verify a quantity of cards in the stack comprising the plurality of cards over the card support surface using the recorded at least one measurement.

33. The shuffler apparatus of claim 29, wherein the electronic controller comprises:

at least one signal processor;

at least one memory device; and at least one computer program stored in the at least one memory device.

34. A method of using a card shuffler apparatus to form one or more playing card hands in a playing card game, the method comprising:

supporting a stack of playing cards on edge over a card support surface;

moving and randomly repositioning the stack over an aperture extending through the card support surface and allowing cards to pass randomly from the stack through the aperture and into a card collector to form a first playing card hand in the card collector;

pausing passage of cards through the aperture after formation of the first playing card hand in the card collector for removal of the first playing card hand from the card collector; and continuing passage of cards through the aperture after the first playing card hand is removed from the card collector to form a second playing card hand in the card collector.

35. The method of claim 34, wherein pausing passage of cards through the aperture after formation of the first playing card hand in the card collector comprises at least partially plugging the aperture with a portion of a card.

36. The method of claim 35, further comprising sensing removal of the first playing card hand from the card collector using a sensor, and automatically continuing the passage of cards through the aperture after sensing removal of the first playing card hand from the card collector.

37. The method of claim 34, wherein allowing cards to pass randomly from the stack through the aperture and into a card collector comprises allowing passage of only one card through the aperture at a time.

38. The method of claim 34, further comprising vibrating the stack of cards over the card support surface while moving and randomly repositioning the stack over the aperture.

39. The method of claim 38, wherein supporting the stack of unshuffled playing cards on edge over the card support surface comprises supporting the stack of unshuffled playing cards on an elongated cantilevered member.

40. The method of claim 34, further comprising selecting the shuffler apparatus to include a controller for controlling operation of the shuffler apparatus, the controller comprising:

at least one signal processor;

at least one memory device;

at least one of an input device and an output device; and at least one computer program stored in the at least one memory device.

41. The method of claim 40, wherein the controller includes an input device, and wherein the method further comprises enabling the input of information into the controller using the input device.

42. The method of claim 41, wherein the input device comprises an audio sensor configured to receive voice commands from a user of the shuffler apparatus, and wherein the method further comprises receiving one or more voice commands with the audio sensor.

43. The method of claim 34, further comprising continuously and sequentially forming playing card hands in the card collector for removal of the playing card hands from the card collector, use of the playing card hands in a playing card game, and return and addition of the used playing card hands to the stack of playing cards without dispensing playing cards to be discarded from the shuffler apparatus.

44. The method of claim 34, wherein allowing the cards to pass randomly from the stack through the aperture and into the card collector comprises moving the cards from the stack to the card collector without storing the cards in an intermediate holding compartment or receptacle between the stack and the card collector.

* * * * *